US007596960B2

(12) United States Patent
Bae

(10) Patent No.: US 7,596,960 B2
(45) Date of Patent: Oct. 6, 2009

(54) INDOOR UNIT IN AIR CONDITIONER

(75) Inventor: Jae Buem Bae, Jinju-si (KR)

(73) Assignee: LG Electronics Inc., Seoul (KR)

( * ) Notice: Subject to any disclaimer, the term of this patent is extended or adjusted under 35 U.S.C. 154(b) by 305 days.

(21) Appl. No.: 10/959,145

(22) Filed: Oct. 7, 2004

(65) Prior Publication Data

US 2005/0076671 A1 Apr. 14, 2005

(30) Foreign Application Priority Data

Oct. 9, 2003 (KR) ..... 10-2003-0070213
Apr. 20, 2004 (KR) ..... 10-2004-0026932

(51) Int. Cl.
*F25D 23/12* (2006.01)

(52) U.S. Cl. ..... 62/263; 62/426

(58) Field of Classification Search ..... 62/314, 62/407, 419, 426, 262, 263
See application file for complete search history.

(56) References Cited

U.S. PATENT DOCUMENTS 3,112,623 A * 12/1963 Crossman ..... 62/419
3,831,395 A * 8/1974 Levy ..... 62/263
4,736,597 A * 4/1988 Anderson et al. ..... 62/239
4,835,981 A * 6/1989 Rinholen ..... 62/229
4,958,504 A * 9/1990 Ichikawa et al. ..... 62/244
5,065,596 A * 11/1991 Harris et al. ..... 62/262
5,388,426 A * 2/1995 Wada et al. ..... 62/263
6,412,298 B2 * 7/2002 Kang et al. ..... 62/262
6,422,028 B1 * 7/2002 Kim ..... 62/285
6,557,364 B2 * 5/2003 Gunji et al. ..... 62/263
6,786,061 B2 * 9/2004 Asami et al. ..... 62/263
2002/0144513 A1 * 10/2002 Gunji et al. ..... 62/263
2004/0094289 A1 * 5/2004 Harshberger et al. ..... 165/48.1

FOREIGN PATENT DOCUMENTS

CN 1249028 3/2000
EP 1 512 919 A1 3/2005
JP 10-238805 A 9/1998

* cited by examiner

*Primary Examiner*—William E Tapolcai
(74) *Attorney, Agent, or Firm*—Birch, Stewart, Kolasch & Birch, LLP

(57) ABSTRACT

An indoor unit of an air conditioner is provided. The indoor unit has an improved airflow structure, for a rapid air conditioning of the room, a user's convenience, and an efficiency of the air conditioner.

27 Claims, 57 Drawing Sheets

INDOOR UNIT IN AIR CONDITIONER

This Nonprovisional application claims priority under 35 U.S.C. § 119(a) on Patent Application No(s). 10-2003-0070213 and 10-2004-0026932 filed in Korea, Republic of on Oct. 9, 2003 and Apr. 20, 2004, respectively, the entire contents of which are hereby incorporated by reference.

TECHNICAL FIELD

The present invention relates to an indoor unit of an air conditioner, and more particularly, to an air conditioner which has an improved suction and discharge method such that the indoor unit of the air conditioner can have efficient inner structure.

BACKGROUND ART

Air conditioning system is an apparatus in which a refrigerant performs a refrigerant cycle including compression, condensation, expansion, and evaporation, in order to control the temperature of certain space according to user's desire. When the air conditioning system is operated to lower the temperature of the certain space, the air conditioning system is used as a cooling system. On the other hand, when the air conditioning system is operated to increase the temperature of the certain space, the air conditioning system is used as a heat pump. Meanwhile, the air conditioning system is usually used as the cooling system. The air conditioning system includes an indoor unit and an outdoor unit. The indoor unit is located in a humanly occupied space to supply a cool air thereto, and the outdoor unit is located at an outside of the humanly occupied space to release heat.

Further, the indoor unit includes a heat exchanger extracting heat from the humanly occupied space, a blower fan forcibly blowing an air to the heat exchanger to create a convective heat transfer therebetween for a fast supply of a cool air to the humanly occupied space. There are several kinds of indoor units such as a wall mount, a standing, a ceiling-suspended and a ceiling-embedded types according to the installation method of the indoor unit.

Typically, the wall mount type indoor unit is fixed to a wall of a room, and includes an air suction hole at an upper side and an air discharge hole at a bottom. However, it is not good for the user to use the typical wall mount type indoor unit having the above-mentioned structure because the suction hole is formed at the upper side and the discharge hole is formed at the bottom. In detail, the drawback is that the air conditioning is not rapidly performed for an entire indoor space because the discharging air is blown only in downward direction.

Further, an inside construction of the indoor unit is limited. For example, since a cross flow fan is installed in the related art indoor unit, a flow rate is restricted and the indoor unit has a large size because the cross flow fan occupies large portion of the indoor unit.

TECHNICAL PROBLEM

Accordingly, the present invention is directed to an indoor unit of an air conditioner that substantially obviates one or more of the problems due to limitations and disadvantages of the related art.

An object of the present invention is to provide an indoor unit of an air conditioner having an improved inner structure for constructing the indoor unit more efficiently.

Also, an object of the present invention is to provide an indoor unit of an air conditioner having an improved air suction and discharge method such that the indoor unit can be installed without limitation, thereby increasing user's convenience.

Further, an object of the present invention is to provide an indoor unit of an air conditioner which is intensively made for a simple and strong structure. Furthermore, the indoor unit can have a larger blast capacity than the same-sized indoor unit of the related art and thus can have an increased efficiency.

Further, an object of the present invention is to provide an indoor unit of an air conditioner which is designed to increase user's convenience.

TECHNICAL SOLUTION

To achieve these and other advantages and in accordance with the purpose of the present invention, as embodied and broadly described, there is provided An indoor unit of an air conditioner, comprising: a rear cover disposed at a rear side of the indoor unit and through which outdoor air is suctioned; a front frame disposed at a front side of the indoor unit and through which the outdoor air is discharged; a heat exchanger for performing heat exchange of the air suctioned through the rear cover; an air guide seated on an inner space formed by the rear cover and the front frame, for guiding airflow; a blower fan for forcibly flowing the air; an air guide hole formed at a middle portion of the air guide and through which the air is passed; and an upper air guide and/or a lower air guide and/or, the upper air guide being formed at an upper side portion a front side of the air guide to guide cool air, and the lower air guide being formed at a lower side portion of the front side of the air guide and spaced apart from the upper air guide, for guiding the cool air in a discharge direction.

In another aspect of the present invention, there is provided An indoor unit of an air conditioner comprising: a front frame forming a front appearance of the indoor unit; a rear cover forming a rear appearance of the indoor unit; a blower fan disposed behind the front frame; an air guide including an air guide hole formed at a middle portion of the air guide, for guiding an indoor air suctioned by the blower fan, an upper air guide and a lower air guide for guiding the air suctioned through the air guide hole, and a wind direction shifter mounting part formed at both side ends of the air guide; a wind direction shifter mounted inside the wind direction shifter mounting part; and a heat exchanger for performing heat exchange.

In a further another aspect of the present invention, there is provided An indoor unit of an air conditioner, comprising: a rear cover disposed at a rear side of the indoor unit; a front frame disposed at a front side of the indoor unit; a heat exchanger for performing heat exchange; a blower fan for forcibly flowing the air toward an inner space and an outer space of the indoor unit; and an air guide including an air guide hole for flowing the air, and an upper air guide formed at a front upper portion of the air guide, for guiding the air suctioned through the air guide hole to be discharged toward both side portions of the indoor unit.

ADVANTAGEOUS EFFECTS

An advantage of the present invention is that an indoor unit of an air conditioner has an improved structure for constructing the indoor unit more efficiently. Also, the indoor unit has an improved air suction and discharge method, such that the indoor unit can be conveniently mounted.

Further, an advantage of the present invention is that the indoor unit has a large blast capacity compared to its size and thus has an increased efficiency. Also, the indoor unit is made to have a simple and strong structure and thereby increases user's convenience.

DESCRIPTION OF DRAWINGS

The accompanying drawings, which are included to provide a further understanding of the invention and are incorporated in and constitute a part of this specification, illustrate embodiments of the invention and together with the description serve to explain the principles of the invention.

In the drawings:

FIG. 21 is a perspective view of a side plate according to the present invention;

FIG. 22 is a perspective view of a rear plate according to the present invention;

FIG. 23 is a perspective view showing a connection of a front plate and a side plate according to the present invention;

FIG. 31 is a partial enlarged view of "A" depicted in FIG. 27;

FIG. 38 is a perspective view of a drain pan according to the present invention;

FIG. 39 is a section taken on line V-V' in FIG. 38;

FIG. 43 is a front perspective view of an air guide according to the present invention;

FIG. 56 is a perspective view of a link according to the present invention;

FIG. 57 is a perspective view of a driven gear according to the present invention;

FIG. 58 is a perspective view of a driving gear according to the present invention;

FIG. 59 is a perspective view of a lower case according to the present invention;

FIGS. 61 and 62 are views showing an operation of an opening/closing device according to the present invention, in which FIG. 61 shows transfer parts located at outward position and FIG. 62 at inward position;

FIG. 71 is a perspective view of a motor mount according to the present invention.

BEST MODE

The present invention will be understood apparently with the following embodiments. However, the present invention should not be construed as being limited to the embodiments set forth herein and it will be understood by those of ordinary skill in the art that various changes in form and details may be made therein without departing from the spirit and scope of the present invention.

Figure 1:
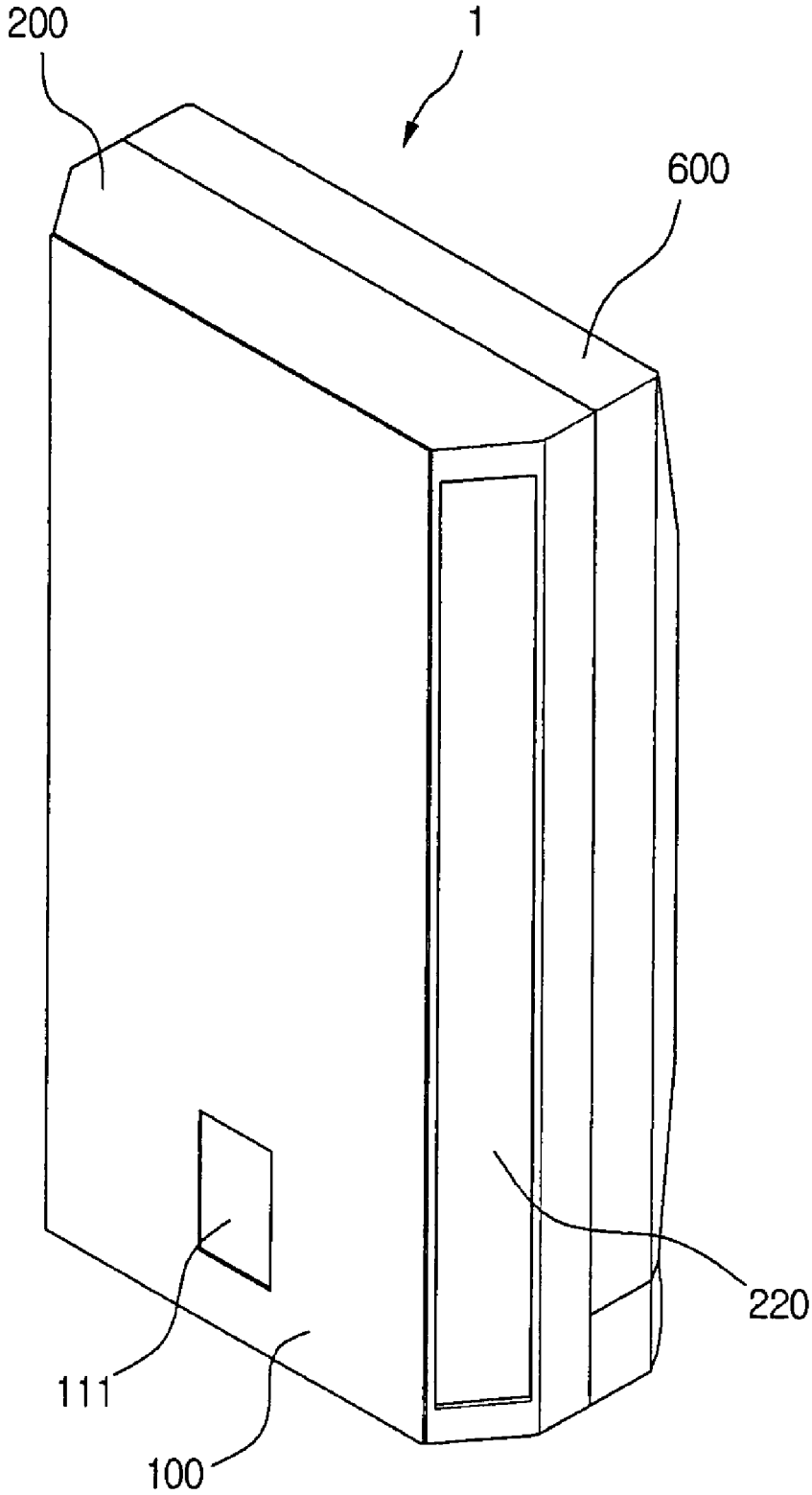
FIG. 1 is a front perspective view schematically showing an indoor unit of an air conditioner according to the present invention.
Figure 2:
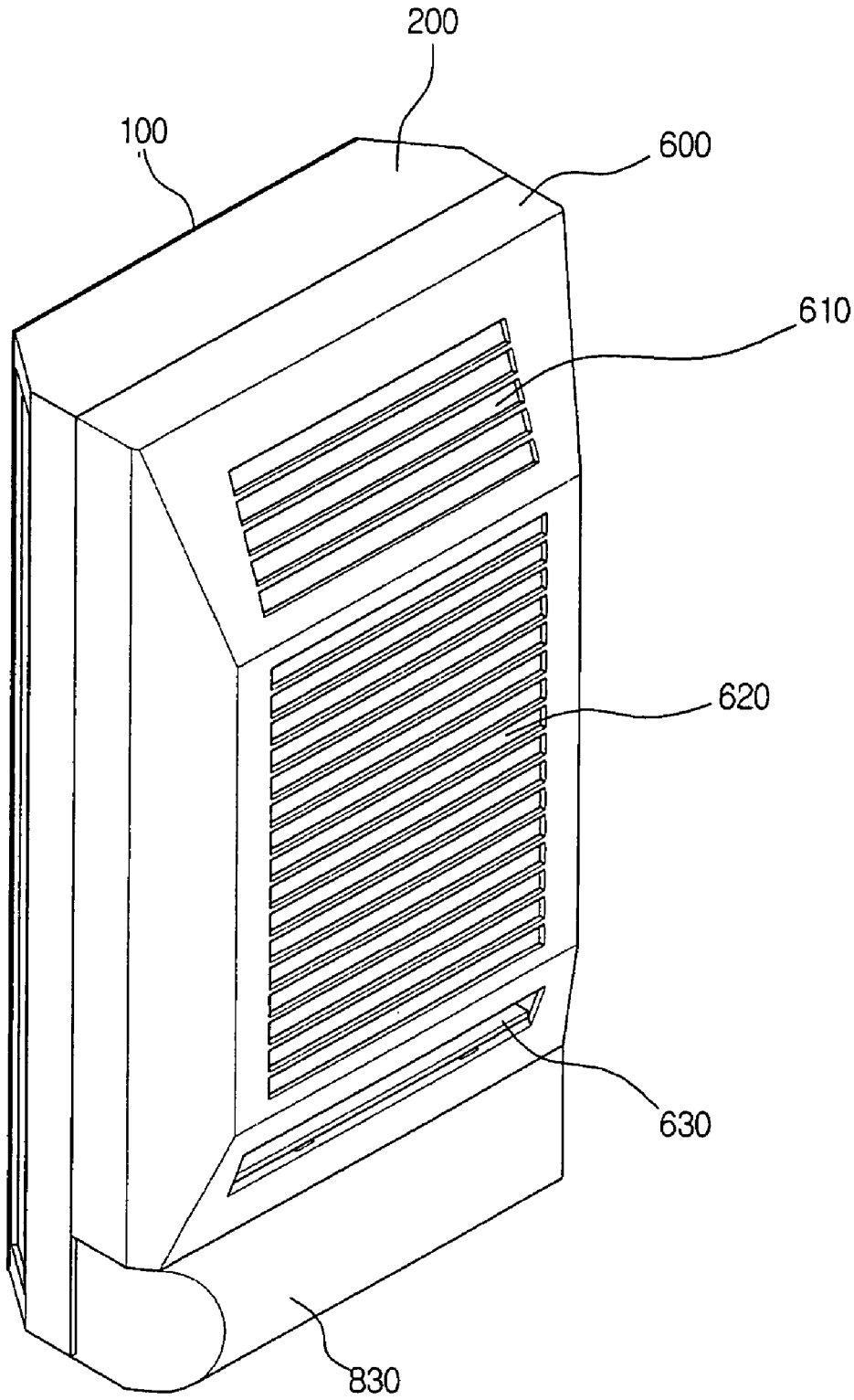
FIG. 2 is a rear perspective view schematically showing an indoor unit of an air conditioner according to the present invention.

FIG. 1 is a front perspective view schematically showing an indoor unit of an air conditioner according to the present invention and FIG. 2 is a rear perspective view schematically showing an indoor unit of an air conditioner according to the present invention.

Referring to FIGS. 1 and 2, an indoor unit 1 of an air conditioner includes a front panel 100, a front frame 200, a rear cover 600, and a tube cover 830. The front panel 100 is provided at a front of the indoor unit 1. The front frame 200 receives the front plate 100 so as to form a front cover and includes side discharge holes 220 at both sides. The rear cover 600 is coupled to the front frame 200 to protect backside of the indoor unit 1. The tube cover 830 is formed at lower portion of the indoor unit 1 to receive tubes coming outside of the indoor unit.

The side discharge hole 220 may be formed at one side or each side of the front frame 200 to discharge an air cooled at a front side portion of the indoor unit 1. In detail, since each side of the front frame 200 slopes outward from its front edge toward its backside, the air discharging through the side discharge holes 220 can be spread over entire indoor space. Further, since the side discharge holes 220 are formed on sides of the indoor unit 1, entire front face of the indoor unit 1 is clearly covered by the front panel, such that the indoor unit 1 can have better appearance.

The rear cover 600 includes a backwardly elevated center portion, and sloped portions that slope inwardly from peripheral edges toward the elevated center portion to meet the elevated center portion. The rear cover 600 is provided with suction holes to suck in outside air. The suction holes include central suction hole 620 formed at the elevated center portion, an upper suction hole 610 formed at a sloped upper portion, and a filter insertion hole 630 formed at a sloped lower portion. Each of the suction holes 620 and 610 is formed with a grill having a plurality of bars, for blocking somewhat large particles while sucking the outside air. Since the outside air can be sucked through the filter insertion hole 630 and the filter insertion hole 630 is capable of sucking the outside air, the suction holes of the present invention include the filter insertion hole 630.

The front panel may includes a transparent window 111 at a predetermined portion for observing inside the indoor unit 1, and a display unit formed inside the indoor unit 1 may be observed through the window 111 to see an operational status of the indoor unit 1. It is possible to provide the window 111 because the front panel 100 covers large portion of the front face of the indoor unit 1. This can be attained owing to an airflow structure, one aspect of the present invention, in which an air is discharged at a front lateral side.

An airflow passage inside the indoor unit will now be described with reference to above-mentioned structure of the indoor unit 1.

The airflow passage of the indoor unit 1 is described as followings: Outside air is sucked through the suction holes 610 and 620, and the filter insertion hole 630, which are formed at predetermined portions of the rear cover 600; The sucked air goes through a heat exchanger installed within the indoor unit, for a heat exchange; and the heat exchanged air is discharged through one or more discharge holes formed at a predetermined portion of the front frame 200. Specifically, since the discharge holes are formed at the front lateral inclined sides of the indoor unit 1, the discharging air can be spread over entire indoor space and thus the users can feel good quickly.

Figure 3:
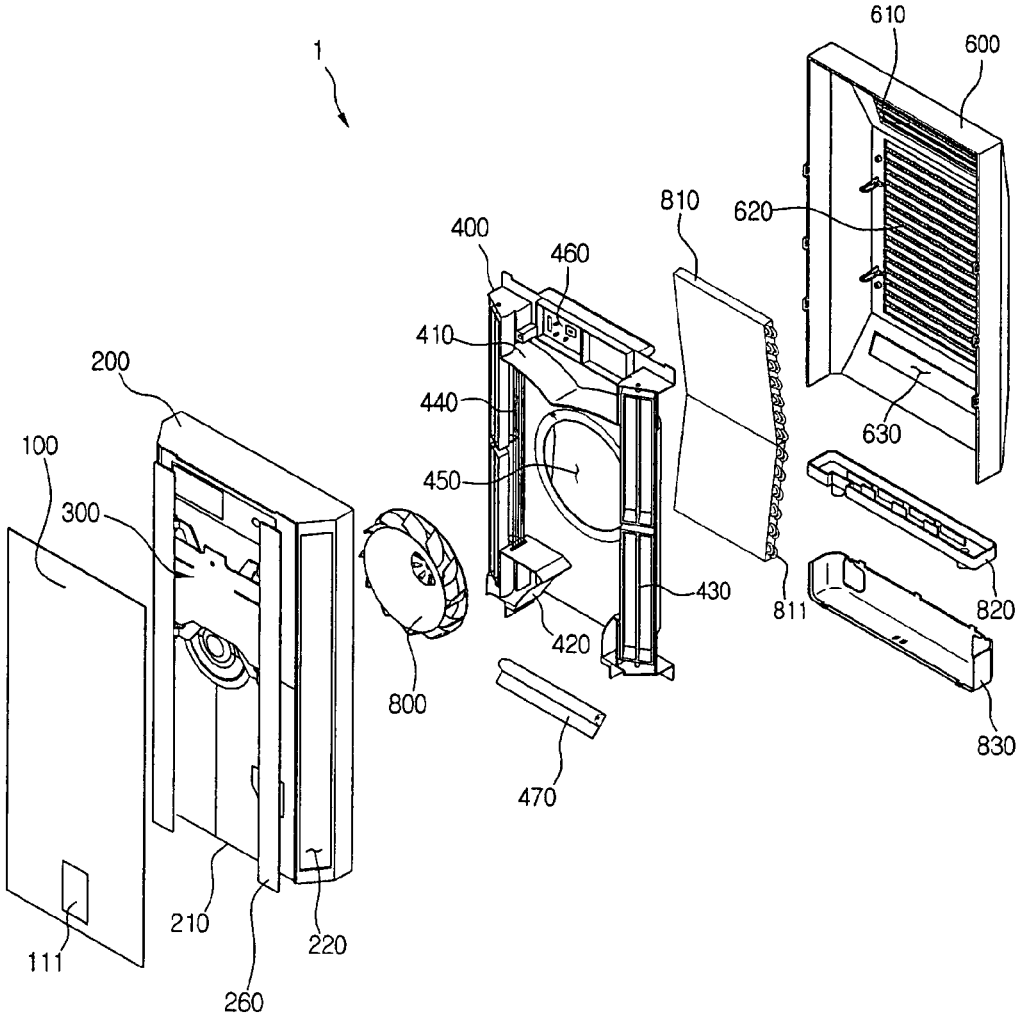
FIG. 3 is a front exploded perspective view showing an indoor unit of an air conditioner according to the present invention.
Figure 4:
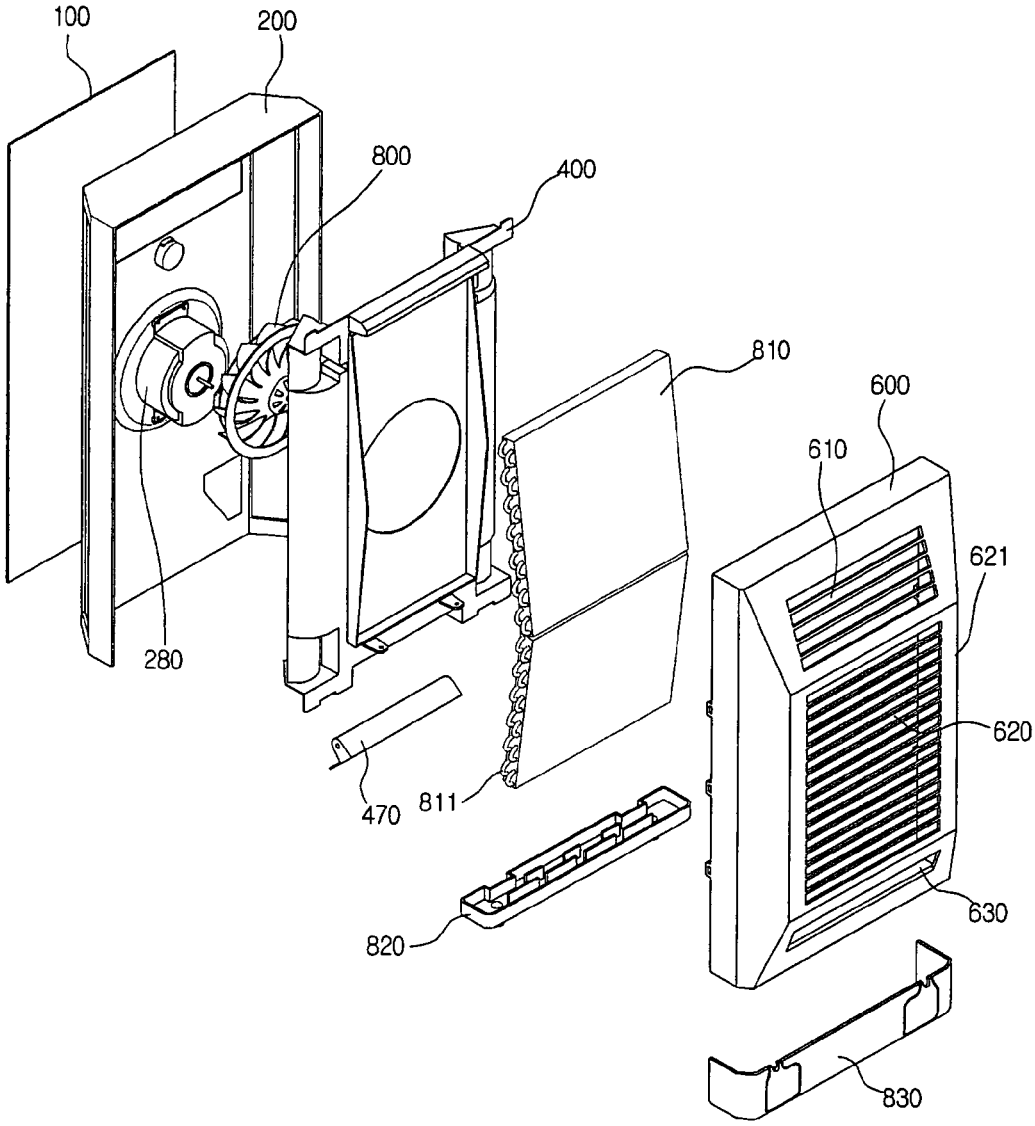
FIG. 4 is a rear exploded perspective view showing an indoor unit of an air conditioner according to the present invention.

FIG. 3 is a front exploded perspective view showing an indoor unit of an air conditioner according to the present invention and FIG. 4 is a rear exploded perspective view showing an indoor unit of an air conditioner according to the present invention;

Referring to FIGS. 3 and 4, there are shown an entire structure of the air conditioner indoor unit 1 of the present invention. The indoor unit 1 includes the front panel 100, the front frame 200, a blower fan 800, an air guide 400, a heat exchanger 810, and the rear cover 600. The front panel 100 forms a front exterior of the indoor unit 1. The front frame 200 receives the front panel 100 to protect the front of the indoor unit 1. The blower fan 800 is disposed behind the front frame 200 for sucking outside air. The air guide 400 is to be coupled with the blower fan 800 to guide the air sucked due to the rotation of the blower fan 800. The heat exchanger 810 is disposed behind the air guide 400 to lower the temperature of the sucked air by contacting with the sucked air. The rear cover 600 is disposed behind the heat exchanger 810 to be coupled to the front frame 200 for protecting the backside of the indoor unit 1.

The indoor unit 1 includes the front panel 100, the front frame 200, the blower fan 800, the air guide 400, the heat exchanger 810, and the rear cover 600 that are assembled in this order.

The indoor unit 1 further includes a drain pan 820 and the tube cover 830. The drain pan 820 is disposed below the heat exchanger 810 to drain the water condensed at the heat exchanger 810 and the tube cover 830 is provided to protect a refrigerant tube connected to the heat exchanger 810 and a condensed water drain tube. Furthermore, the indoor unit 1 includes a lower discharge hole door 470 that are disposed below the air guide 400. The lower discharge hole door 470 determines the direction of airflow to be discharged through a bottom discharge hole 210 and opens and closes the bottom discharge hole 210. The bottom discharge hole 210 allows the air guided by a lower air guide 420 to be discharged at a lower side of the indoor unit 1.

An opening/closing device 300 is disposed between the front panel 100 and the front frame 200, for opening and closing the side discharge holes 220. Herein, the opening/closing device is fixed to the front frame 200.

An electrical part 460 is provided at upper location between the front frame 200 and the air guide 400, for controlling operations of electrical parts such as a motor. Wind direction shifters 430 are disposed at both side of the air guide 400, for shifting the direction of the air flowing through the side discharge holes 220. The wind direction shifter 430 includes a safety screen 440 for not allowing a user to insert his or her hand thereto. The safety screen 440 is provided to protect user's hand from the blower fan 800 in case the user insert his or her hand into the wind direction shifter 430. An upper air guide 410 is provided at an upper position of the air guide 400, for guiding the air blown by the blower fan 800 toward the side discharge holes 220. The lower air guide 420 is provided at a lower position of the air guide 400, for guiding the air blown by the blower fan 800 toward the bottom discharge hole 210.

Function and operation of each element of the present invention will now be described.

The front panel 100 is attached at a front face of the indoor unit 1, for forming a front exterior of the indoor unit 1. The window 111 may be provided at a predetermined portion of the front panel 100, for an observation of the display unit (240 in FIG. 67) that displays on/off status and/or operational status of the indoor unit 1. The front panel 100 may include a finishing material or a design, for a good and beautiful exterior of the indoor unit 1.

The front frame 200 includes front peripheral sides that are inclined at a predetermined angle, and the front panel 100 is attached thereto. The side discharge holes 220 and/or the bottom discharge hole 210 may be formed at least one side of the front peripheral sides of the front frame 200. The front panel 100 may be fixedly attached to the front frame 200 or may be attached while allowing movement in left and right directions in order to form a discharge hole at the front of the indoor unit 1.

A fan motor (280 in FIG. 70) attached to a rear face of the front face 200 drives the blower fan 800, such that indoor air can be sucked into the indoor unit 1. The number of the blower fan 800 may be one or more according to the size or use of the indoor unit 1. A turbofan having a large capacity may be used for the blower fan 800.

The air guide 400 guides the air to be sucked to the blower fan 800 via an air guide hole 450, and the upper air guide 410 and the lower air guide 420 guide the sucked air to the side discharge holes 220 and the bottom discharge hole 210.

The heat exchanger 810 includes a tube 811 turned a number of times. Low-temperature and low-pressure refrigerant passed an expansion valve flows in the tube 811. Since a heat exchanger with wide area has good heat transfer performance, the heat exchanger 810 may have a flat rectangular shape or folded at a predetermined angle. The drain pan 820 is provided below the heat exchanger 810 to receive the dropping water condensed at the surface of the heat exchanger 810, thereby preventing the condensed water from dropping outside of the indoor unit 1.

The rear cover 600 is provided with suction holes at least one portion, such as the upper suction hole 610 at upper portion and the central suction hole 620 at center portion. In order words, the shape and number of the suction holes, such as the upper suction hole 610 and the central suction hole 620, may be selected according to the shape and capacity of the indoor unit 1. Herein, each of the suction holes 610 and 620 includes a grill having bars repeatedly formed with a predetermined space therebetween, such that particles included in the air can be primarily blocked. Further, the rear cover may be formed with the filter insertion hole 630 at a predetermined portion, for inserting a filter (refer to FIG. 32) to filter out impurities such as dust. Preferably, the filter is inserted between the rear cover 600 and the heat exchanger 810 in order to prevent adhesion of impurities on the surface of the heat exchanger 810. The filter insertion hole 630 may be function as an air suction hole.

The peripheral sides of the rear cover 600 is formed having slopes at a predetermined angle and the upper suction hole 610 at this sloped side of the rear cover 600, such that the indoor air can be smoothly sucked. Specifically, in case the indoor unit is installed close to a corner of wall, air suction can be smoothly performed.

Figure 5:
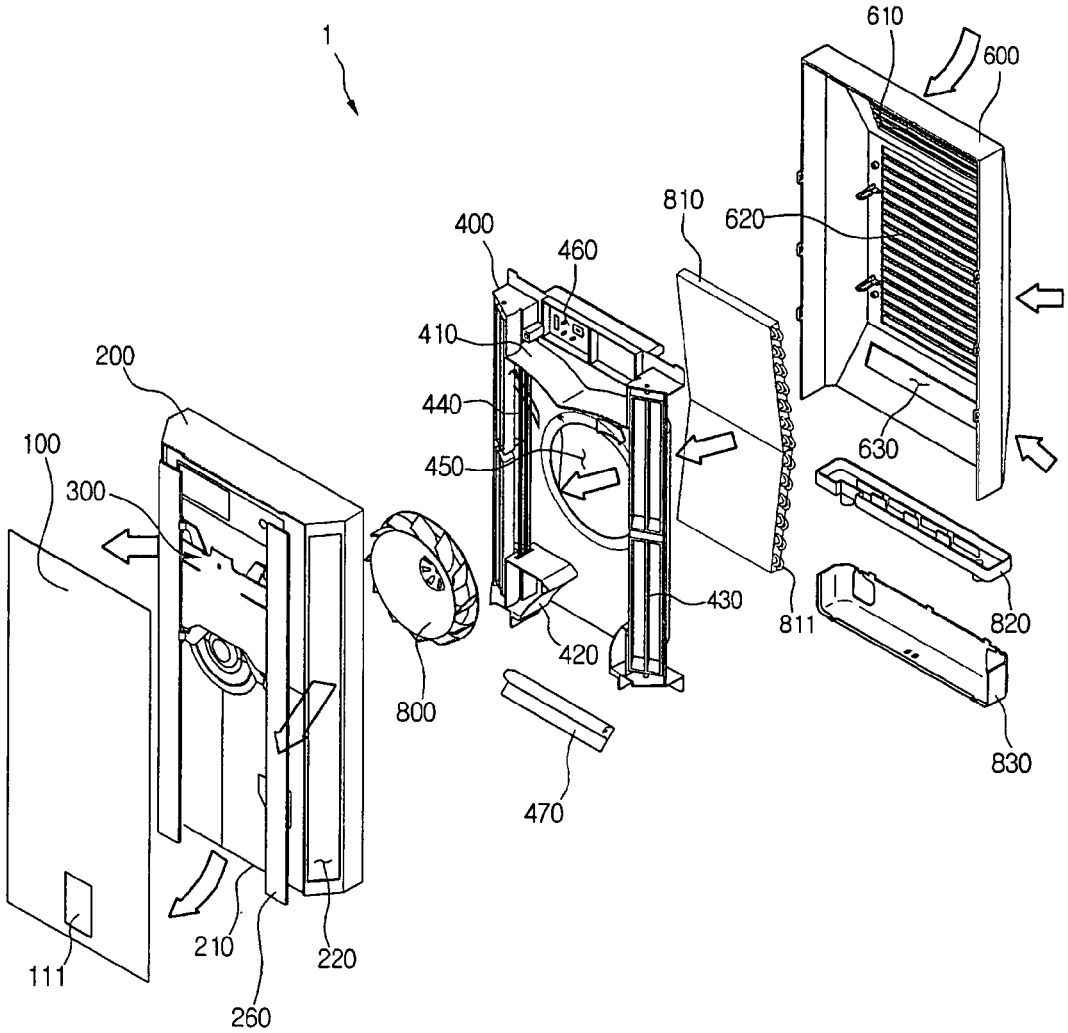
FIG. 5 is a perspective view showing an airflow passage of an indoor unit of an air conditioner according to the present invention.

FIG. 5 is a perspective view fully showing an airflow passage of an indoor unit of an air conditioner according to the present invention.

Referring to FIG. 5, the indoor air is sucked through the upper suction hole 610 and/or the central suction hole 620 and/or the filter insertion hole 630 of the rear cover 600. The sucked air exchanges heat with the heat exchanger 810 and flows to the air guide hole 450 and flows to a suction side of the blower fan 800. Herein, the suction force of the blower fan 800 motivates the above airflow. The upper air guide 410 and the lower air guide 420 are functions to guide the air discharging from the blower fan 800 in a predetermined direction.

In detail, the air guided by the upper air guide 410 is discharged through the side discharge holes 220 and the air guided by the lower air guide 420 is discharged through the bottom discharge hole 210. The wind direction shifters 430 guide the air discharging through the side discharge holes 220, such that the cooled air can be spread over entire indoor space. The lower discharge hole door 470 may guide the air discharging through the bottom discharge hole 210.

Figure 6:
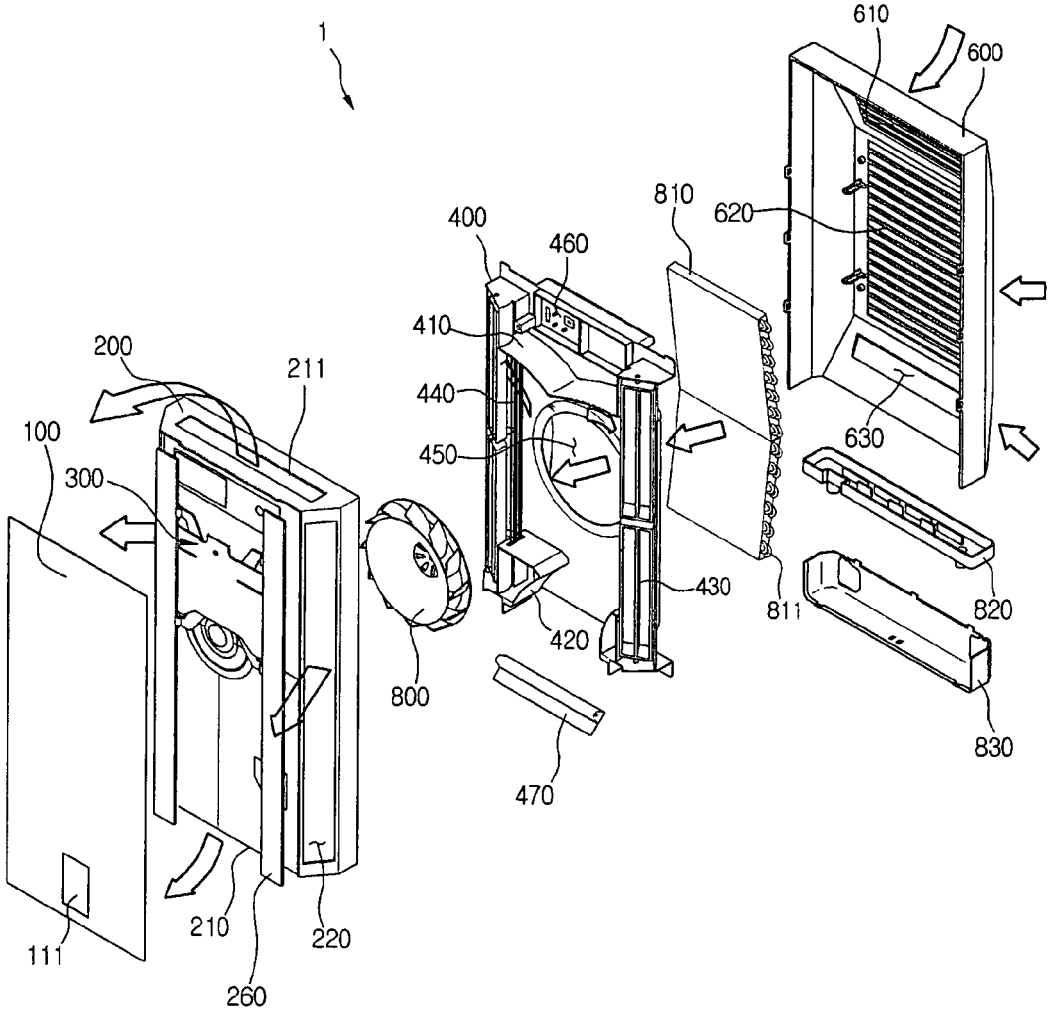
FIG. 6 is a perspective view showing another air discharge passage of an indoor unit of an air conditioner according to the present invention.

FIG. 6 is a perspective view showing another air discharge passage of an indoor unit of an air conditioner according to the present invention.

Figure 7:
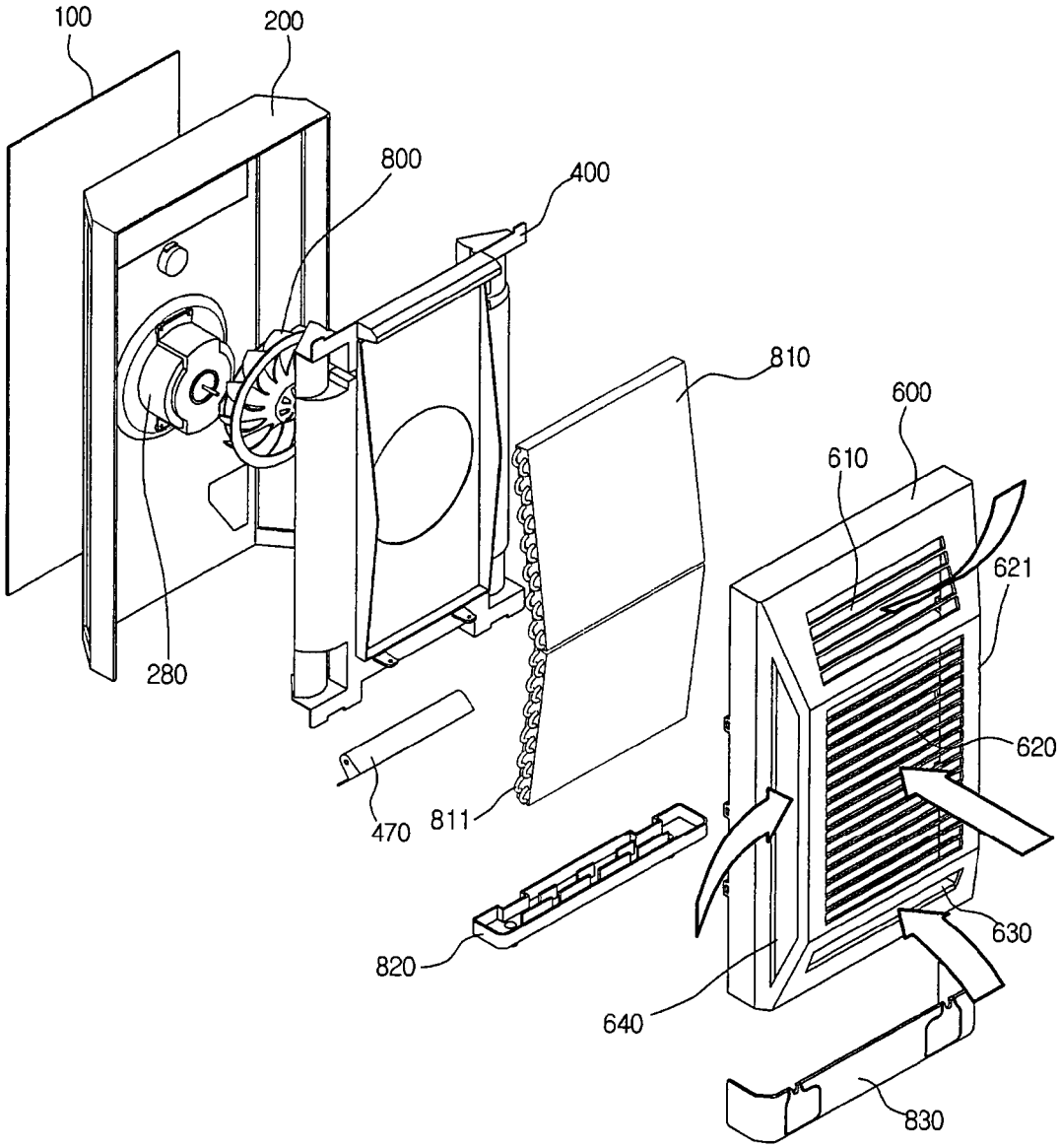
FIG. 7 is a perspective view showing another air suction passage of an indoor unit of an air conditioner according to the present invention.

Referring to the FIG. 6, the front frame 200 is provided with a top discharge hole 211 at a top, such that the cooled air can be discharged through the top discharge hole 211. Herein, in order to discharge the cooled air through the top discharge hole 211, the structure and shape of the upper air guide 410 may be changed properly. In this case, since the pneumatic resistance may be reduced, the blowing efficiency may be increased. FIG. 7 is a perspective view showing another air suction passage of an indoor unit of an air conditioner according to the present invention. Referring to FIG. 7, the rear cover 600 is provided with side suction holes 640. By forming the side suction holes 640, the pneumatic resistance can be reduced and thus efficiency of indoor unit 1 can be increased.

Figure 8:
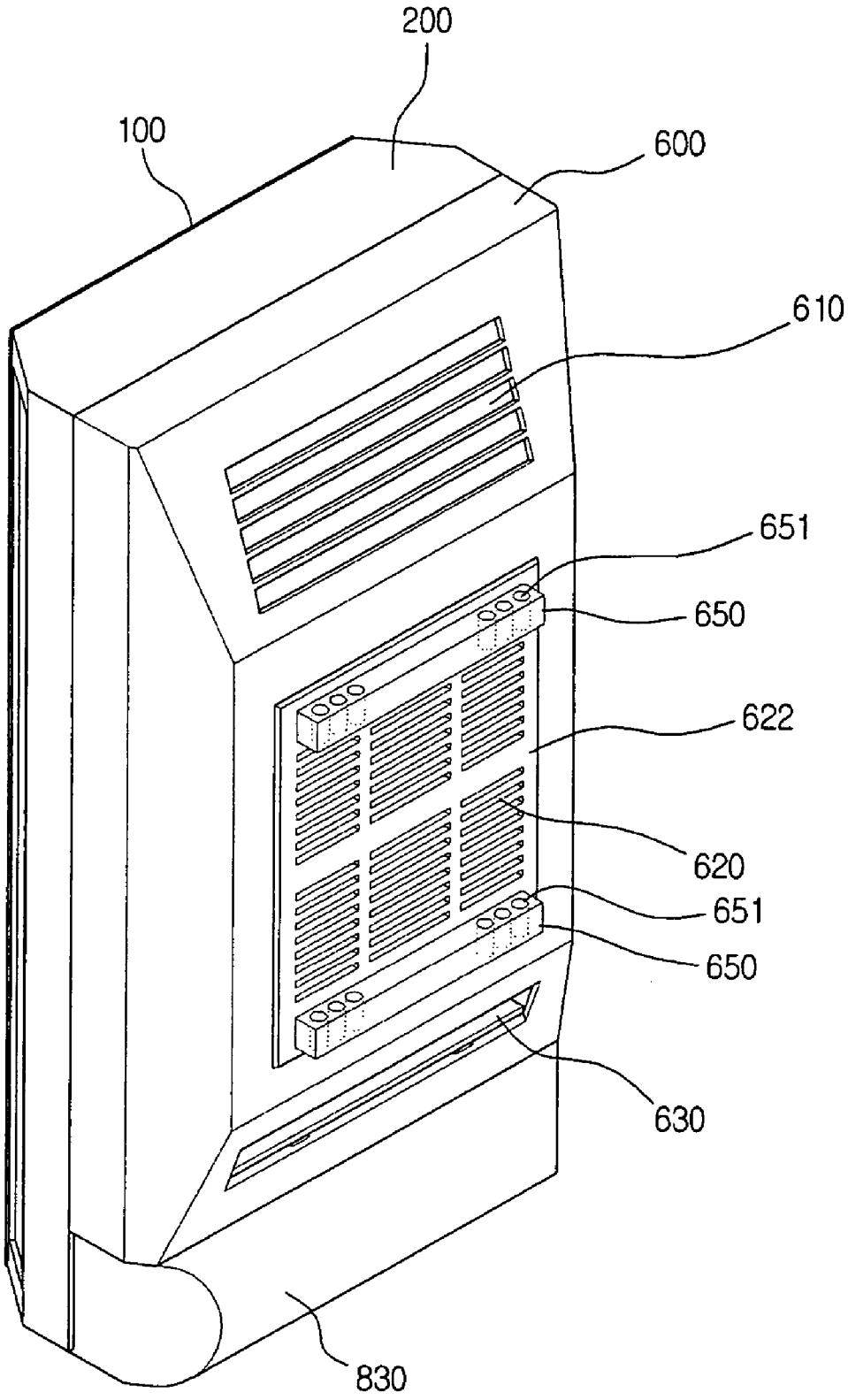
FIG. 8 is a rear perspective view showing an installation structure of an indoor unit of an air conditioner according to the present invention.

FIG. 8 is a rear perspective view showing an installation structure of an indoor unit of an air conditioner according to the present invention.

Referring to FIG. 8, to fix the indoor unit on a wall, the rear cover further includes a support panel 622 formed at a rear side thereof, settlement guides 650 formed at upper and lower portions thereof, and holes 651 formed at the settlement guides in up and down directions.

The support panel 622 may be securely fixed to the rear cover 600 by using various methods such as screw coupling and adhesion. The settlement guides 650 may be fixed to the support panel 622 by using various methods such as screw coupling and adhesion, or may be formed integral with the supporting panel 633. Herein, the shape of the settlement guides 650 and the number of the holes 651 is not limited to this embodiment and may be formed various shapes and numbers according to the shape and size of the indoor unit 1. The settlement guides 650 may be fixed direct to the rear cover 600 or formed integral with the rear cover 600, without the support panel 622 therebetween.

Figure 9:
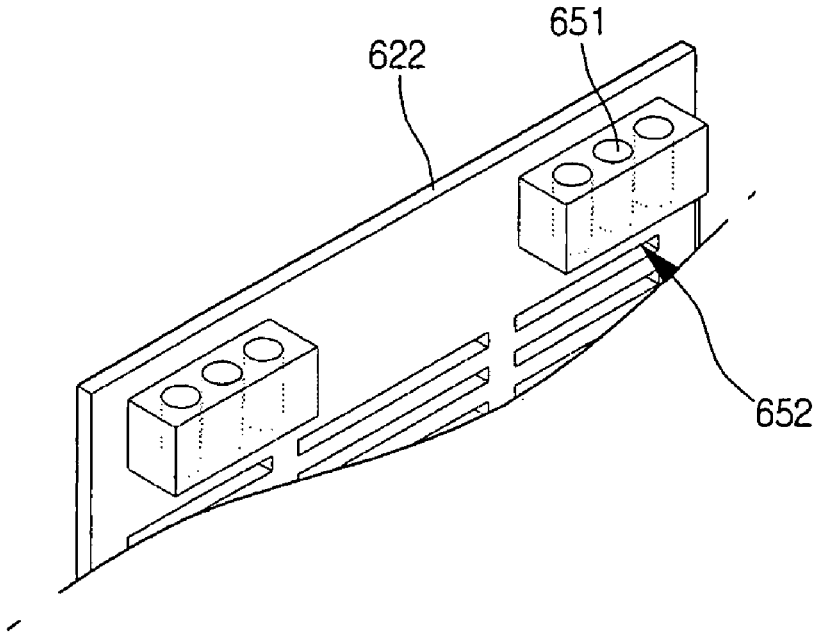
FIG. 9 is a view showing a settlement guide as shown in FIG. 8 according to another embodiment of the present invention.

In detail, the settlement guides 650 may have elongated cuboid shape and attached to the upper and lower portions of the support panel 622 as shown in FIG. 8, and as well the settlement guides 650 may have short cuboid shape and individually attached to four corners of the support panel 622 as shown in FIG. 9. In case the settlement guides 650 is formed as shown in FIG. 9, an air sucking space between the indoor unit 1 and the wall is enlarged, the pneumatic resistance of the airflow may be reduced furthermore.

The shape of the holes 651 is not limited to this embodiment. The holes 651 may be formed in various shapes such as groove and rectangle, provided that bars can be inserted into and supported by the holes 651.

Figure 10:
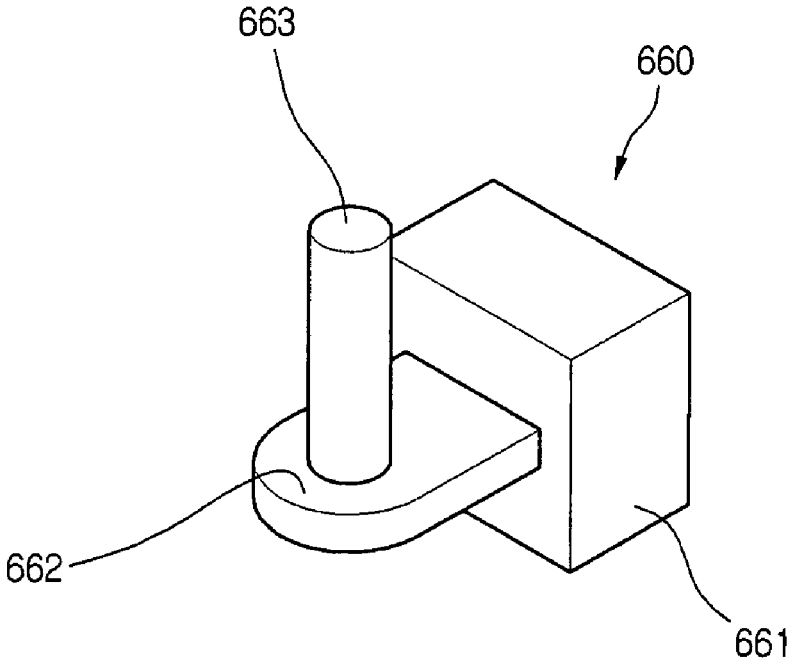
FIG. 10 is a perspective view of a receiving hook according to the present invention.
Figure 11:
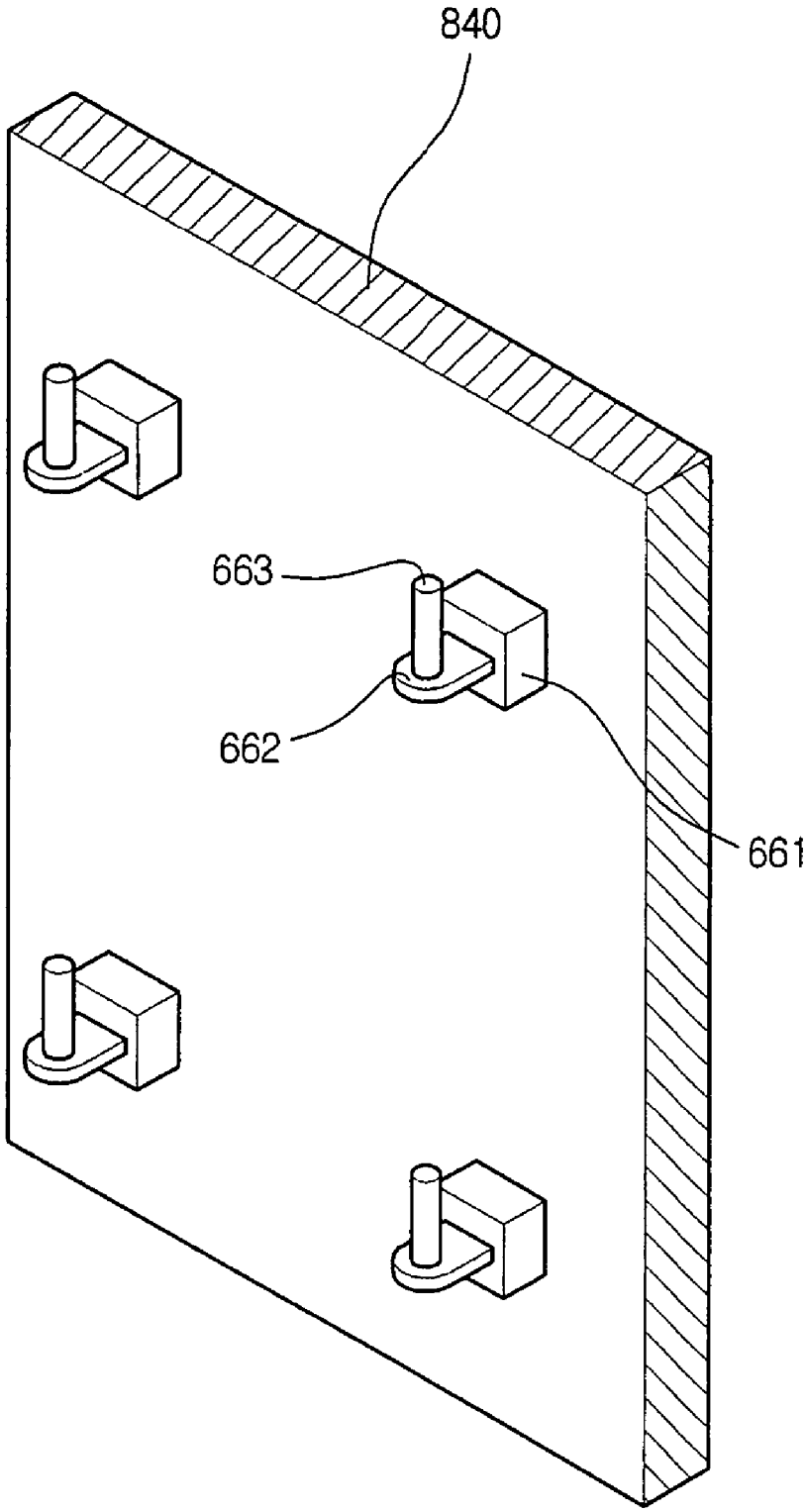
FIG. 11 is a view showing an installation structure of receiving hooks according to the present invention.

FIG. 10 is a perspective view of a receiving hook according to the present invention and FIG. 11 is a view showing an installation structure of receiving hooks according to the present invention.

Referring to FIGS. 10 and 11, receiving hooks 660 are coupled to a wall 840 using an adhesion-like method. The receiving hook 660 includes a support 661 for fixing the indoor unit 1 to the wall 840 while spacing between the indoor unit 1 and the wall 840, extension 662 extending forwardly from the support 661, and boss 663 protruded upwardly by a predetermined length from the extension 662.

In detail, the outer diameter of the boss 663 is designed for an exact insertion to the hole 651. The shape of the boss 663 is not limited to the cylindrical shape as this embodiment. The boss 663 may have various shapes provided that the boss 663 can be engaged and closely coupled to the hole 651 without a shake. The support 661 has a predetermined thickness in order to make a space between the indoor unit 1 and the wall when the indoor unit 1 is coupled with the receiving hooks 660. The support 661 also has a surface area larger than a predetermined value in order to couple the receiving hooks 660 to the wall 840. In case there is a sufficient coupling force, the surface area of the support 661 may be not important factor. The extension 662 is extended forwardly from the support 661 and formed with the boss 663 on a top thereof. The extension 662 allows the receiving hooks 660 as a whole to be spaced more than a predetermined distance from the wall 840, which provides a predetermined or more distance between the indoor unit 1 and the wall 840, such that the pneumatic resistance of the air sucking through the rear cover 600 can be reduced.

Though the support 661, the extension 662, and the boss 663 may be formed in various ways, preferably they are integrally formed using two or more members. The receiving hooks 660 can be arranged in rectangular fashion in which the receiving hooks 660 are disposed at upper and lower locations of the wall 840 with spaced one another as shown in the drawing. The distance between the receiving hooks 660 may be determined according to the size of the indoor unit 1.

Figure 12:
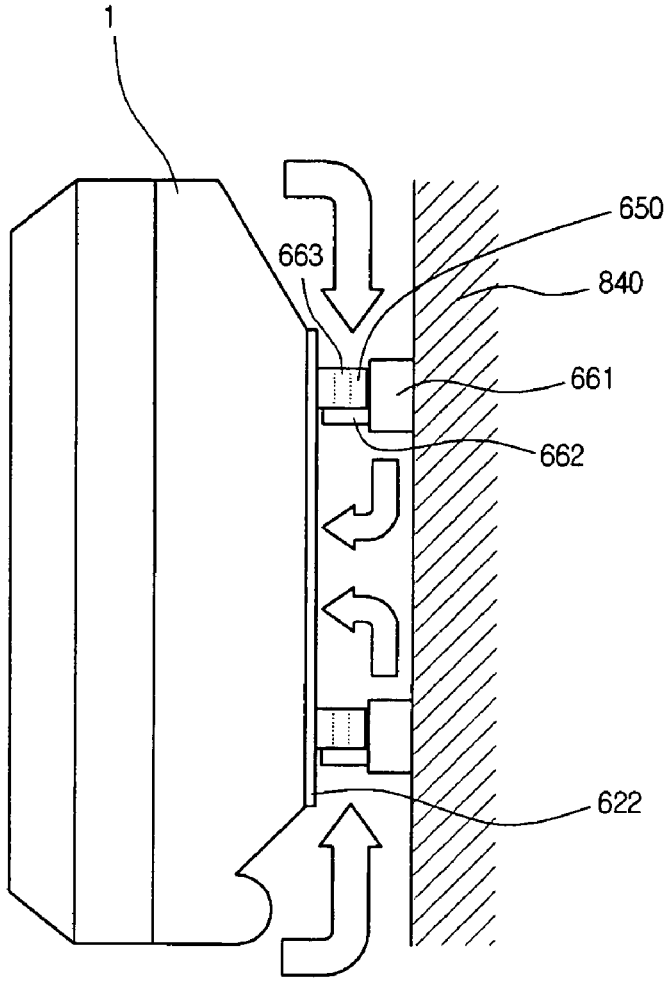
FIG. 12 is a side view showing an air suction passage of an indoor unit according to the present invention.

FIG. 12 is a side view showing an indoor unit coupled with receiving hooks according to the present invention;

Referring to FIG. 12, since the indoor unit 1 is coupled with the wall 840 with spaced a predetermined distance therebetween, such that a space along which air flows to be sucked into the indoor unit 1 can be formed between the indoor unit 1 and the wall 840. The air introduced along the space may be sucked through the suction holes 610 and 620 of the rear cover 600. Meanwhile, even though there is a narrow space between the rear cover 600 and the wall 840, the upper suction hole 610 is not interfered by the wall 840 and thereby the air can be smoothly sucked. The arrow in the drawing denotes the air sucking through the central suction hole 620.

Figure 13:
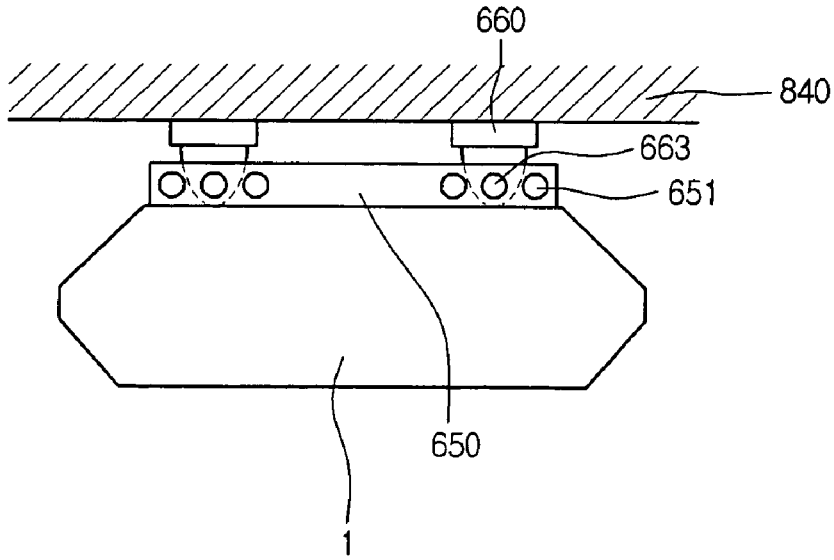
FIG. 13 is a plan view showing an installation structure of an indoor unit according to the present invention.
Figure 14:
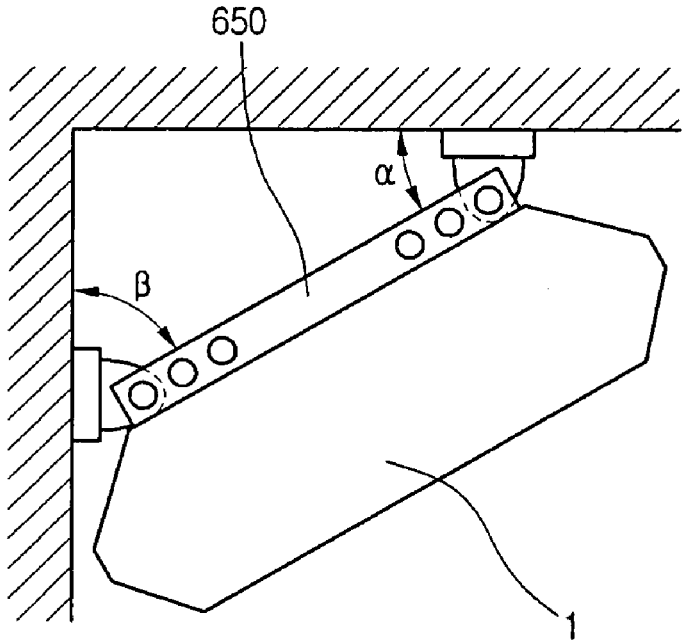
FIG. 14 is a plan view showing another installation structure of an indoor unit according to the present invention.
Figure 15:
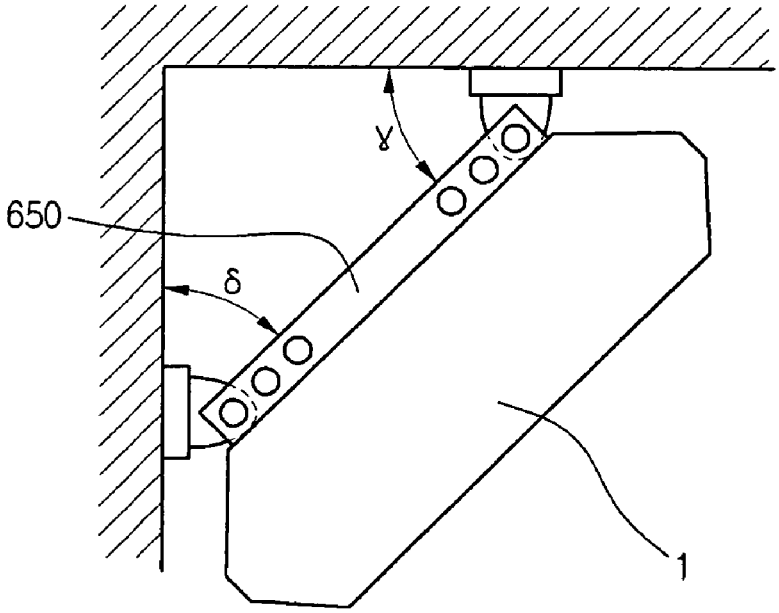
FIG. 15 is a plan view showing a further another installation structure of an indoor unit according to the present invention.

FIGS. 13 to 15 show ways of mounting an indoor unit according to embodiments of the present invention: FIG. 13 is a plan view showing an indoor unit mounted on a flat wall; FIG. 14 is a plan view showing an indoor unit mounted on a corner of a wall; and FIG. 15 is a plan view showing an indoor unit mounted on a corner of a wall according to another embodiment.

According to the present invention, the indoor unit 1 can be mounted on a flat wall and as well a corner of a wall without limitation due to the settlement guides 650 and the receiving hooks 660. Further, the front direction of the indoor unit 1 can be freely adjusted according to attached locations of the receiving hooks 660. Therefore, the mounting position and direction of the indoor unit 1 is freely adjustable without changing the airflow passage for smooth air suction, thereby increasing user's convenience.

Referring to FIG. 13, the indoor unit 1 can be mounted on an ordinary flat wall and the receiving hooks 660 can be fixed at proper locations according to the thicknesses of the settlement guides 650.

Referring to the FIG. 14, the angles between the indoor unit 1 and the wall are different, one side has a mounting angle $\alpha$ of 30 degrees and the other side has a mounting angle $\beta$ of 60 degrees. Preferably, this installation structure can be applied when the indoor space has a rectangular shape such that the air needs to be blown much more in one direction or when there is an obstacle at one side of the indoor space. Of course, it is apparent that the mounting locations of the receiving hooks 660 depend on the mounting angles.

Referring to FIG. 15, both mounting angles $\chi$ and $\delta$ between the indoor unit 1 and the wall are 45 degrees. Preferably, this installation structure can be applied when the indoor space has a square shape such that the air needs to be blown equally in the left and the right directions.

As provided above, since the indoor unit 1 can be freely mounted on the wall without limitation of the mounting location, such that the indoor space can be used more efficiently. Also, there is an advantage of securing the space behind the indoor unit 1 for introducing the air to be sucked.

Figure 16:
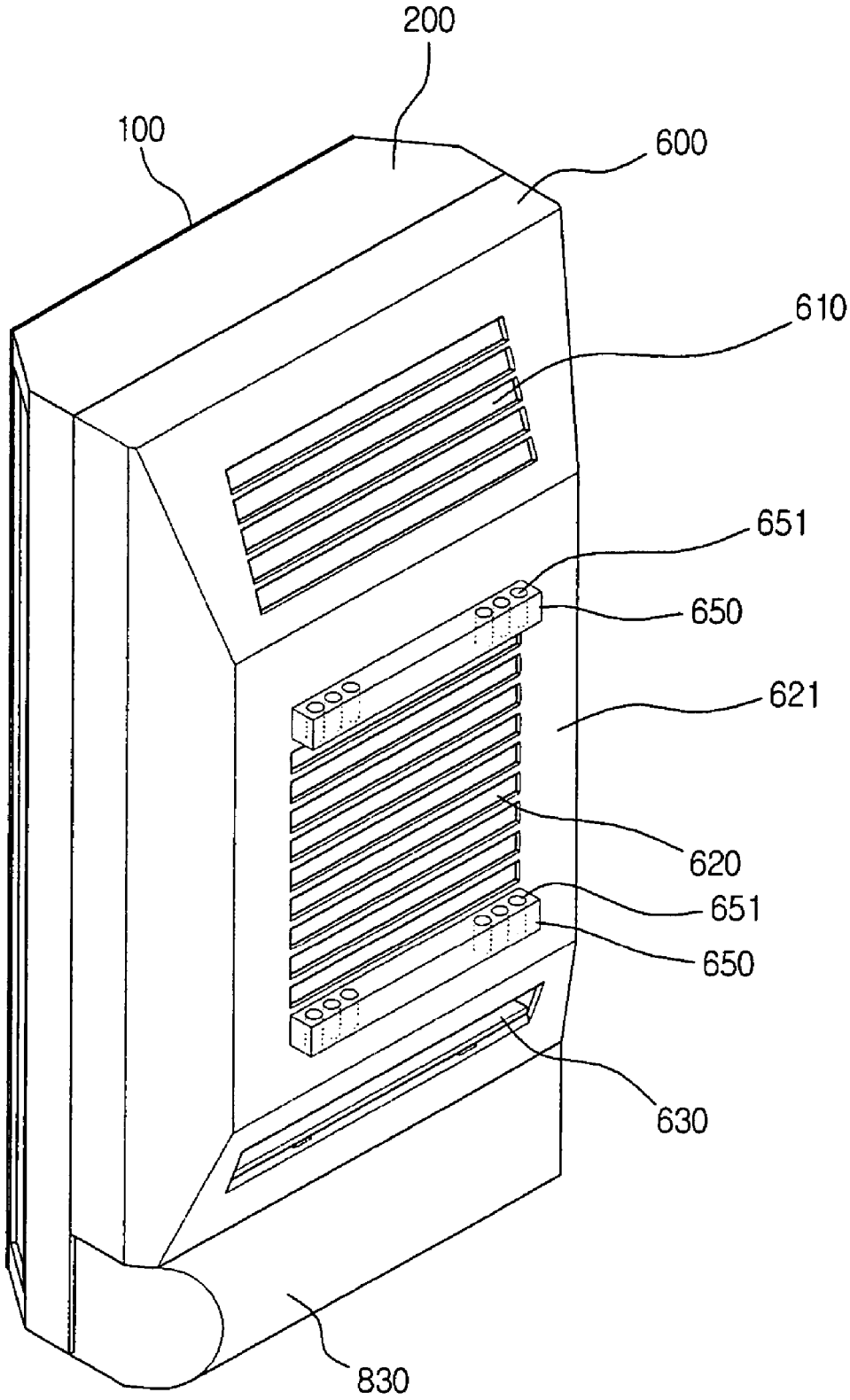
FIG. 16 is a view showing a way of forming a settlement guide according to another embodiment of the present invention.

FIG. 16 is a view showing a way of forming a settlement guide according to another embodiment of the present invention.

Referring to FIG. 16, the settlement guides 650 are not coupled to the support panel 622. Instead, the settlement guides are directly fixed on a central suction panel 621 formed with the central suction hole 620. In order to directly fix the settlement guides 650 to the central suction panel 621, the thickness of the central suction panel 621 is preferably maintained thicker than a predetermined thickness at least at the portions to which the settlement guide 650 is fixed, such that the fixing of the settlement guides 650 can be securely maintained. Other features of the settlement guides 650 and the receiving hook 660 described above may be applied to this embodiment.

The settlement guides 650 are directly fixed to the central suction panel 621, thereby reducing cost and fabricating process compared when the settlement guides 650 are fixed to the support panel 622.

As described above, in order to install the indoor unit, the settlement guides 650 formed on the rear of the indoor unit 1 and the receiving hooks 660 installed on the wall 840 are coupled by a way of insertion. Of course, there may be a number of embodiments of installing the indoor unit 1 on the wall 840. Hereinafter, another embodiments will be described with reference to the drawings.

FIGS. 17 to 26 are views showing another installation structure of an indoor unit according to another embodiment of the present invention.

Figure 17:
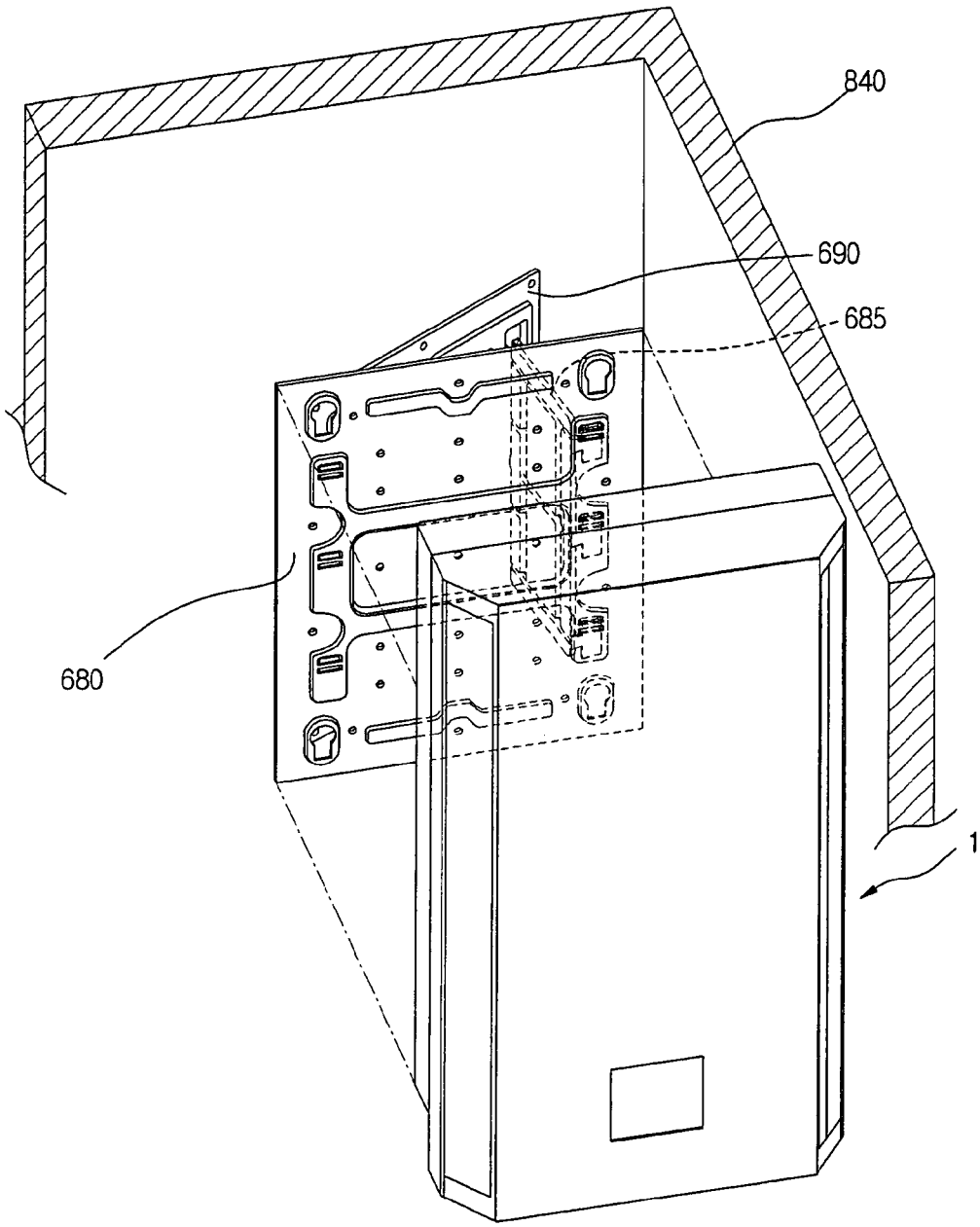
FIG. 17 is a perspective view showing a yet further another installation structure of an indoor unit according to the present invention.

Referring to FIG. 17, the installation structure as a whole includes the indoor unit 1, a front plate 680 coupled to the rear of the indoor unit 1, a rear plate 690 directly coupled to the wall 840, and a side plate 685 which allows the coupled front plate 680 and rear plate 690 to keep the indoor unit 1 apart from the wall 840 at a predetermined angle therebetween. Ends of the side plate 685 are connected with the front plate 680 and the rear plate 685 through a predetermined way. Due to the above-mentioned structure, the indoor unit 1 can be positioned apart from the wall at a predetermined angle or much even when the indoor unit 1 is installed on a corner of wall 840, such that the indoor unit 1 can blow the air to the entire area of the indoor space more smoothly. In detail, when the indoor unit 1 is installed on the corner of wall, the indoor unit 1 can be installed on the wall at a predetermined angle instead of at a right angle, such that the air discharged from one side of the indoor unit 1 can be smoothly blown to the entire indoor space without an interference of the wall.

Figure 18:
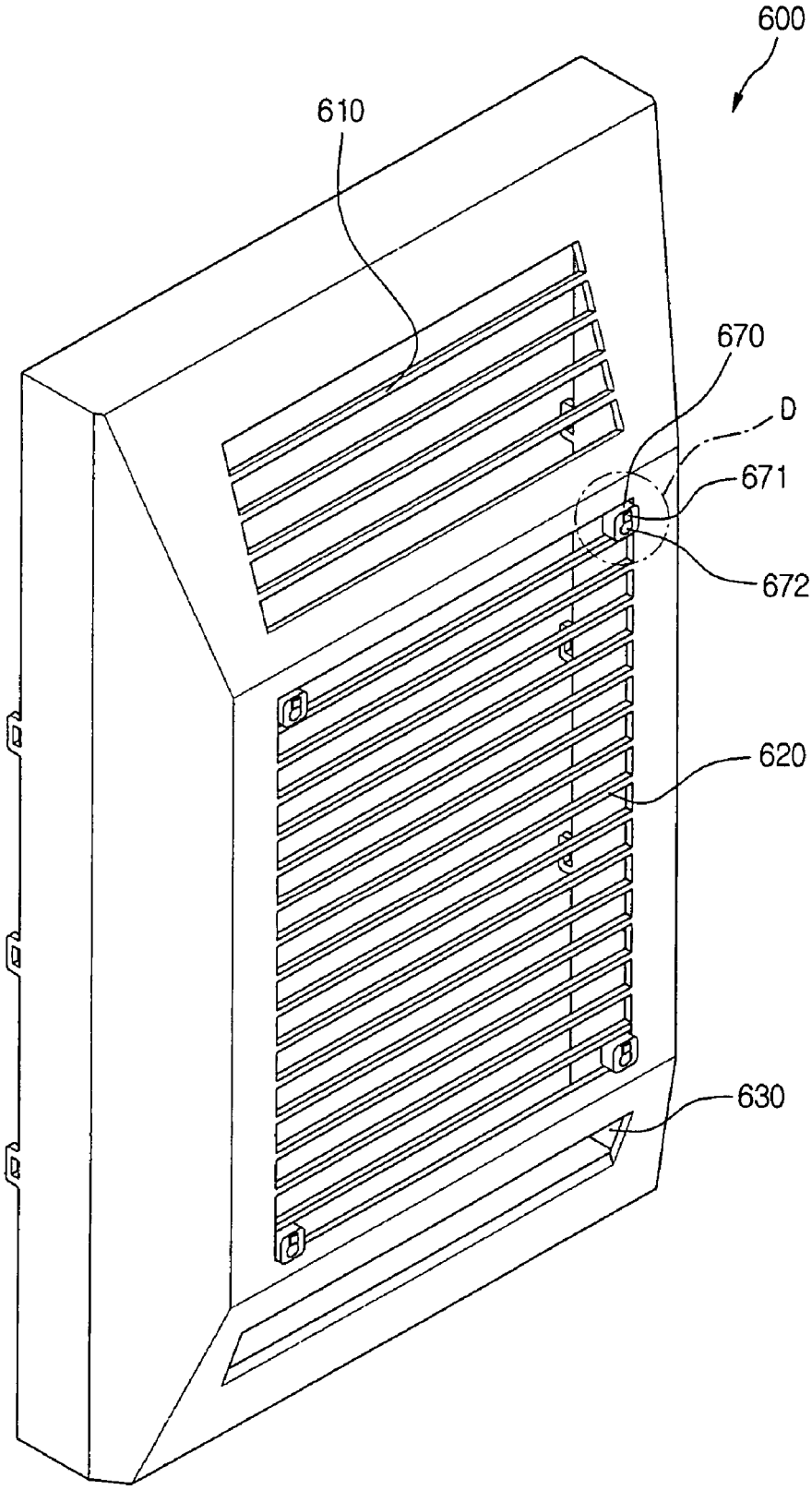
FIG. 18 is a rear perspective view showing an indoor unit according to the present invention.

FIG. 18 is a rear perspective view showing an indoor unit according to another embodiment of the present invention.

Referring to FIG. 18, the rear cover 600 is provided at a rear with support protrusions 670 protruded by a predetermined height to form four corners of the central suction panel 621, for mounting the indoor unit 1 on the wall. The support protrusions 670 may be formed integrally with the central suction panel 621 or may be formed separately with the central suction panel 621 and then fixed thereto. Further, though when the support protrusions 670 are formed on the support panel 622 that is additionally attached on the central suction panel 621, the support protrusions 670 can perform the same function.

Figure 19:
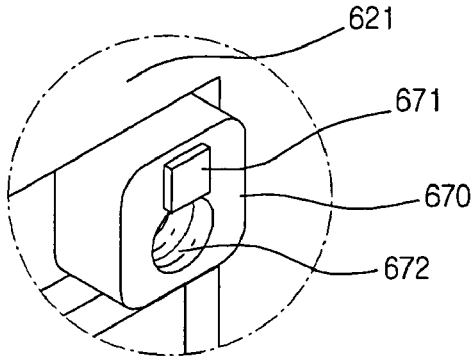
FIG. 19 is a partial enlarged view of "D" depicted in FIG. 18.

FIG. 19 is a partial enlarged view of "D" depicted in FIG. 18.

Referring to FIG. 19, each of the support protrusions 670 is shaped in a protruded rectangle and is configured to include a coupling groove 672 and an elevated portion 671. The coupling groove 672 is caved such that a coupling member for coupling the front panel 680 and the indoor unit 1 is inserted thereinto. The elevated portion 671 is formed above the coupling groove 672 at a height equal to the thickness of the front plate 680 such that the coupling member is more exactly coupled.

When the coupling member is inserted into the front plate 680 and the support protrusions 670, the elevated portion 671 functions to fix the coupling member at the same height as the elevated portion 671 with respect to the front plate 680 and the support protrusions 670. The elevated portion 671 enables the coupling member to be inserted exactly without deviation when the coupling member is inserted into the coupling groove 672. Therefore, since the coupling member can be inserted exactly in a perpendicular direction, the coupling of the front panel 680 and the rear cover 600 can be reliably carried out.

Figure 20:
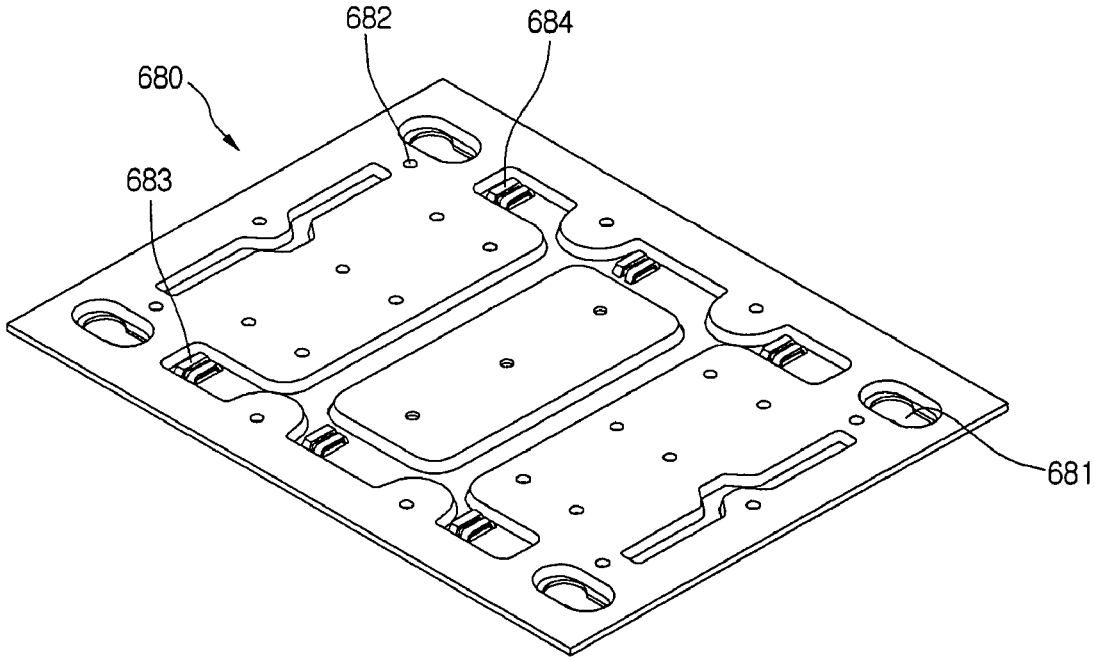
FIG. 20 is a perspective view of a front plate according to the present invention.
Figure 2:
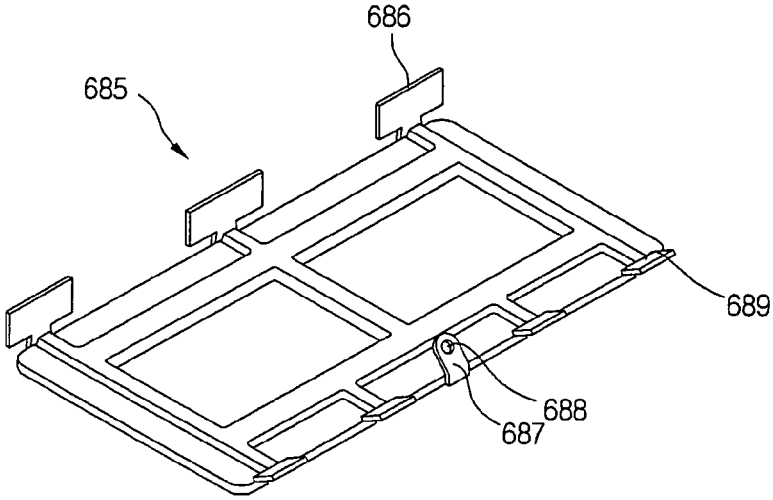
Figure 2:
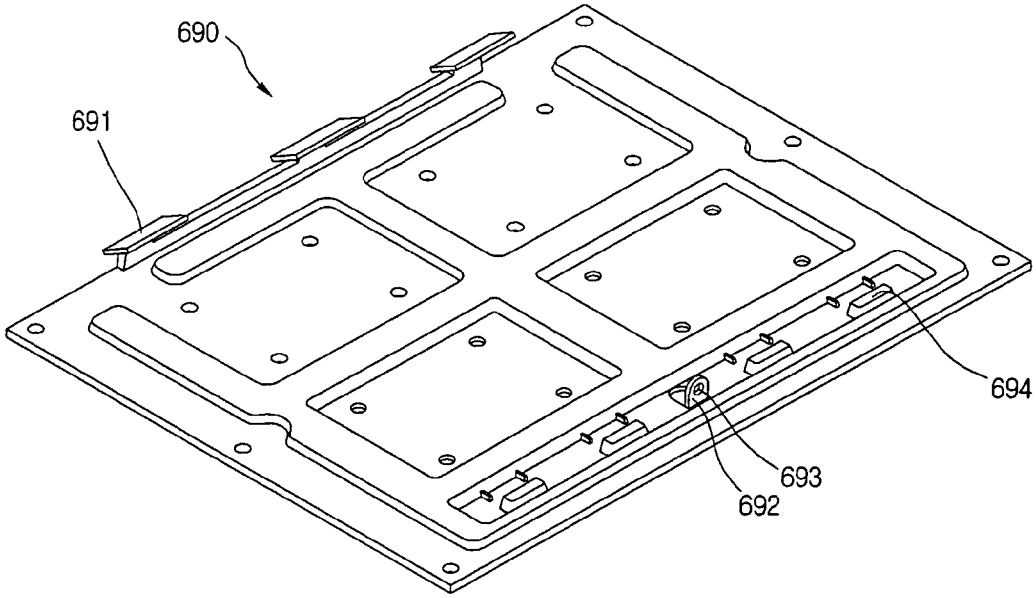
Figure 2:
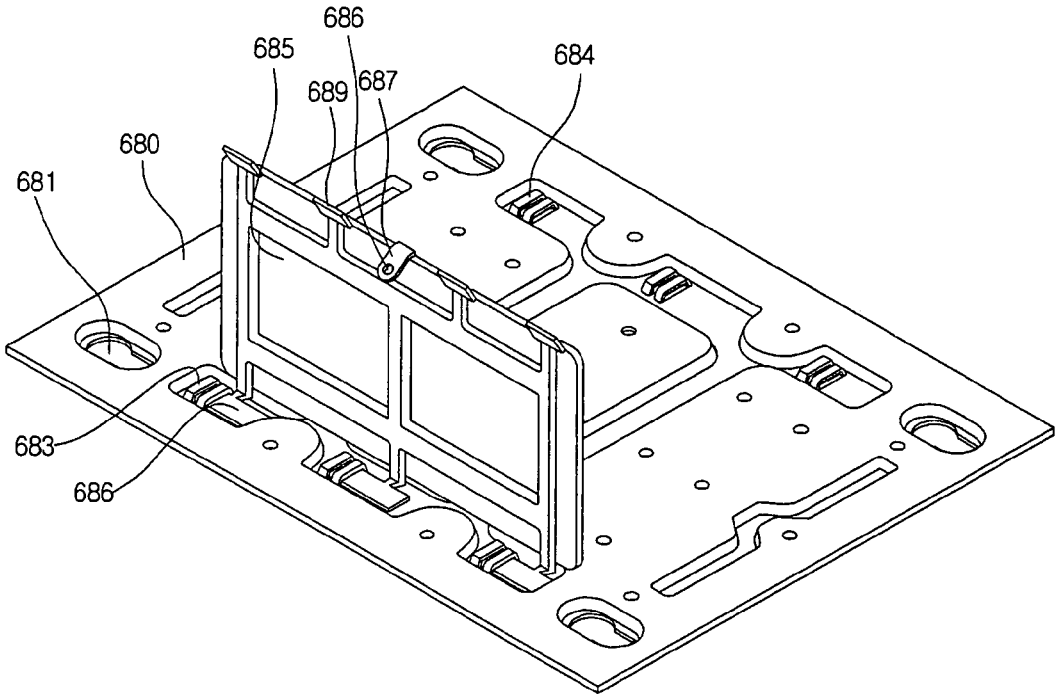

FIG. 20 is a perspective view of a front plate according to the present invention, FIG. 21 is a perspective view of a side plate according to the present invention, and FIG. 22 is a perspective view of a rear plate according to the present invention.

Referring to the FIG. 20, the front panel 680 is formed in a fashion to enhance strength and prevent interference. In detail, the front panel 680 includes support protrusion insertion holes 681, a first flanges 683, and a second flanges 684 that are formed thereon. The support protrusion insertion holes 681 in which the support protrusions 670 are inserted are formed at four corners of the front panel 680, for fixing the indoor unit 1. The first flanges 683 to which front hooks (686 in FIG. 21) of the side plate 685 are coupled are formed for fixing the side plate 685 to the front plate 680. The second flanges 684 to which front hooks (691 in FIG. 22) of the rear plate 690 are coupled are formed for fixing the rear plate 690 to the front plate 680.

Further, the front plate 680 may be formed with wall fixing holes 682 therethrough, such that the front plate 680 can be directly fixed to the wall without the side plate 685 and the rear plate 690.

In detail, the first flanges 683 and the second flanges 684 are formed by cutting and bending at predetermined portions of the front panel 680, and each flange includes two projected ribs. The number of the first and the second flanges 683 and 684 may be determined as many numbers as is required to support the indoor unit 1 and in this embodiment, each of the flanges 683 and 684 have three flanges. The shape, number, and fabricating method of the flanges 683 and 684 are limited to this embodiment and thereby the shape, number, and fabricating method may be variously changed without departing from the spirit and scope of the present invention.

Referring to FIG. 21, the side plate 685 includes the front hooks 686 protrusively formed at one side with a predetermined width and length for coupling with the front plate 680, and rear hooks 689 protrusively formed at the other side, such that the side plate 685 can be fixed to the front plate 680 and the rear plate 690. Further, the side plate 685 includes a rear plate fixing part 687 and a rear plate fixing hole 688 that are formed at the one side where the rear hooks 689 is formed, for securely fixing the side plate 685 and the rear plate 690.

In detail, the rear hooks 689 are provided to guide the side plate 685. The rear plate fixing part 687 is formed on a center of the other side of the side plate 685, for securely fixing the side plate 685 to the rear plate 690 with a coupling member.

Referring to FIG. 22, the rear plate 690 to be attached to the wall includes side guides 694, a side plate fixing part 692, a side plate fixing hole 693, and front hooks 691. The side guides 694 are formed at one side of the rear plate 690 with a bent shape, for guiding the rear hooks 689 of the side plate 685. The side plate fixing part 692 and the side plate fixing hole 693 are aligned with the rear plate fixing part 687 of the side plate 685, for fixing the side plate 685. The front hooks 691 are formed at the other side edge of the rear plate 690, for hooking the front plate 680.

FIG. 23 is a perspective view showing a connection of a front plate and a side plate according to the present invention.

Referring to FIG. 23, the side plate 685 is coupled to the rear of the front plate 680. In detail, the front hooks 686 formed at the one side of the side plate 685 are inserted into the first flanges 683 formed at the one side of the front plate 680. In more detail, the side plate 685 or the front plate 680 is shifted in order to align the front hooks 686 and the first flanges 683 and then the side plate 685 is pushed in the insertion direction of the front hooks 686 and the first flanges 683 in order to insert the front hooks 686 into the first flanges 683. Meanwhile, though when the first flanges 683 are hooked by the front hooks 686 in one direction, the indoor unit 1 is supported without trouble because of one directional force of gravity. Merely, each of the first flanges 683 has two or more ribs that are bent and spaced each other, for preventing the indoor unit 1 from shaking even when there is small amount of impact.

When the side plate 685 is inserted into the front plate 680 according to the above-mentioned way, the side plate 685 and the front plate 680 are placed at a predetermined angle therebetween. The predetermined angle between two plates is the same as the angle between the front hooks 686 and the body of the side plate 685 and for this, the front hooks 686 have a flat shape.

Figure 24:
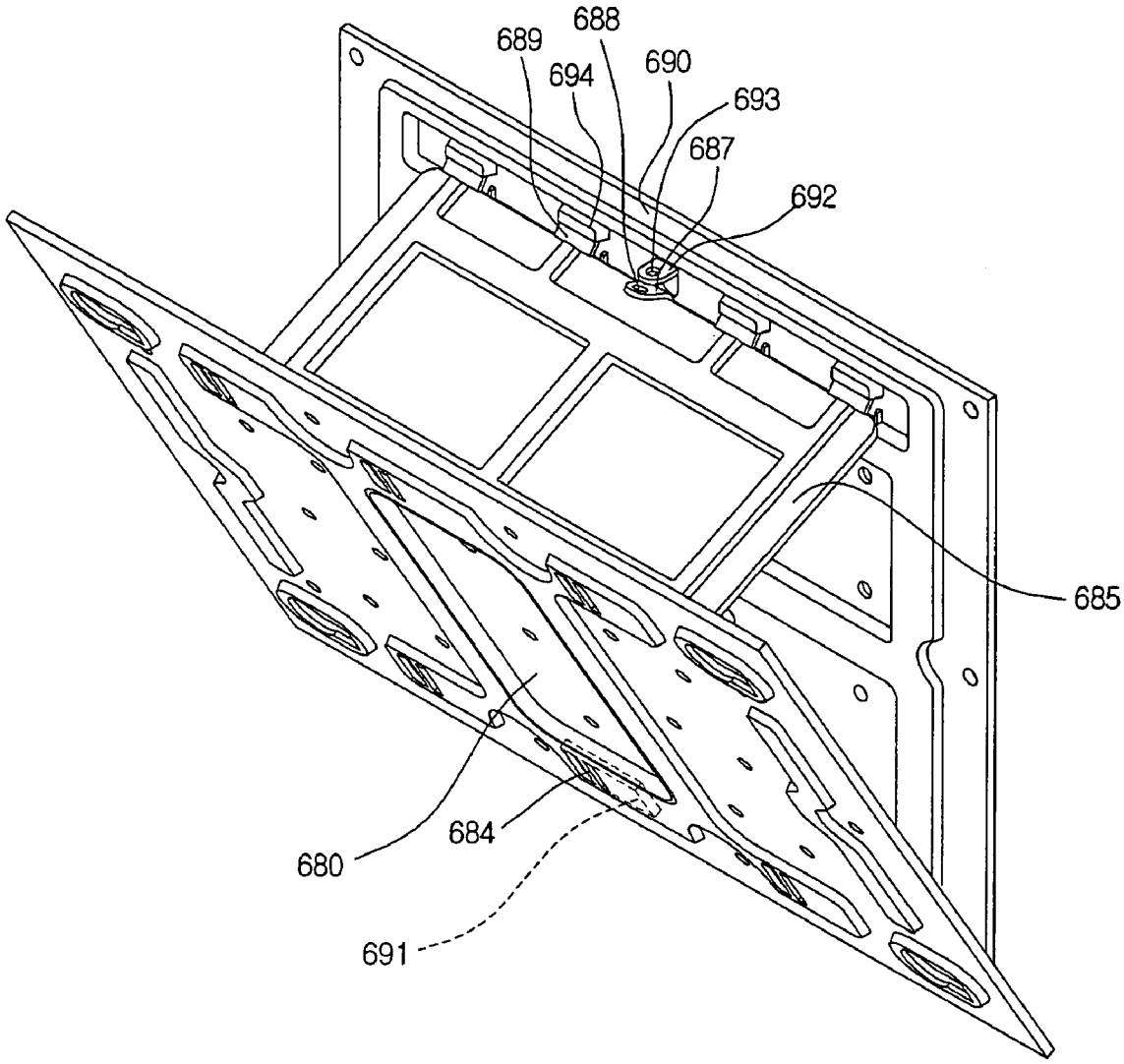
FIG. 24 is a perspective view showing a connection of a front plate, a side plate, and a rear plate according to the present invention.

After the front plate 680 and the side plate 685 are assembled in a single assembly, a coupling step of the assembly and the rear plate 690 proceeds. FIG. 24 shows the coupling step.

Referring to FIG. 24, two ends of the two plate 680 and 685 assembly are placed apart at a predetermined angle, and the rear plate 690 is coupled to the two ends. In detail, the rear hooks 689 of the side plate 685 are inserted into and guided by the side guides 694 formed on the one side of the rear plate 690 and then the front hooks 691 of the rear plate 690 are inserted in the second flanges 684 of the front plate 680. The coupling between the front hooks 691 of the rear plate 690 and the second flanges 684 of the front plate 680 is the same way as the coupling between the side plate 685 and front plate 680. As this way, the rear plate 690 is positioned by the guides of the front plate 680 and the side plate 685. Further, when the rear plate 690 is guided and positioned, the rear plate fixing part 687 and the side plate fixing part 692 are aligned and then a coupling member is inserted into the rear plate fixing hole 688 and the side plate fixing hole 693, such that the rear plate 690 is completely coupled. The rear plate 690 may be fixed to the wall using bolts or the like.

According to above steps of assembling the plates 680, 685 and 690, the coupling structure as shown in FIG. 17 is completed.

Figure 25:
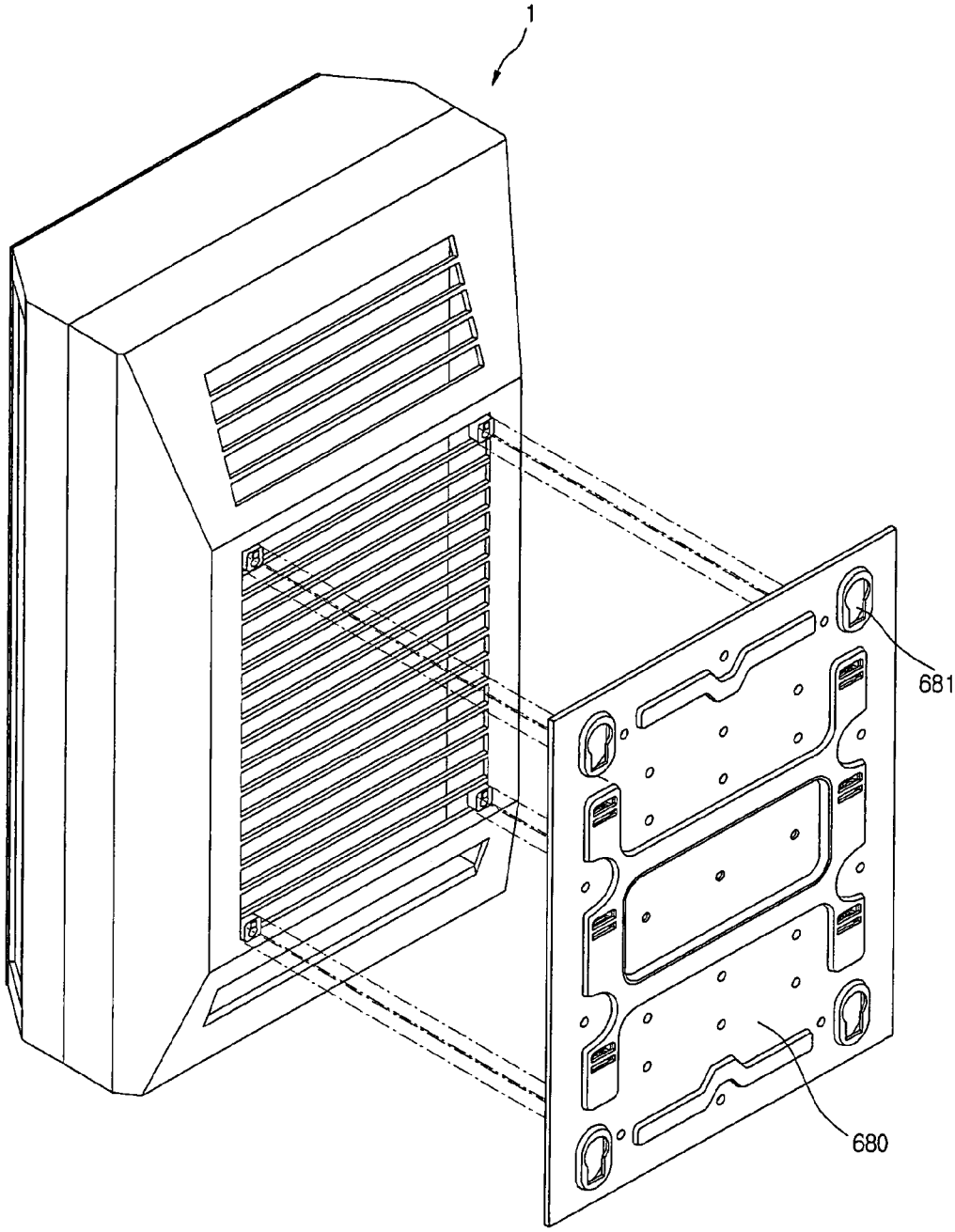
FIG. 25 is a perspective view showing a connection of a front plate and an indoor unit according to the present invention.
Figure 26:
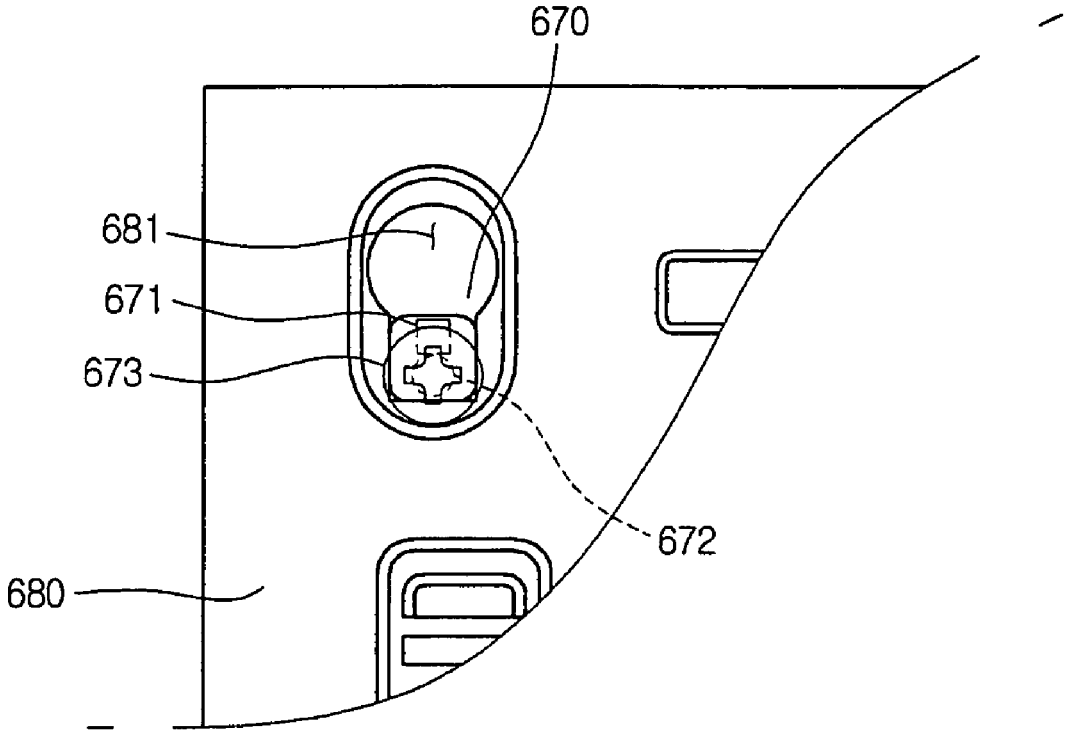
FIG. 26 is a partial rear view of a front plate to which a support protrusion is securely inserted.

FIG. 25 is a perspective view showing a connection of a front plate and an indoor unit according to the present invention and FIG. 26 is a partial rear view of a front plate to which a support protrusion is securely inserted.

Referring to FIGS. 25 and 26, the coupled relationship between the indoor unit 1 and the front plate 680 will be fully described.

The support protrusions 670 formed rear of the indoor unit 1 is aligned with the support protrusion insertion holes 681. The shape of the support protrusion insertion holes 681 includes a comparatively large circular hole at an upper side and a rectangular hole at a lower side. The shape of the rectangular hole is the same as the shape of the support protrusions 670. Therefore, when inserting the support protrusions 670, the support protrusions 670 are primary inserted into the upper circular holes and secondarily, inserted into the lower rectangular holes, such that the support protrusions 670 can be conveniently inserted into the support protrusion insertion holes 681. The shapes of the support protrusion insertion holes 681 and steps of inserting the support protrusions 670 are provided since the user can't see the backside of the indoor unit when he or she mounting the indoor unit 1. That is, the user roughly places the indoor unit to insert the support protrusions 670 to the circular holes of the support protrusion insertion holes 681 and then allows the indoor unit 1 to fall due to its weight, such that the support protrusions 670 can be inserted into the rectangular holes of the support protrusion insertion holes 681 and thus the indoor unit 1 can be mounted in the exact position.

After the support protrusions 670 are exactly inserted into the rectangular holes of the support protrusion insertion holes 681, coupling members 673 are inserted. The coupling members 673 are inserted into the coupling grooves 672 with its at least one outward portion abutting, upon a peripheral portion of the support protrusion insertion holes 681, such that exact positions of the coupling members 673 can be guided. Meanwhile, the coupling members 673 are inserted until they come into contact with the elevated portions 671. The elevated portions 671 are protruded at a height equal to the thickness of the front plate 680. Therefore, the coupling members 673 are equally spaced from the support protrusion 670 and the front plate 680 after the insertion, such that the coupling members 673 can be reliably coupled without bending or twisting and the coupling of the front plate 680 and the support protrusions 670 cannot be released.

Meanwhile, the angle between the indoor unit 1 and the wall can be conveniently adjusted by changing the width of the side plate 685. For this reason, the side plate 685 may be designed to have a shape that can change its width. Further, when the indoor unit 1 is mounted on a flat wall instead of a corner of wall, the front plate 685 can be directly mounted on the flat wall for a convenient mounting work.

In this embodiment, it is apparent that the front plate 680, the side plate 685, and the rear plate 690 function as the receiving hooks (refer to 660 in FIG. 10) and the support protrusions 670 function as the settlement guides 650.

Figure 27:
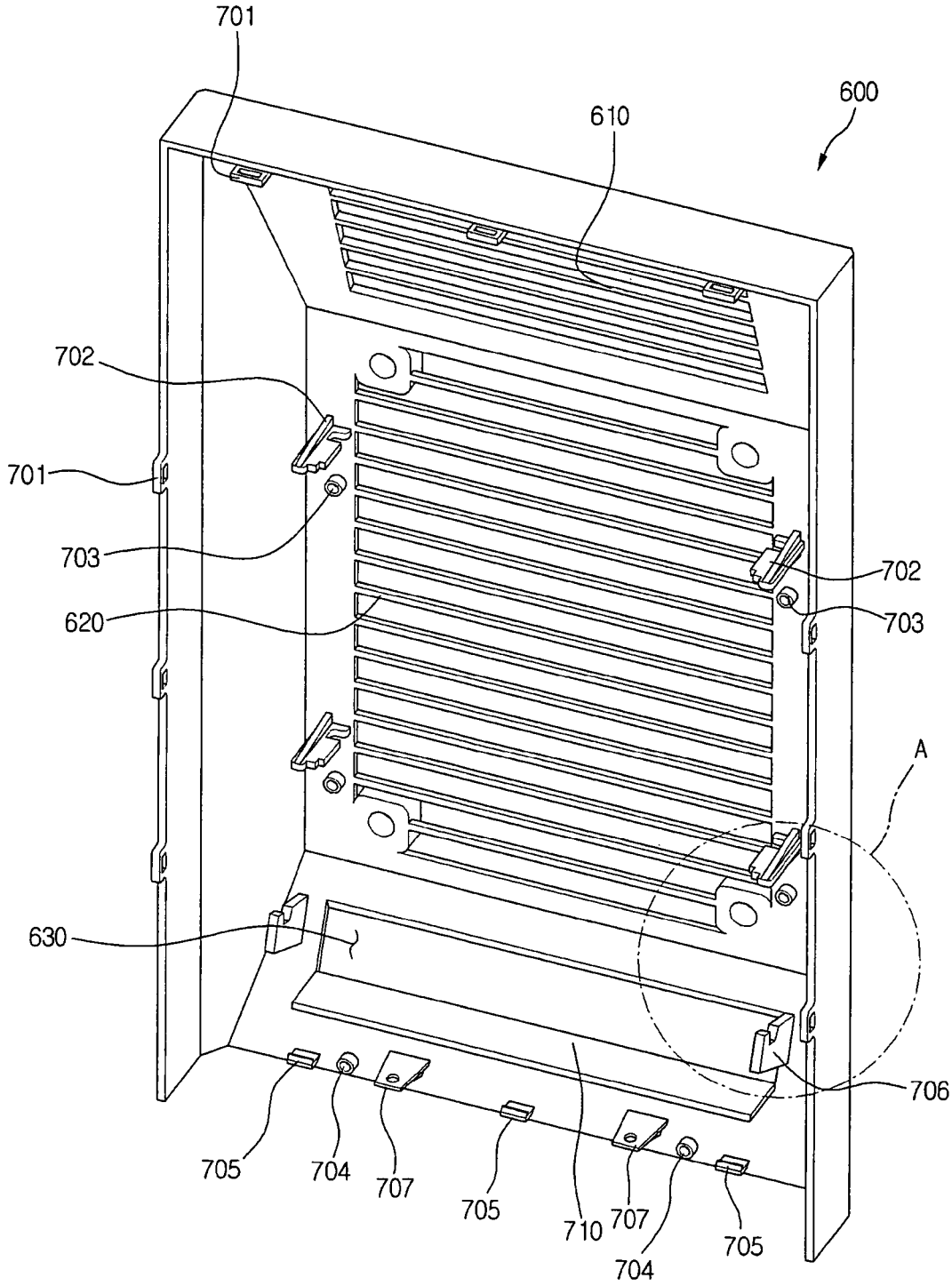
FIG. 27 is a front perspective view of a rear cover according to the present invention.
Figure 28:
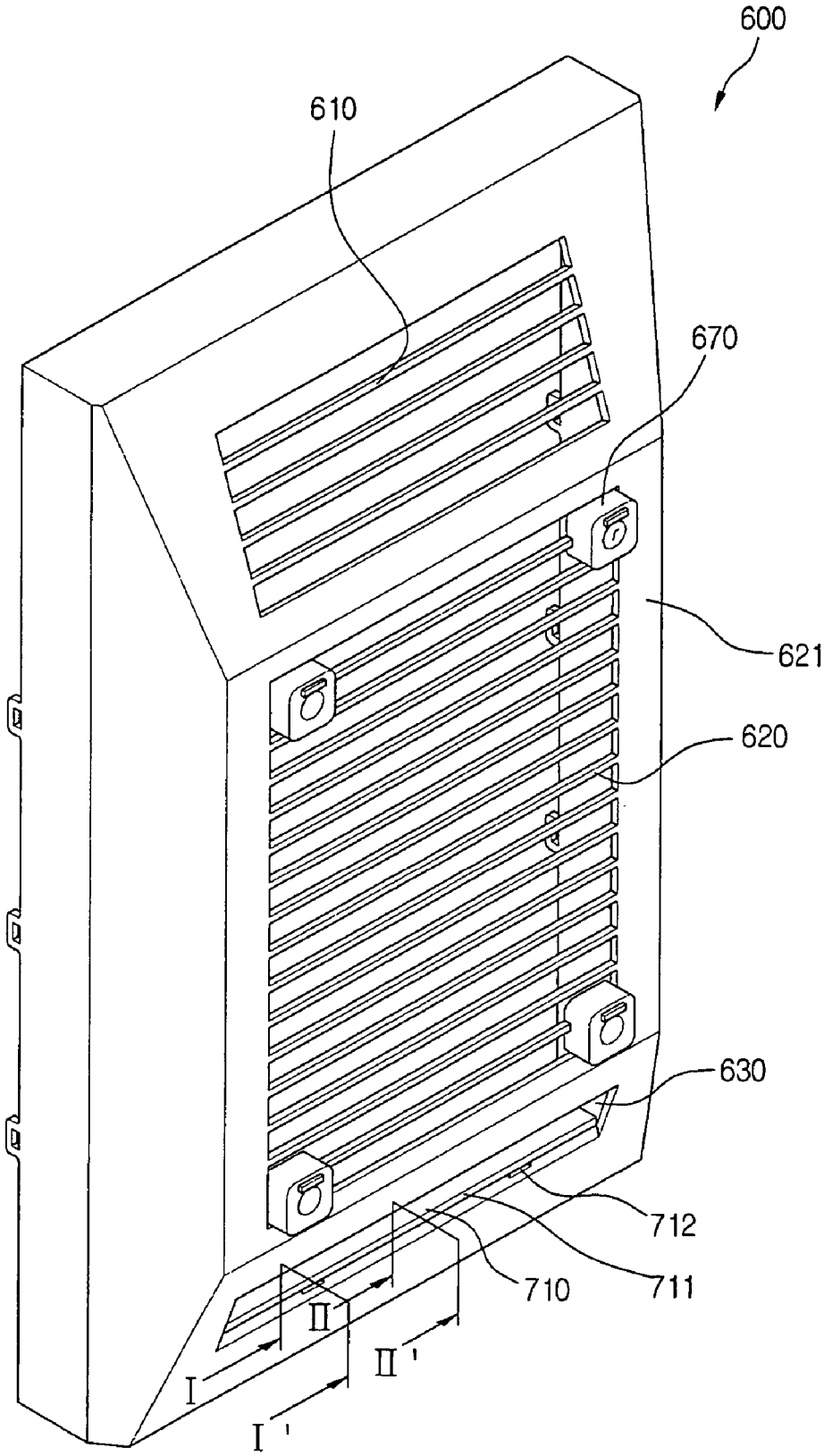
FIG. 28 is a rear perspective view of a rear cover according to the present invention.

FIG. 27 is a front perspective view of a rear cover according to the present invention and FIG. 28 is a rear perspective view of a rear cover according to the present invention. These drawings show the rear cover 600 in detail, including parts or potions that are not shown in the perspective view of the indoor unit 1.

Referring to FIGS. 27 and 28, the rear cover 600 includes an air suction hole at at least one portion, for sucking indoor air into the indoor unit 1. Four edge of the rear cover 600 are sloped at a predetermined angle as they travel backwardly, such that the indoor unit 1 can be conveniently mounted. The suction holes 610 and 620 are formed with grills, such that particles included in the air such as dirt and impurities can be prevented from being sucked into the indoor unit 1, and accidents occur when children insert their hand into the indoor unit 1 can be prevented. Also, the rear cover 600 includes the filter insertion hole 630 for an insertion of a filter. The filter will be described later. It is apparent that the filter is provided to filter off dirt in the sucking air. Further, the indoor unit 1 can be freely mounted on a corner of wall because the four edges of the rear cover 600 are sloped at the predetermined angle.

When the inside of the rear cover is viewed, the rear cover includes: one or more front frame coupling parts 701 formed at a front edge, for coupling with rear cover hooks formed on an inner surface of the front frame 200 (refer to 241 in FIG. 70); one or more first heat exchanger supports 702 formed on each side of an inner bottom, for receiving a heat exchanger 810; and second heat exchanger supports 706 protrusively formed on both sloped sides of the filter insertion hole 630, for supporting the heat exchanger 810.

Further, the rear cover 600 includes drain pan guides 707, drain pan fixing part 704, and tube cover fixing part 705. A drain pan 820 and the air guide 400 are to be coupled to the drain pan guides 707. The drain pan fixing parts 704 are protrusively formed on left and/or right sides of the drain pan guides 707 in order to insert coupling member therethrough, for coupling the drain pan 820 with the rear cover 600. The tube cover fixing parts 705 are provided for coupling the tube cover 830 in the rear cover 600.

Further, the rear cover 600 includes a flow guide 710, a filter receiving surface 711, and filter fixing grooves 712. The flow guide 710 extends from a bottom of the filter insertion hole 630 toward the inside of the indoor unit 1, for guiding the air sucked through the filter insertion hole 630. The filter receiving surface 711 is provided for guiding a lower end of the filter (refer to 720 in FIG. 32) when the filter is inserted and placed in exact position. The filter fixing grooves 712 are provided to insert protrusions formed at the lower end of the filter 702, for fixing the filter 720 in exact position. Further, the filter receiving surface 711 increases coupling degree of the filter 720 and the rear cover 600, thereby preventing a leakage of air.

Figure 29:
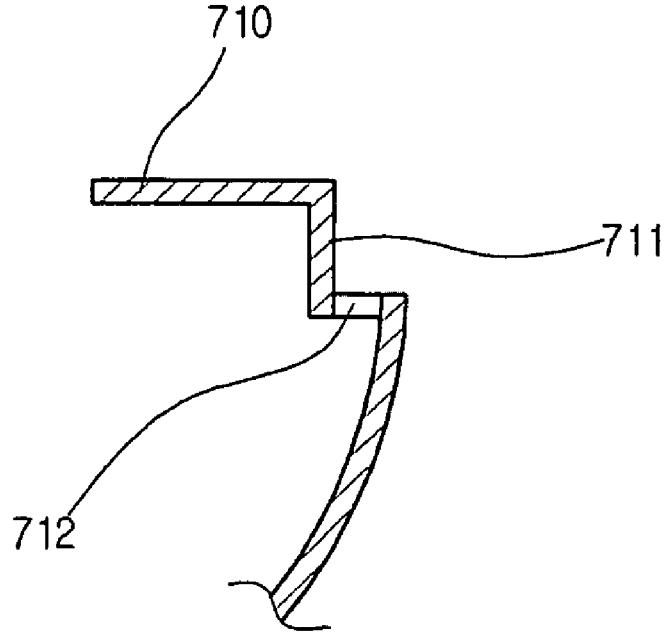
FIG. 29 is a section taken on line I-I' in FIG. 28.
Figure 30:
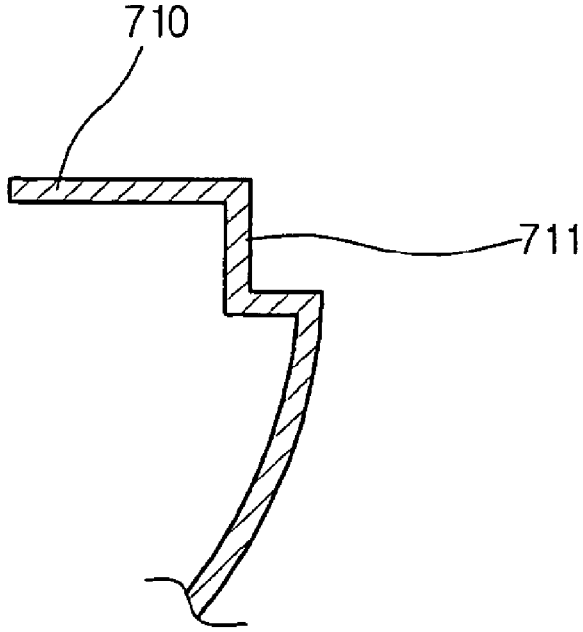
FIG. 30 is a section taken on line II-II' in FIG. 28.
Figure 3:
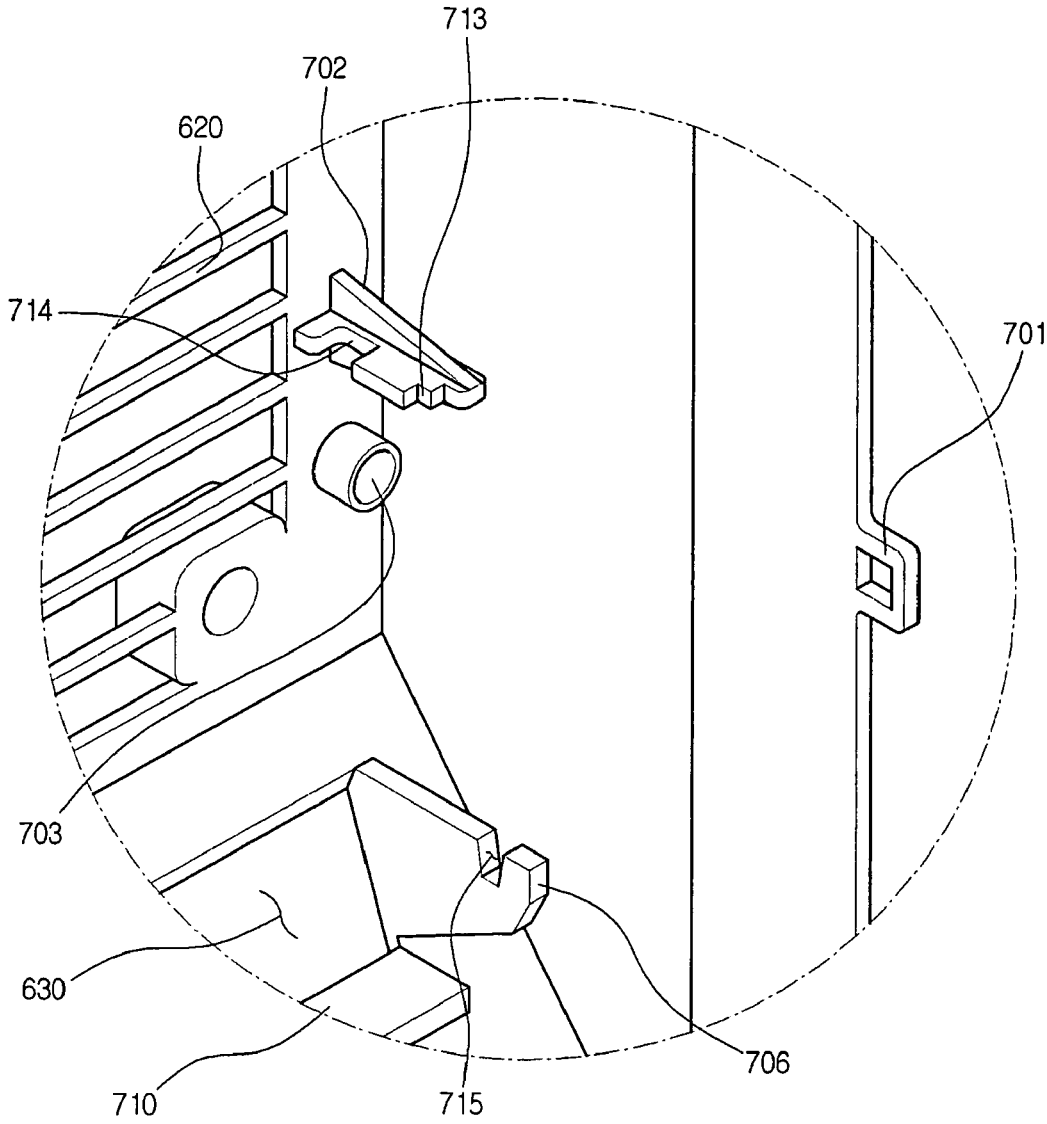

FIG. 29 is a section taken on line I-I' in FIG. 28 and FIG. 30 is a section taken on line II-II' in FIG. 28. Referring to these drawings, the filter receiving surface 711 is bent downwardly from the flow guide 710, and the filter fixing grooves 712 are formed at a lower end of the filter receiving surface 711 and the number of the filter fixing grooves 712 is two.

FIG. 31 is a partial enlarged view of "A" depicted in FIG. 27.

Referring to FIG. 31, each of the first heat exchanger supports 702 includes a heat exchanger receiving part 713 formed having a stepped shape at a leading end portion and a filter guide insertion groove 714 formed having a predetermined depth at the other end portion. The stepped shape of the heat exchanger receiving part 713 is provided to easily cope with the change of heat exchanger capacity because the width of the heat exchanger 810 changes according to the diameter of the heat exchanger tube 811. The filter guide insertion groove 714 receives a filter guide (refer to FIG. 34) that has a predetermined length and allows the filter 720 to be inserted easily. The filter guide 730 is coupled with filter guide coupling parts 703, which are protruded below the first heat exchanger supports 702 with a vertical arrangement therebetween, such that the filter guide 730 can be securely fixed. Each of the second heat exchanger supports 706 is provided at a top edge with a heat exchanger receiving groove 715, for receiving and supporting the lower side of the heat exchanger 810. The heat exchanger receiving groove 715 may receive a rear side or the heat exchanger 810 or a tube thereof.

The flow guide 710 guides the air sucking through the filter insertion hole 603 and as well prevents the drain pan 820 from shaking. For this purpose, the flow guide 710 is designed to extend in a horizontal direction.

Figure 32:
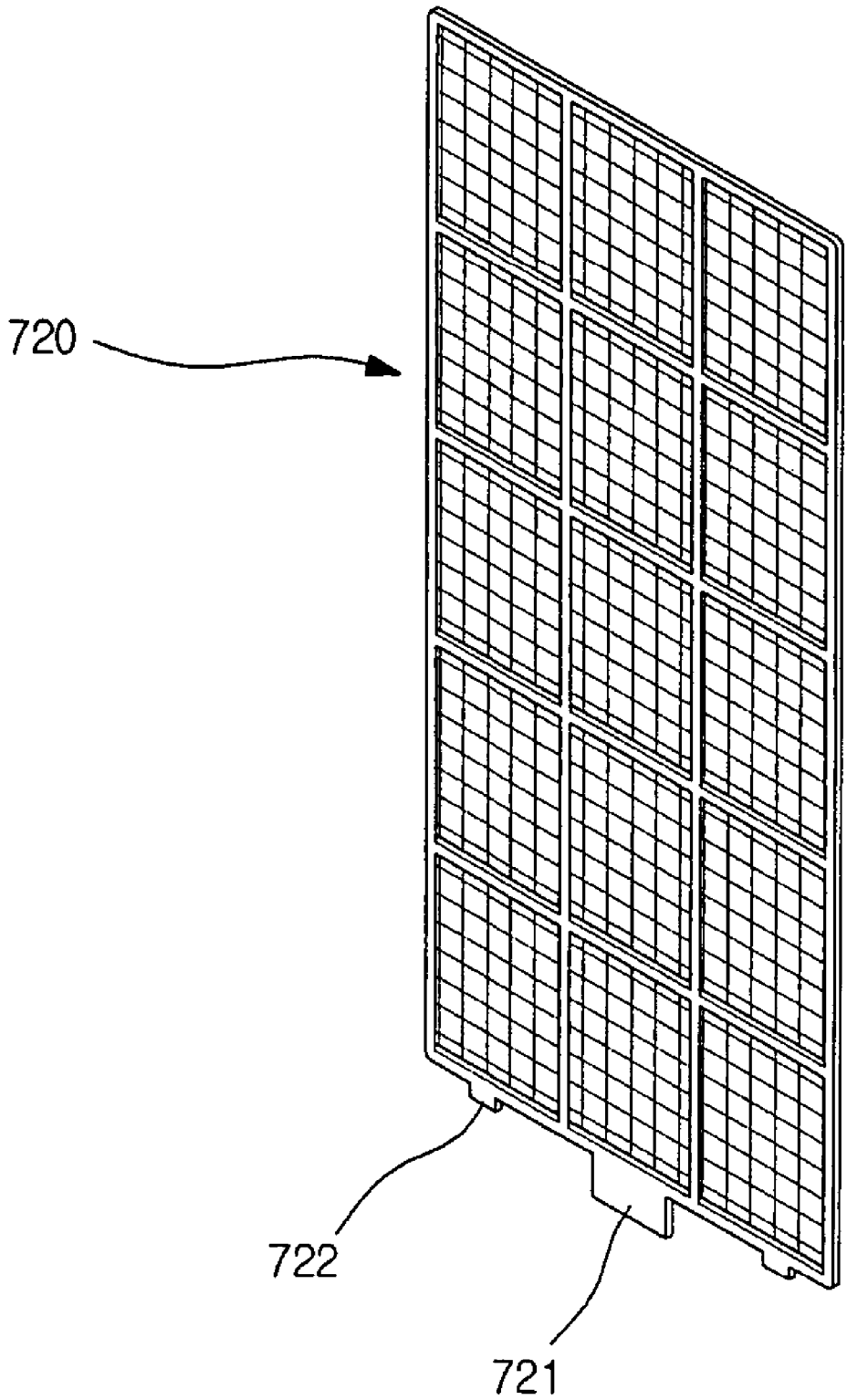
FIG. 32 is a perspective view of a filter according to the present invention.

FIG. 32 is a perspective view of a filter according to the present invention.

Referring to FIG. 32, the filter 720 of the present invention may be a high efficiency particulate air (HEPA) filter that has a rectangular shape as a whole and provided with plural meshes. The filter 720 includes: filter fixing ribs 722 at a lower edge to be coupled with the filter fixing grooves 712, for supporting the filter 720 at a low; and a filter handle 721 that allows the user to hold it for inserting or drawing the filter 720.

Figure 33:
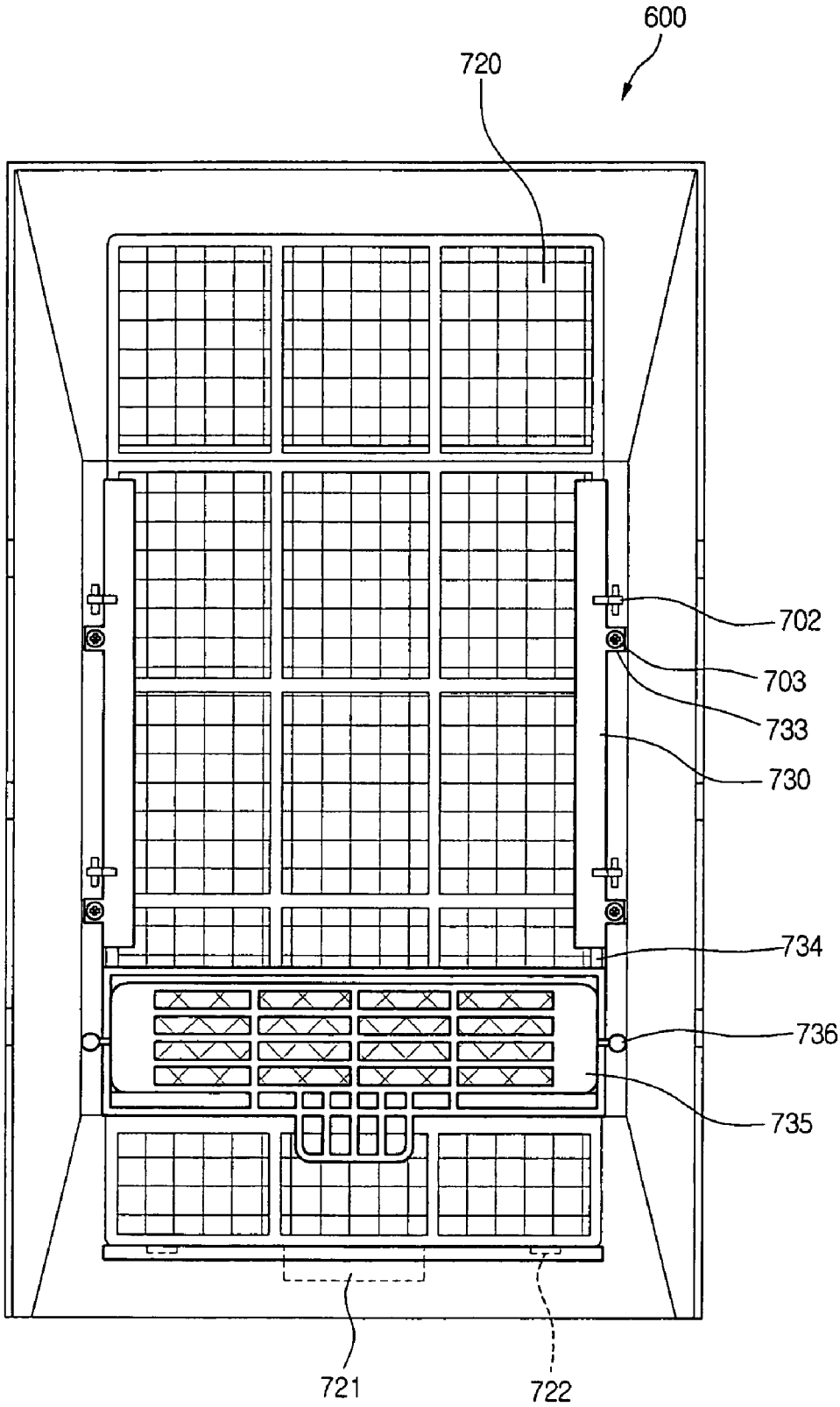
FIG. 33 is a front perspective view of a rear cover to which a filter is coupled.
Figure 34:
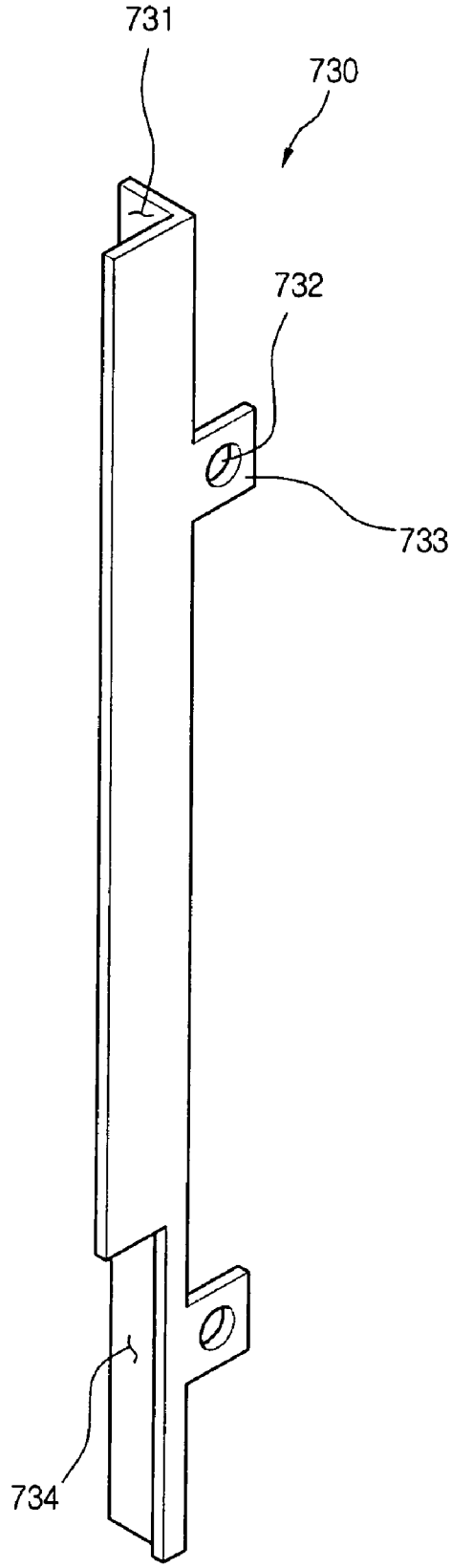
FIG. 34 is a perspective view of a filter guide according to the present invention.

FIG. 33 is a front perspective view of a rear cover to which a filter is coupled and FIG. 34 is a perspective view of a filter guide used for guiding a filter according to the present invention.

Referring to FIGS. 33 and 34, the filter 720 is inserted by the guide of the filter guide 730 that is provided at each side of the bottom surface of the rear cover 600, such that the user can easily insert the filter 720. In detail, the filter guide may made of plastic and has a L-shaped cross section forming a filter insertion portion 731 at inner side in order to receive the frame of the filter 720 at each lateral side. Further, the filter guide 730 is formed with at least one fixing extension 733 extending from outer side in a horizontal direction, for coupling with each of the filter guide coupling parts 703. The fixing extension 733 is formed with a hole 732, for an insertion of a coupling member therethrough, such that the fixing extension 733 and the filter guide coupling parts 703 can be arranged and coupled.

An insertion method and structure of the filter will now be described. The filter guides 730 are coupled to the rear cover 600 by coupling of the fixing extensions 733 of the filter guides 730 and the filter guide coupling parts 703 of the rear cover 600. After the coupling of the filter guide 730 and the rear cover 600, the filter 720 is pushed upwardly through the filter insertion hole 630 while guided by the filter insertion portion 731, such that the filter 720 can be mounted on a rear face of the rear cover 600 with a closely contacted relationship therebetween. The filter 720 comes to be fixed after the filter is inserted enough to cover the inner face of the upper suction hole 610 and the filter fixing ribs 722 are inserted in the filter fixing grooves 712 for supporting the lower portion of the filter 720.

Since the frame of the filter 720 is made of a flexible material such as elastic-plastic material, a non-guided portion of the filter 720 bends smoothly, such that the filter 720 can cover the inner face of the upper suction hole 610.

In front of the filter may be installed a dust collector 735 that applies high voltage for collecting fine dust that is not filtered off by the filter 730. The dust collector 735 may include a fixing part 736 that extends from each side thereof, for a coupling to the rear face of the rear cover 600, and the rear cover 600 may include a coupling part such as a boss at each corresponding portion to the fixing part 736. Further, the filter guide 730 is formed with a dust collector receiving part 734 at a lower portion to receive the dust collector 735 without interference with the dust collector 735, such that the dust collector 735 can be stably mounted on the rear cover 600.

Figure 35:
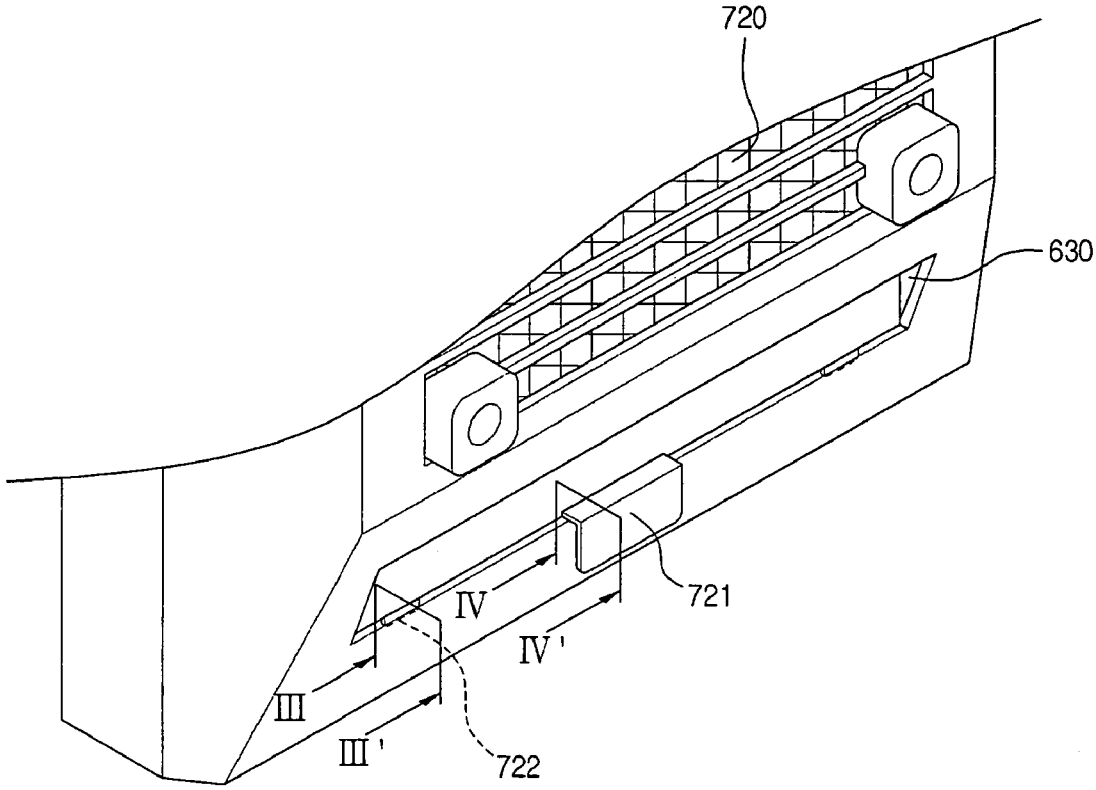
FIG. 35 is a partial perspective view showing a lower portion of a rear cover.
Figure 36:
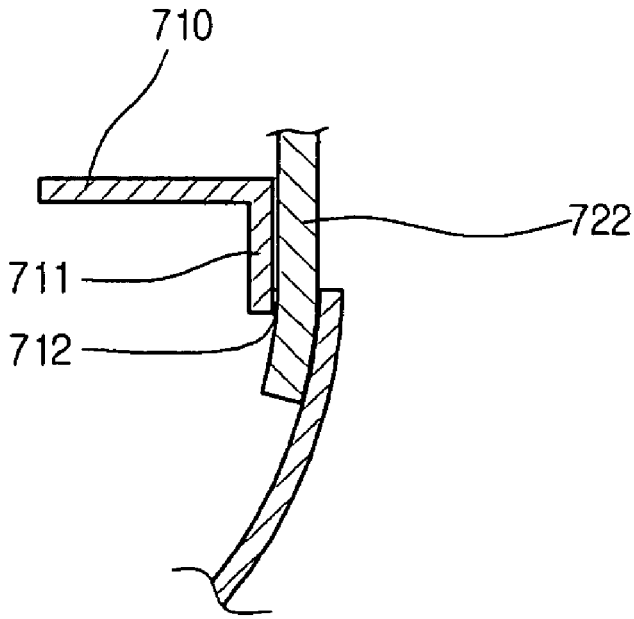
FIG. 36 is a section taken on line III-III' in FIG. 35.
Figure 37:
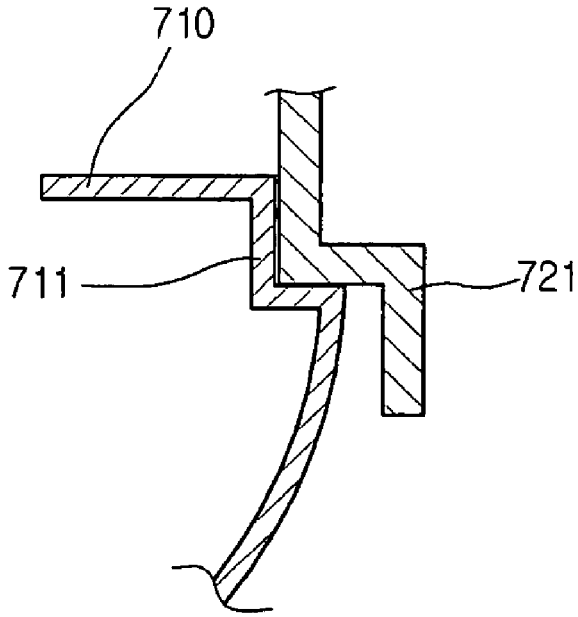
FIG. 37 is a section taken on line IV-IV' in FIG. 35.
Figure 3:
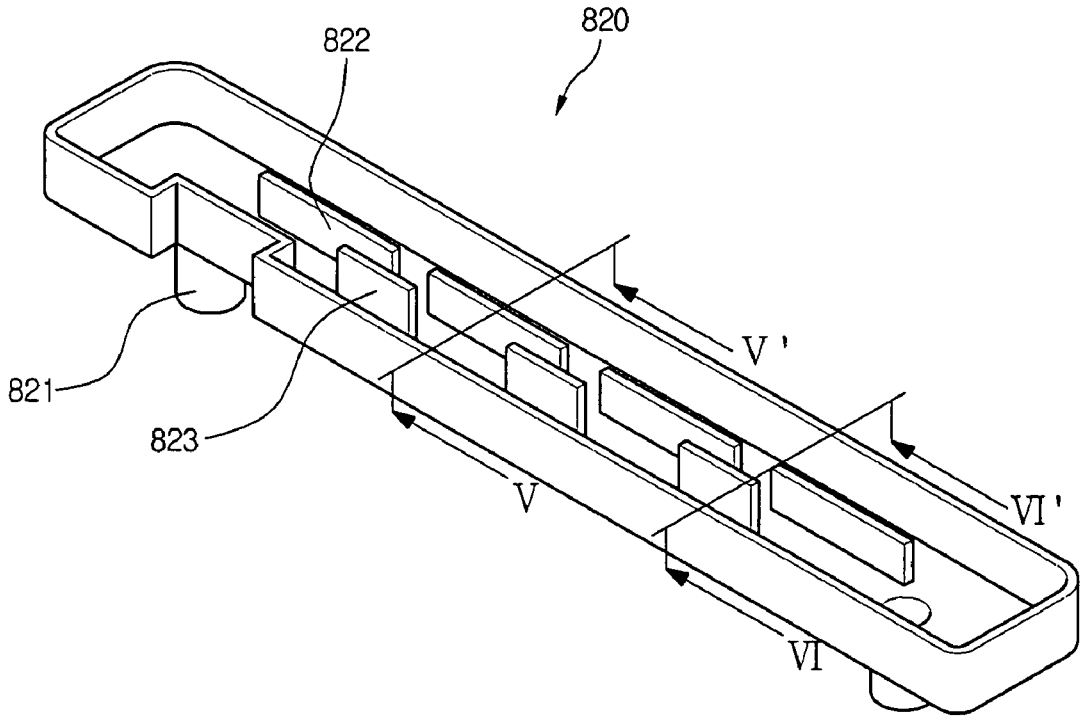
Figure 3:
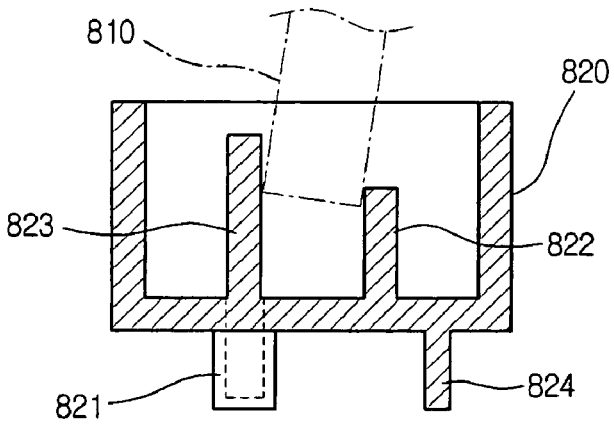

FIG. 35 is a partial perspective view showing a lower portion of a rear cover when a filter is installed, FIG. 36 is a section taken on line III-III' in FIG. 35, and FIG. 37 is a section taken on line IV-IV' in FIG. 35.

Referring to FIGS. 35, 36, and 37, mounting status of the filter will now be described. It is apparent that the filter guide 730 supports the main body of filter 720 when the filter 720 is completely mounted. The filter fixing ribs 722 formed at the lower edge of filter 720 are inserted in the filter fixing grooves 712 while closely contacting with the filter receiving surface 711, such that the lower edge of the filter 720 can be securely fixed. Further, the user inserts and draws the filter 720 in convenience due to the filter handle 721 protruded forward from a center of the lower edge of the filter 720.

In detail, when a user mounts the filter 720, the user holds the filter handle 721 and pushes the filter 720 to some extent through the filter insertion hole 630 and then pulls back the filter 720 for inserting the filter fixing ribs 722 to the filter fixing grooves 712, thereby completing the mounting of the filter 720. When the user removes the filter 720, the user holds the filter handle 721 and slightly pushes the filter 720 in upward direction in order to draw the filter 720 from the filter fixing grooves 712 and then pulls down the filter 720 while bending the filter slightly.

Figure 40:
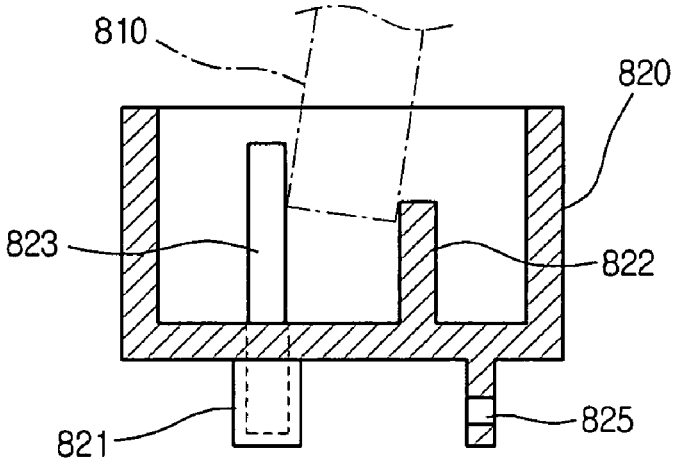
FIG. 40 is a section taken on line VI-VI' in FIG. 38.

FIG. 38 is a perspective view of a drain pan according to the present invention, FIG. 39 is a section taken on line V-V' in FIG. 38, and FIG. 40 is a section taken on line VI-VI' in FIG. 38.

Referring to the FIGS. 38 to 40, the drain pan 820 is disposed below the heat exchanger 810 with a predetermined depth, for collecting condensed water that drops from the heat exchanger 810. Further, the drain pan 820 is provided at an outer bottom with a pair of drain tube 821 extending downwardly in vertical direction with a predetermined length, for draining the water.

Further, the drain pan 820 provided at an inner bottom with first anti-shake ribs 822 and second anti-shake ribs 823, for preventing the heat exchanger 810 from shaking by supporting the lower portion of the heat exchanger 810. Each of the anti-shake ribs is spaced one another as shown in drawing and the number of ribs may be properly selected. There is height difference between the first and the second anti-shake ribs. Preferably, the second anti-shake ribs 823 are taller than the first anti-shake ribs 822. Therefore, both the front and rear sides of the heat exchanger 810 can be securely supported.

Further, the drain pan 820 is provided at the outer bottom with fixing parts 825 that are coupled with the corresponding drain pan fixing parts 704 of the rear cover 600, for fixing the drain pan 820. By aligning the drain pan fixing parts 704 and the fixing parts 825 and inserting coupling members thereto, the drain pan 820 can be securely fixed to the rear cover 600.

Further, the drain pan 820 is provided at the outer bottom with guides 824, for inserting to the drain pan guide parts 707 of the rear cover 600. By inserting the guides 824 to the drain pan guide parts 707, the drain pan 820 can be placed and stably held in exact position before securely fixed by the coupling members.

Figure 41:
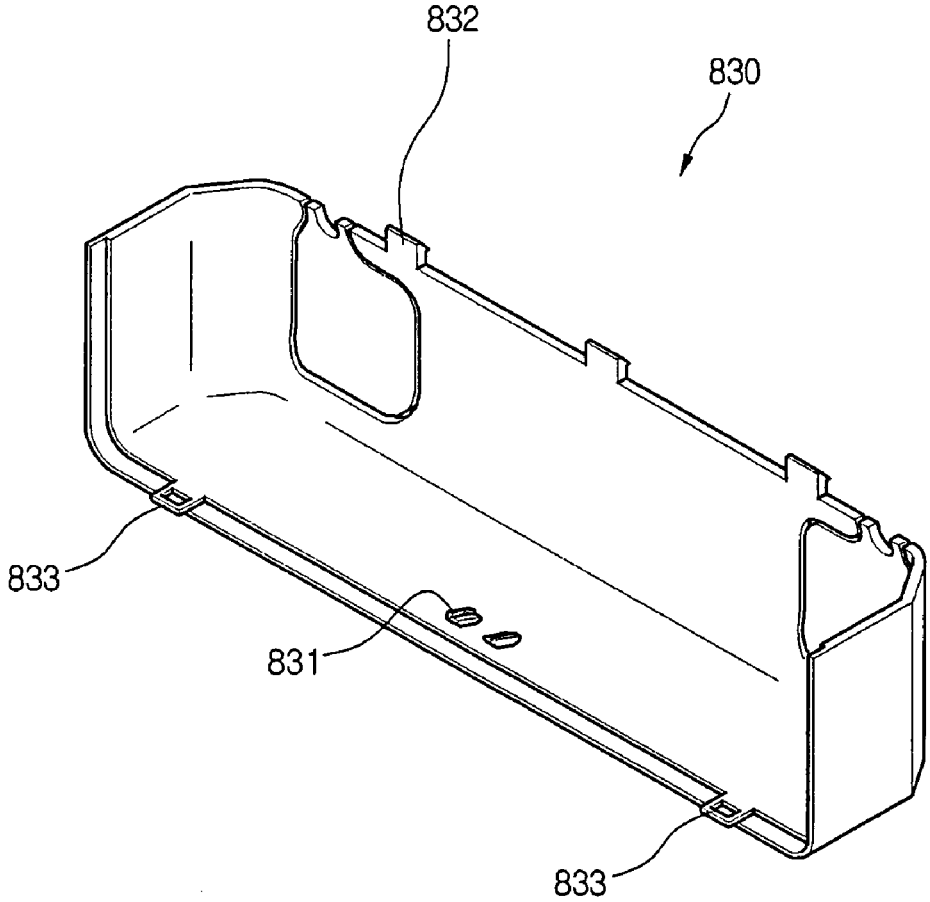
FIG. 41 is a perspective view of a tube cover according to the present invention.

FIG. 41 is a perspective view of a tube cover according to the present invention.

Referring to FIG. 41, the tube cover 830 is provided at a lower portion of the rear cover 600 to prevent a cable connected to the indoor unit from exterior and other tubes from exposing to outside.

In detail, the tube cover 830 is provided at an upper edge with rear cover hooking parts 832 that are coupled with the tube cover fixing parts 705 formed at a lower end portion of the rear cover 600, such that the tube cover 830 can be fixed to the rear cover 600. Further, the tube cover 830 is provided at a both sides of lower edge with second hooking parts 833, for coupling with the lower portion of the front frame 200. Further, the tube cover 830 is provided with first hooking parts 831 for connecting with the air guide 400. In other words, the tube cover 830 is coupled to the air guide 400, the rear cover 600, and the front frame 200 respectively through the hooking parts 831, 832, and 833, such that the tube cover 830 can be securely supported after coupling.

Figure 42:
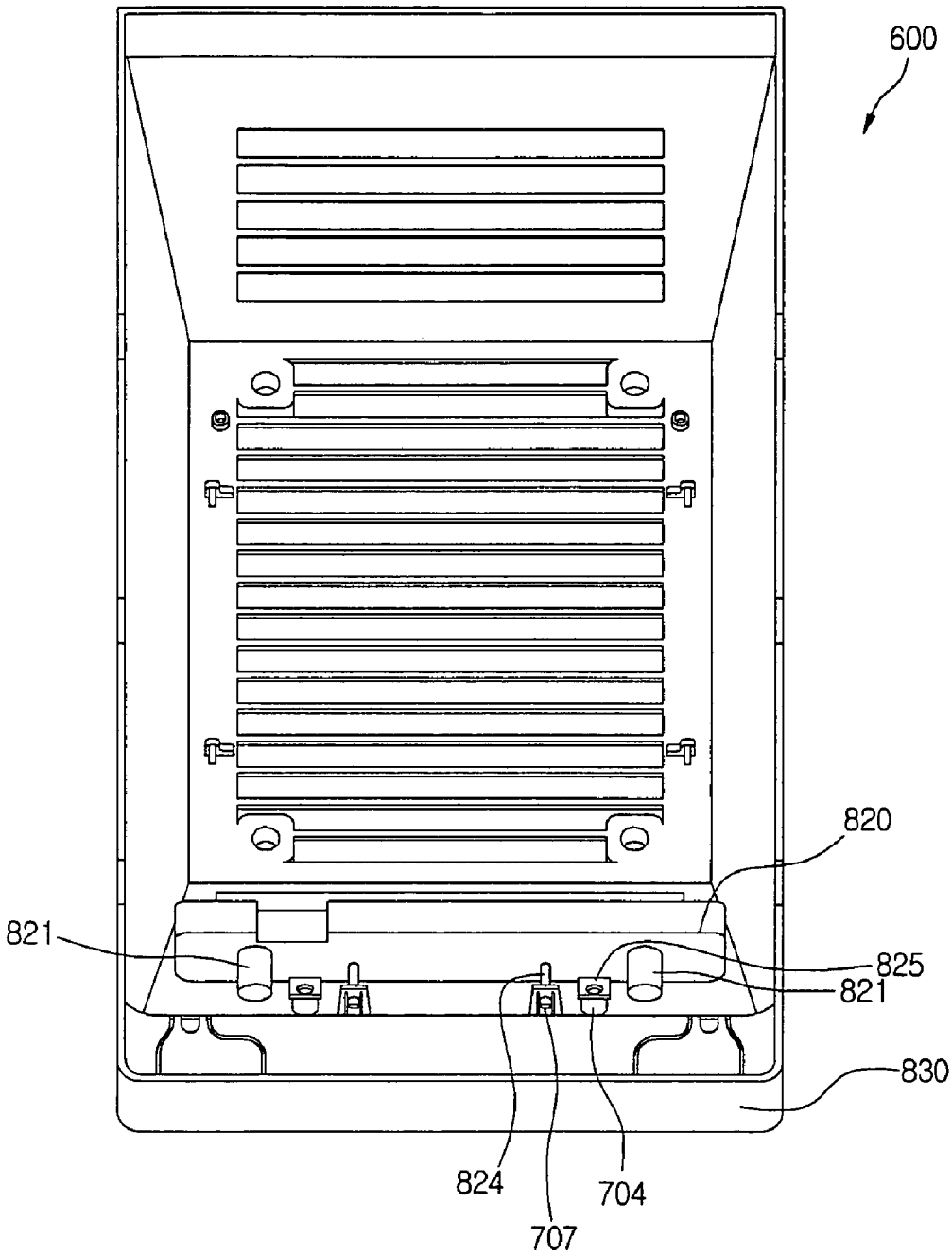
FIG. 42 is a front perspective view of a rear cover to which a drain pan and a tube cover are coupled according to the present invention.
Figure 4:
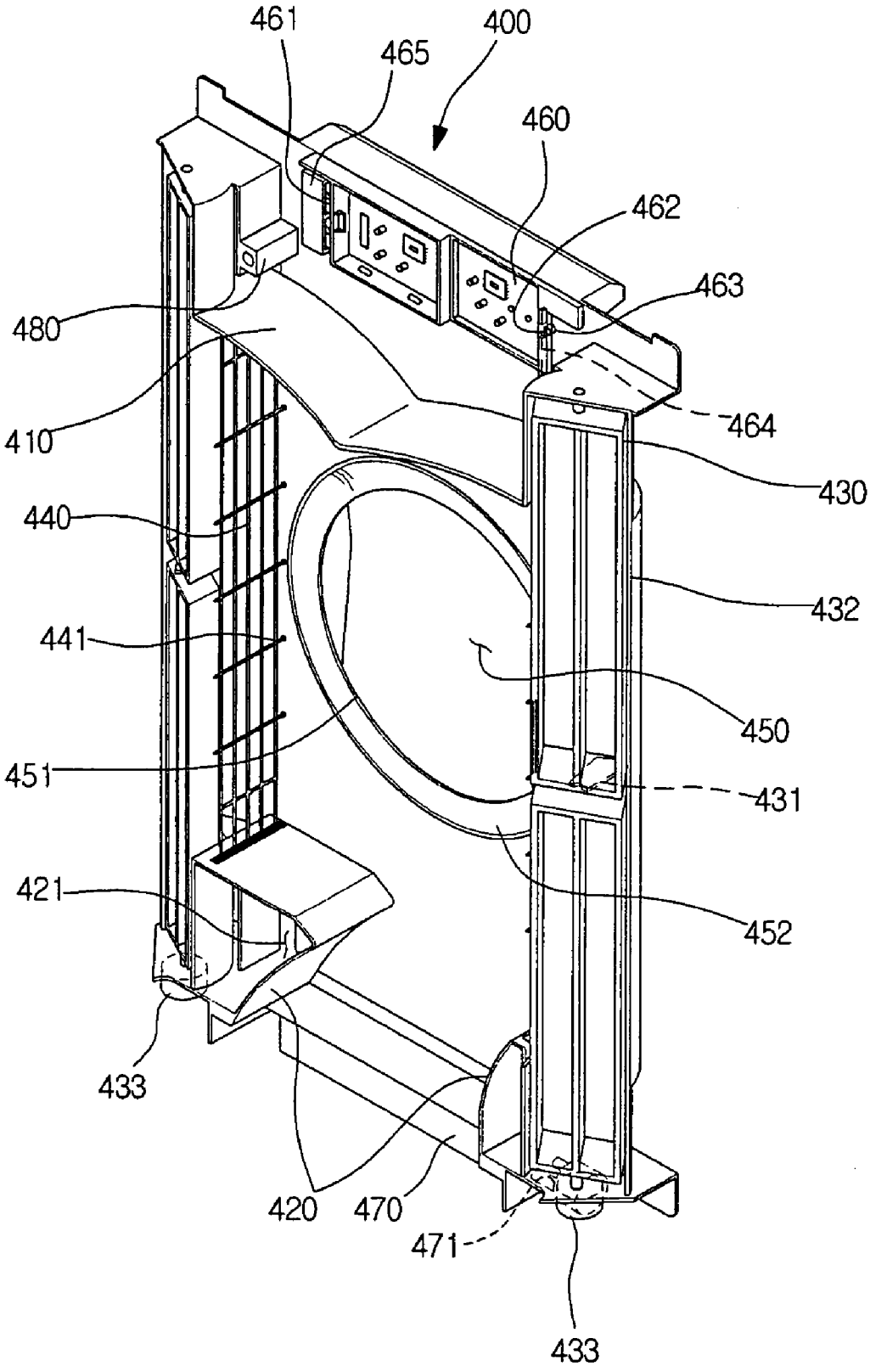

FIG. 42 is a front perspective view of a rear cover to which a drain pan and a tube cover are coupled according to the present invention. The mounting structure of the drain pan 830 is shown in detail in this drawing.

Referring to FIG. 42, the fixing parts 825 formed at the outer bottom of the drain pan 820 and the drain pan fixing parts 704 of the rear cover 600 are aligned and coupled using the coupling members. Further, the guides 824 of the drain pan 820 are inserted into the drain pan guide parts 707, such that the drain pan 820 can be easily placed in the proper position before coupled using the coupling members.

Figure 44:
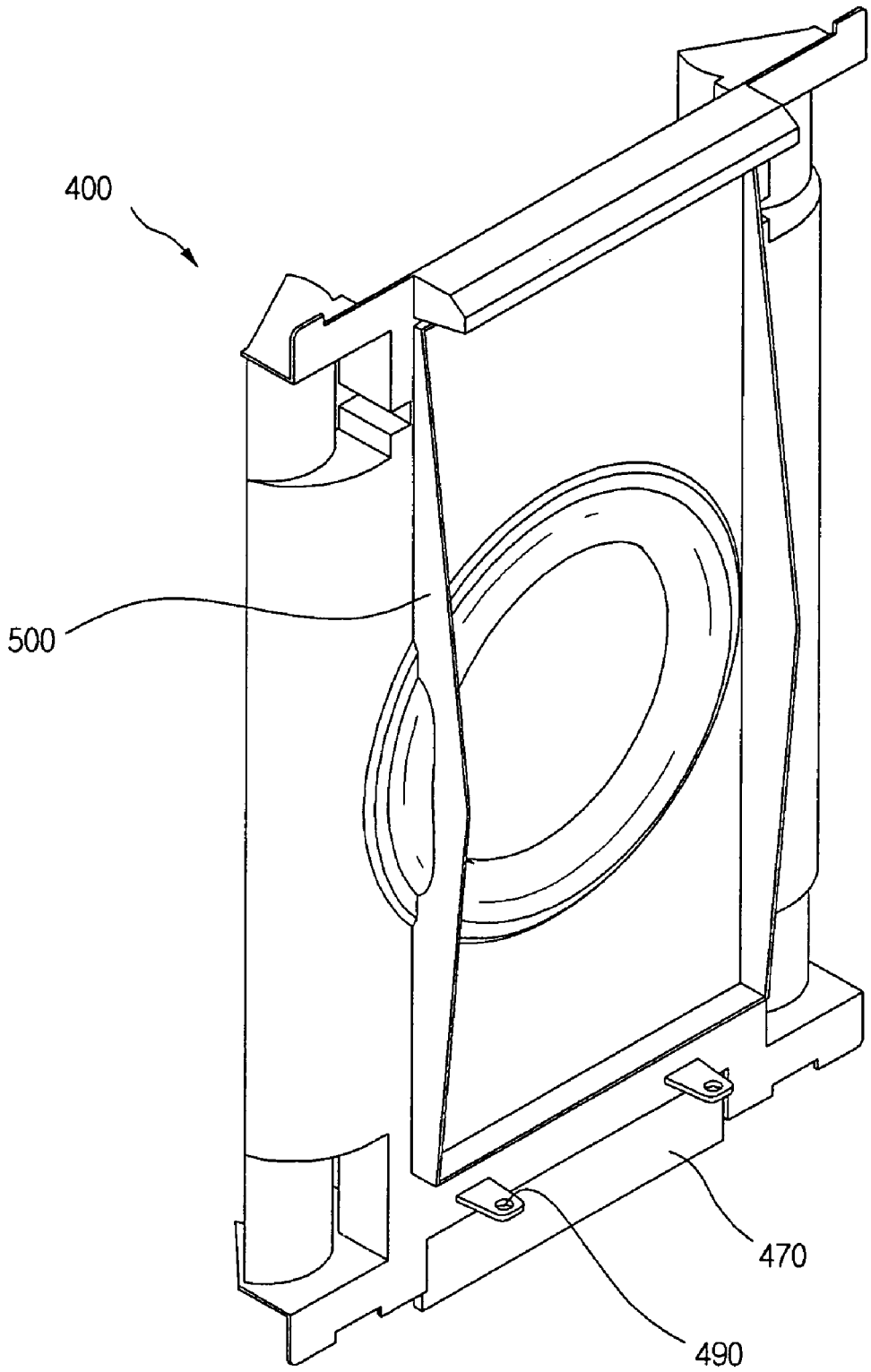
FIG. 44 is a rear perspective view of an air guide according to the present invention.

FIG. 43 is a front perspective view of an air guide according to the present invention and FIG. 44 is a rear perspective view of an air guide according to the present invention.

Referring to FIGS. 43 and 44, the detail shape and structure of the air guide 400 will now be described.

The air guide 400 has a rectangular shape as a whole. The air guides 400 includes the air guide hole 450 penetrating at a central portion with a predetermined diameter and a bell mouth 451 formed at inner circumference of the air guide hole 450 with a predetermined radius of curvature to smoothly curved. Further, the air guide 400 includes the upper air guide 410 and the lower air guide 420, for guiding the indoor air sucked through the air guide hole 450 to the discharge holes 210 and 220. The shapes of the air guides 410 and 420 are provided to make smooth airflow passage. Therefore, the air guides 410 and 420 are divided into two portions toward each side along the airflow streamline in order to guide the air outwardly along each side, such that the air blown from the blower fan 800 can be smoothly guided to the discharge holes 210 and 220. In detail, the upper air guide 410 guides the air to the side discharge holes 220 and the lower air guide 420 guides the air to the bottom discharge hole 210.

Meanwhile, the blower fan 800 is preferably a turbofan, which sucks air in axial direction and discharge the air in radial direction. Therefore, the upper air guide 410 can smoothly guide the air toward the side discharge holes 220 and the lower air guide 420 can smoothly guide the air toward the bottom discharge hole 210. Specifically, the lower air guide 420 extends with a slope in a direction tangential to the circumference of the blower fan 800 in order to smoothly guide the air discharged from the blower fan 800 to the bottom discharge hole 210, such that turbulent airflow can be reduced and thereby the discharged air can be smoothly guide to the outside of the indoor unit 1 with a low air suction loss.

Due to the bell mouth 451 formed at the inner circumference of the air guide hole 450, the air guide hole 450 has a smoothly curved inner circumference and thereby the indoor air sucked from the rear side can be smoothly blown to the front side without leakage and noise. Further, a blower fan receiving part 452 is provided in the circumference of the bell mouth 451 in order to allow the blower fan 800 to be closely contacted with the air guide 400 when the blower fan 800 is seated in the air guide 400. If necessary, the blower fan receiving part 452 may be formed with a sealing part, or further a bonding agent can be applied to the blower fan receiving part 452 for a complete sealing without air leakage.

Further, the air guide 400 is provided at each side with a wind direction shifter receiver 432 curved forwardly with a predetermined radius of curvature, for guiding the air guided by the upper air guide 410 to the side discharge 220. Further, the wind direction shifter receiver 432 receives the wind direction shifter 430 therein, the wind direction shifter 430 being provided to adjust the direction of the air for discharging the sucked indoor air in various directions. In detail, a wind direction shifter mounting guide 431, which is protrusively formed at the curved surface of the wind direction shifter receiver 432, supports the wind direction shifter 430, and hinges supports the upper and lower portion of the wind direction shifter 430, such that the wind direction shifter 430 can be rotated at a predetermined angle. A front frame coupling part 480 is formed above the location where the wind direction shifter receiver 432 meets the upper air guide 410, for coupling with the front frame 200. A wind direction shifter driving motor 433 is disposed at a bottom of the wind direction shifter 430 to drive the wind direction shifter 430 in the left and right direction. It is apparent that the location of the wind direction shifter driving motor 433 is not limited to this embodiment. The motor 433 can be located at any position.

Further, the safety screen 440 is provided between the blower fan 800 and the wind direction shifter 430 to protect a user from the blower fan 800 when the user inserts hand toward the blower fan 800. The safety screen may be inserted and fixed to a number of safety screen coupling grooves 441 formed in the body of air guide 400.

Further, a space for receiving the electrical part 460 is formed above the upper air guide 410. In detail, an electrical part support 465 is formed at one side of the space, for receiving support ribs 461 formed at one side of the electrical part 460. An electrical part coupling part 463 is formed at the other side of the space, for coupling with a coupling part 462 formed at the other side of the electrical part 460 by using a coupling member. Further, an elevated portion 464 is formed to make a space between the electrical part 460 and the air guide 400, for a rapid radiation.

The installation of the electrical part 460 will be described more fully. The electrical part 460 is provided with a number of heat-generating electrical elements, such that the electrical part 460 is spaced apart from the air guide 400 to release heat. Because the space between the electrical part 460 and the air guide 400 allows airflow therethrough, the heat of the electrical part 460 can be easily released. To make the electrical part 460 spaced apart from the air guide 400, one side of the electrical part 460 is fixed to the air guide 400 by the support ribs 461 and the electrical part support 465, and the other side of the electrical part 460 is fixed to the air guide 400 by the coupling part 462 and the electrical part coupling part 463 while the elevated portion 464 spacing out the electrical part from the air guide 400. In other words, the electrical part 460 can be spaced apart from the air guide 400 by the support of the elevated portion 464.

Further, A part storage space 421 is formed within the lower air guide 420, for storing consumables such as an electrical part and a fuse. The part storage space 421 is provided to store such parts that are required to be replaced repeatedly. Usually, electrical elements that do not require frequent replacement are disposed in the electrical part 460. On the other hand, it is preferable to store the part storage space with parts that require frequent replacements and thus frequent accesses of the user. In order to make easy access to the part storage space 421, the front frame 200 is formed with an opening (refer to 234 in FIG. 67), such that the part storage space 421 can be easily accessed by only opening the front panel 100.

Further, the air guide 400 includes the lower discharge hole door 470 disposed below the lower air guide 420 and a lower door driving motor 471 installed at one end of the door 470 for opening and closing the door 470. In detail, the lower discharge hole door repeatedly swings in the up and down directions at a predetermined angle in order to allow the cool air guided by the lower air guide 420 to be discharged in varying direction. The lower door driving motor 471 repeatedly changes its rotation direction in order to allow the lower discharge hole door 470 to swing in the up and down directions. Therefore, the cooling of the indoor space is more rapidly performed.

Further, the air guide 400 includes heat exchanger receiving ribs 500 having a predetermined height and slope at both side of the back, and rear cover coupling part 490 protrusively formed at a lower portion of the back. In detail, each of the heat exchanger receiving ribs 500 is sloped up from its each end toward its center, as the shape of the heat exchanger 810, thereby preventing leakage of the air sucked from the rear side of the indoor unit 1 and cooled at the heat exchanger 810.

Figure 45:
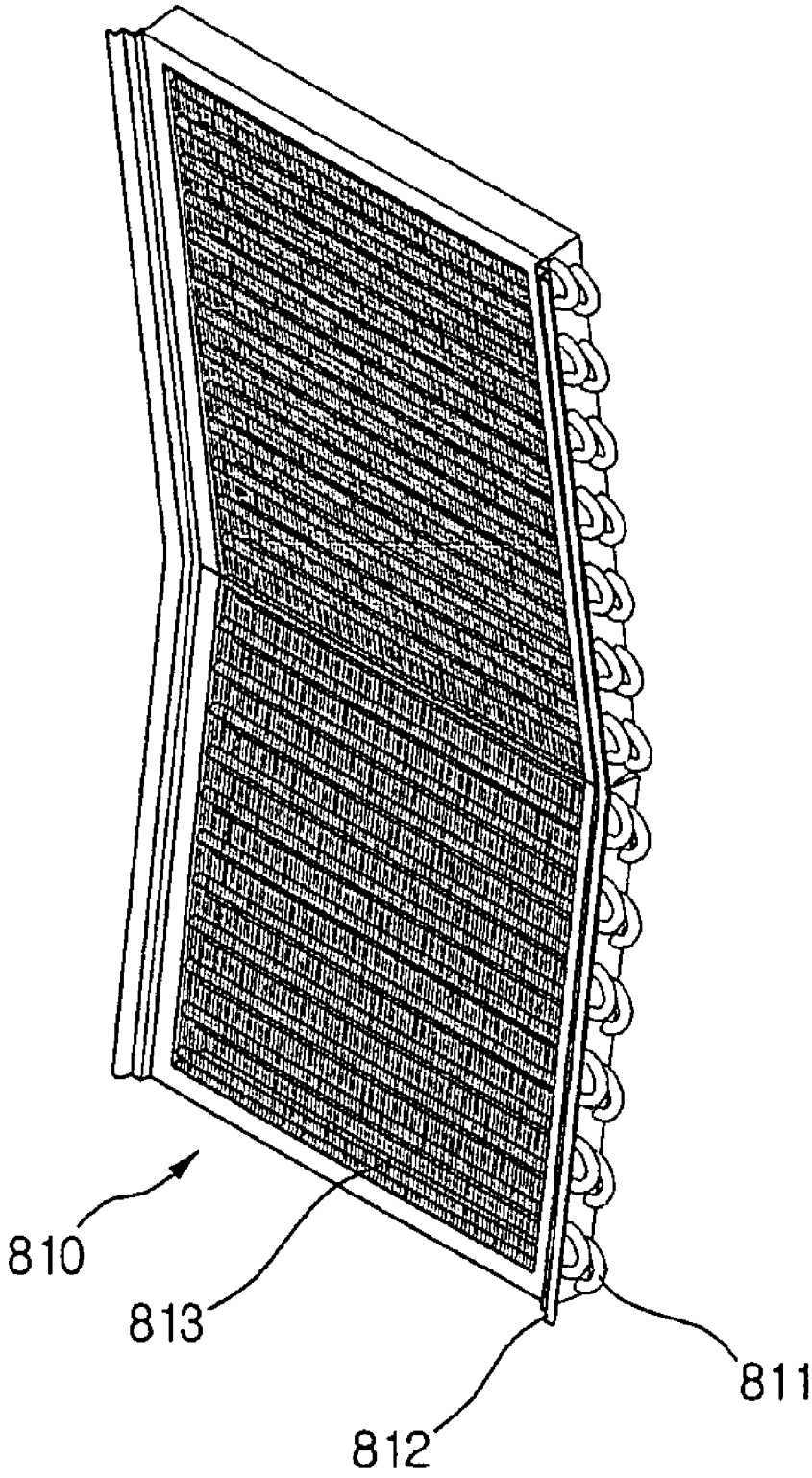
FIG. 45 is a perspective view of a heat exchanger according to the present invention.

FIG. 45 is a perspective view of a heat exchanger according to the present invention.

Referring to FIG. 45, the heat exchanger 810 includes an anti-leakage ribs 812 at both sides, the ribs 812 abutting against the heat exchanger receiving ribs 500 for a reliable sealing of the air. The heat exchanger 810 also includes the tube 811 in which a refrigerant flows and fins 813 for increasing efficiency of the heat exchanger 810.

Figure 46:
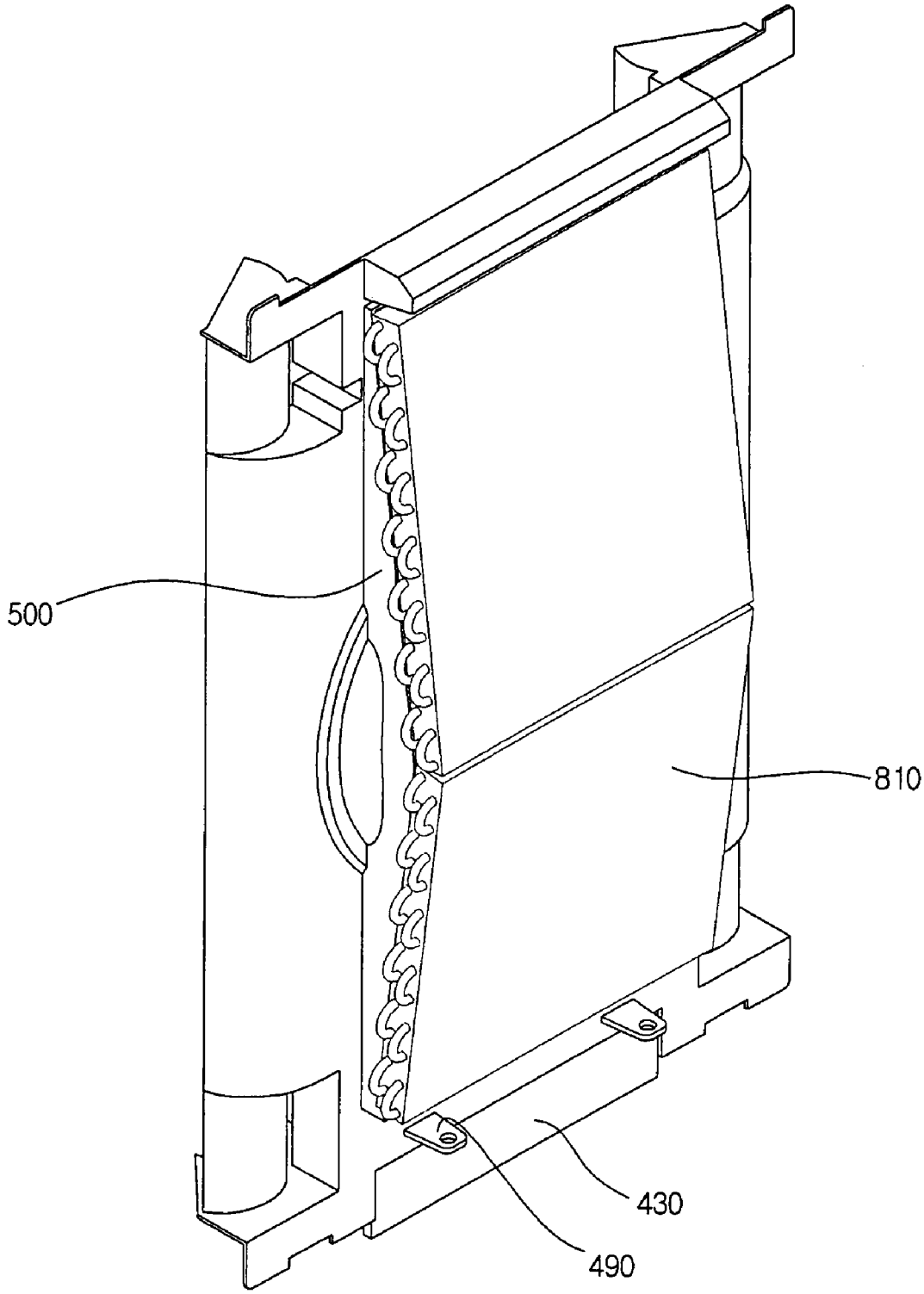
FIG. 46 is a view showing a connection of a heat exchanger and an air guide according to the present invention.
Figure 47:
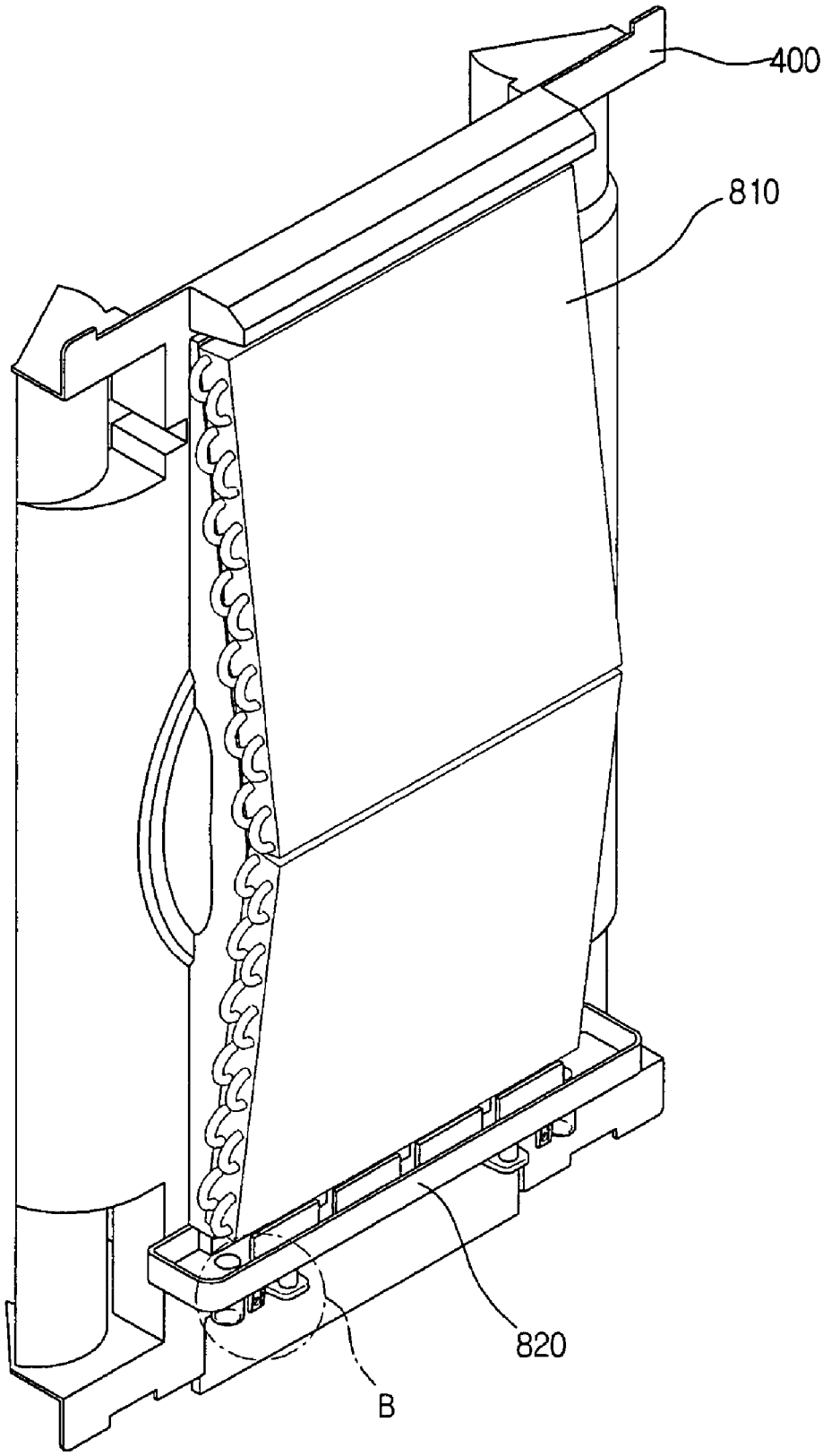
FIG. 47 is a view showing a connection of a heat exchanger, an air guide, and a drain pan according to the present invention.
Figure 48:
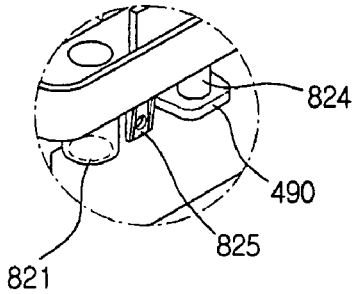
FIG. 48 is a partial enlarged view of "B" depicted in FIG. 47.

FIG. 46 is a view showing a connection of a heat exchanger and an air guide according to the present invention, FIG. 47 is a view showing a connection of a heat exchanger, an air guide, and a drain pan according to the present invention, and FIG. 48 is a partial enlarged view of "B" depicted in FIG. 47.

Referring to FIGS. 46 to 48, the heat exchanger 810 is coupled to the heat exchanger receiving ribs 500 formed at the back of the air guide 400. The drain pan 820 is coupled below the heat exchanger 810. The guides 824 formed at the outer bottom of the drain pan 820 are inserted and fixed to holes formed in the rear cover coupling parts 490, which are integrally formed with the air guide 400. As described above, the bar-shaped guides 824 formed integral with the drain pan 820 are inserted into both the drain pan guide parts 707 formed integral with the rear cover 600 and the rear cover coupling parts 490, such that the drain pan 820, the air guide 400, and the rear cover 600 can be coupled one another.

Further, the drain pan 820 can be securely fixed by coupling the fixing parts 825 and the rear cover 600. The first and second anti-shake ribs 822 and 823 that are formed inside the drain pan 820 are provided to support the bottom of the heat exchanger 810. Since the anti-shake ribs 822 and 823 support the heat exchanger 810, the heat exchanger 820 is prevented from forward and backward shaking.

Figure 49:
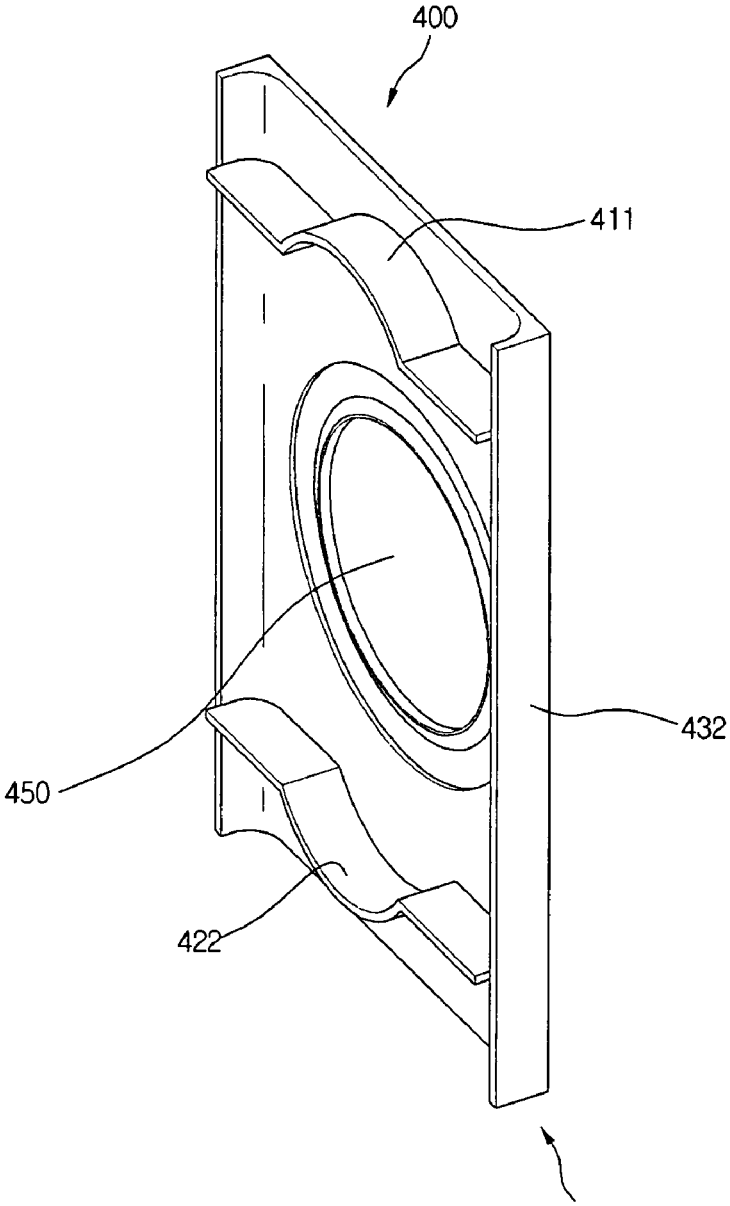
FIG. 49 is a perspective view showing an air guide according to another embodiment of the present invention.

FIG. 49 is a perspective view schematically showing an air guide according to another embodiment of the present invention;

Referring to FIG. 49, the air guide 400 includes an upper air guide 411 and a lower air guide 422 at an upper and lower inside portions. The wind direction shifter receiver 432 at each side of the air guide 400 and the air guide hole 450 are formed in the same manner of the previous embodiments. Merely, the specific shapes of the upper air guide 411 and the lower air guide 422 are different, and these shapes are preferable when the side discharge holes 220 of the indoor unit 1 are narrowly formed in up and down direction in order to concentrate the discharging air. Further, these shapes are more preferable when the bottom discharge hole 210 discharging the air in bottom direction is not formed.

Figure 50:
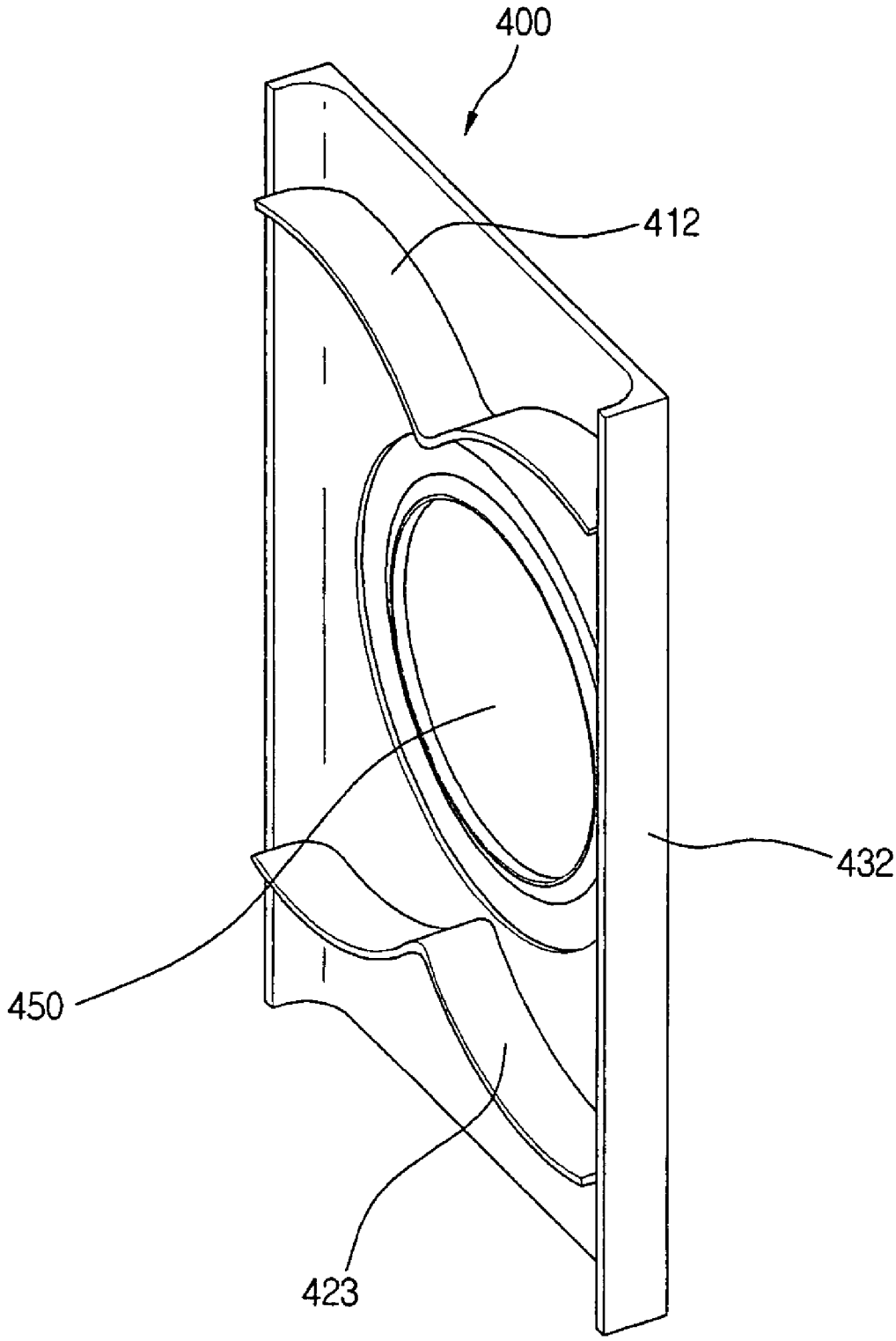
FIG. 50 is a perspective view showing an air guide according to a further another embodiment of the present invention.

FIG. 50 is a perspective view showing an air guide according to a further another embodiment of the present invention.

Referring to FIG. 50, the air guide 400 includes an upper air guide 411 at the upper inside portion, a lower air guide 422 at the lower inside portion, the wind direction shifter receiver 432 at each side, and the air guide hole 450 that are formed in the same manner of the previous embodiments. Merely, the specific shapes of the upper air guide 411 and the lower air guide 422 are different and these shapes are preferable when discharging the air widely in side direction without the bottom discharge hole 210.

The present invention is not limited to the embodiments shown in FIGS. 49 and 50. It will be apparent to those skilled in the art that various embodiments can be made according to the shape of the discharging holes without departing from the scope and spirit of the present invention.

Figure 51:
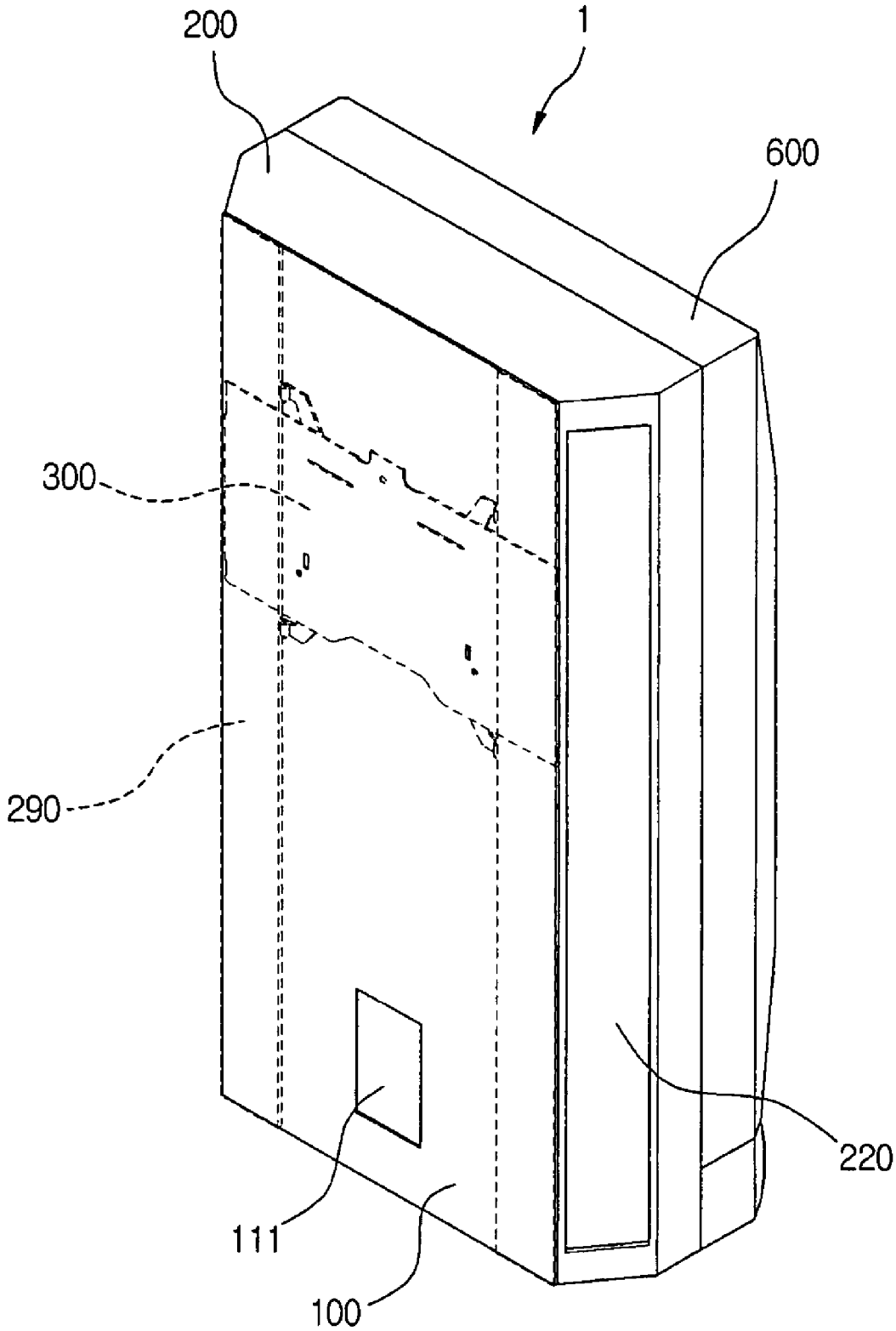
FIG. 51 is a front perspective view of an indoor unit, showing an opening/closing device according to the present invention.

FIG. 51 is a front perspective view of an indoor unit, showing the inside of the indoor unit according to the present invention. In the drawing, a front panel is imaginarily transparent in order to show the inside of the indoor unit.

Referring to FIG. 51, there is shown the opening/closing device 300 inside the front panel 100 and side discharge hole doors 290 to be opened and closed by the opening/closing device 300 that are not shown in FIG. 1. The side discharge holes 220 are opened or closed by the side discharge hole doors 290. When the indoor unit 1 is not used, the side discharge holes 220 can be closed using the side discharge hole doors 290, for an external appearance. When the indoor unit 1 is used, the side discharge holes 220 can be opened using the same.

Figure 52:
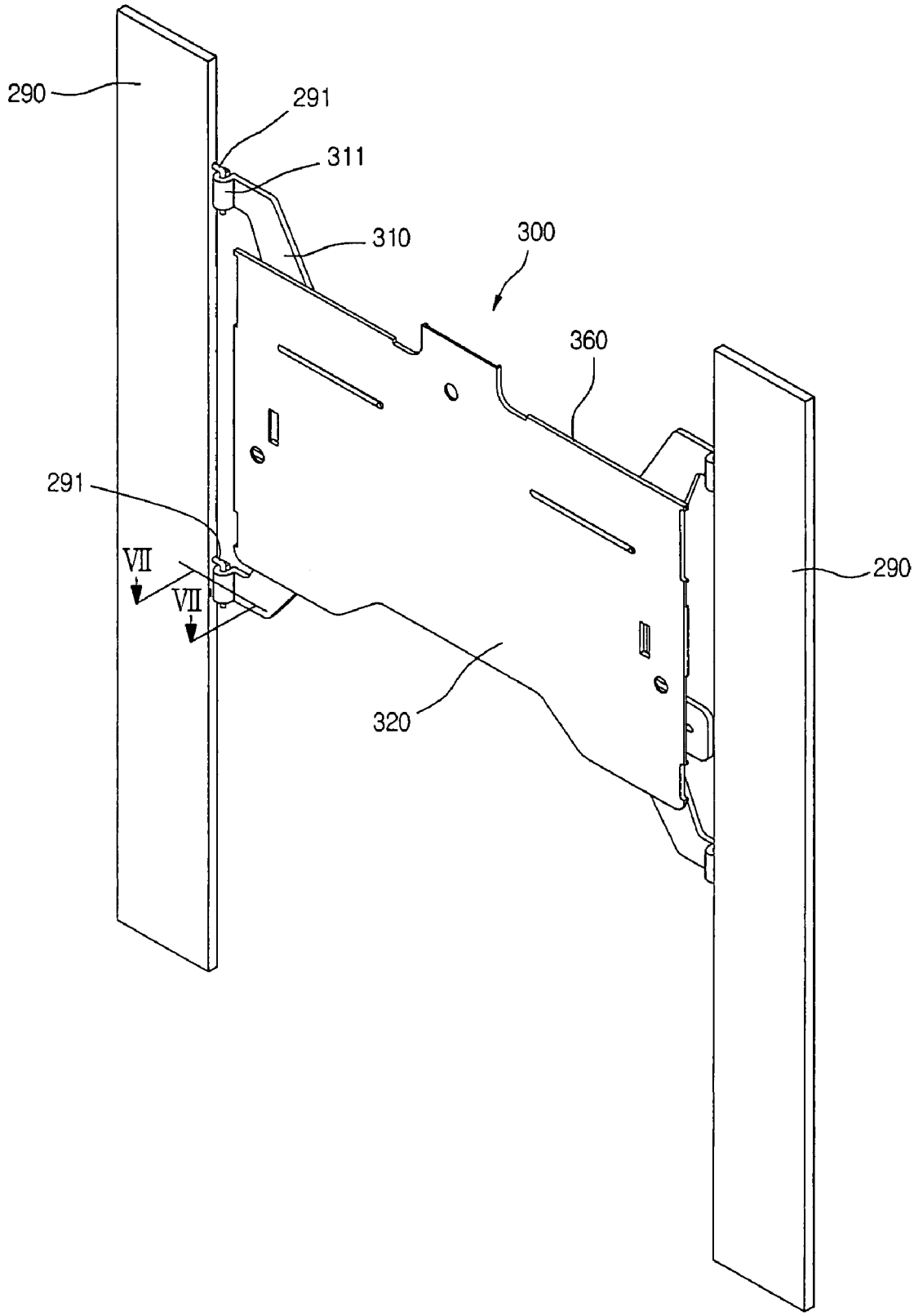
FIG. 52 is a perspective view of an opening/closing device for opening and closing discharge holes according to the present invention.
Figure 53:
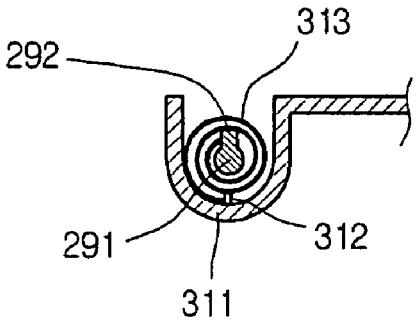
FIG. 53 is a section taken on line VII-VII' in FIG. 52.

FIG. 52 is a perspective view of an opening/closing device for opening and closing discharge holes according to the present invention and FIG. 53 is a section taken on line VII-VII' in FIG. 52.

Referring to FIGS. 52 and 53, an opening/closing device 300 is protected by a front case 320 and a rear case 360 and includes the side discharge hole doors 290 at both sides for opening and closing the side discharge holes 220. Transfer parts 310 controllably shift the side discharge hole doors 290 in the right and left directions.

The connection structure between the discharge hole doors 290 and the transfer parts 310 will now be described more fully.

The connection structure includes: a door support bar 291 extending from a side edge of the discharge hole door 290 and bending downwardly; a hook arm 311 formed having a hook shape at an end of the transfer part 310; a bar protrusion 292 protruded from a circumference of the door support bar 291; an arm protrusion 312 protruded from an inner side of the hook arm 311; and a spring 313 disposed between the bar protrusion 292 and the arm protrusion.

The spring 313 forces the door support bar 291 to rotate in clockwise direction. In detail, the spring connects the door support bar 291 with the hook arm 311 and the spring 313 is disposed in a condition that a restoring force is exerted in winding direction, such that an torque is acting on the door support bar 291 and as well the side discharge hole door 290. Therefore, when the discharge hole door 290 is drawn inside the indoor unit 1, the door 290 abuts against front each side of the indoor unit 1, such that the door 290 is spread in spite of the restoring force of the spring 313. On the other hand, when the door 290 is pushed outside the indoor unit 1, the door 290 is folded along the front, sloped each side of the indoor unit 1 by the restoring force of the spring 313, such that the door 290 can close the side discharge hole 220. The door 290 is somewhat bigger than the side discharge hole 220 to cover the hole 220.

In FIGS. 54 to 61 are shown an opening/closing device. FIG. 59 is a perspective view of a rear case and FIG. 61 is an inside perspective view of an opening/closing device when a front case is removed. The structure and operation of the opening/closing device 300 will be described more fully With reference to FIGS. 59 and 61.

Meanwhile, The opening/closing device 300 includes driving part to which a motor transmits power, a connection part connected with the driving part to transmit power in a predetermined direction or position, a driven part connected with the other end of the connection part to transmit power to the transfer part 310. The driving part, the connection part, and the driven part are provided because the power transmission method between the motor and the transfer part 310 and their location may be changed.

Figure 54:
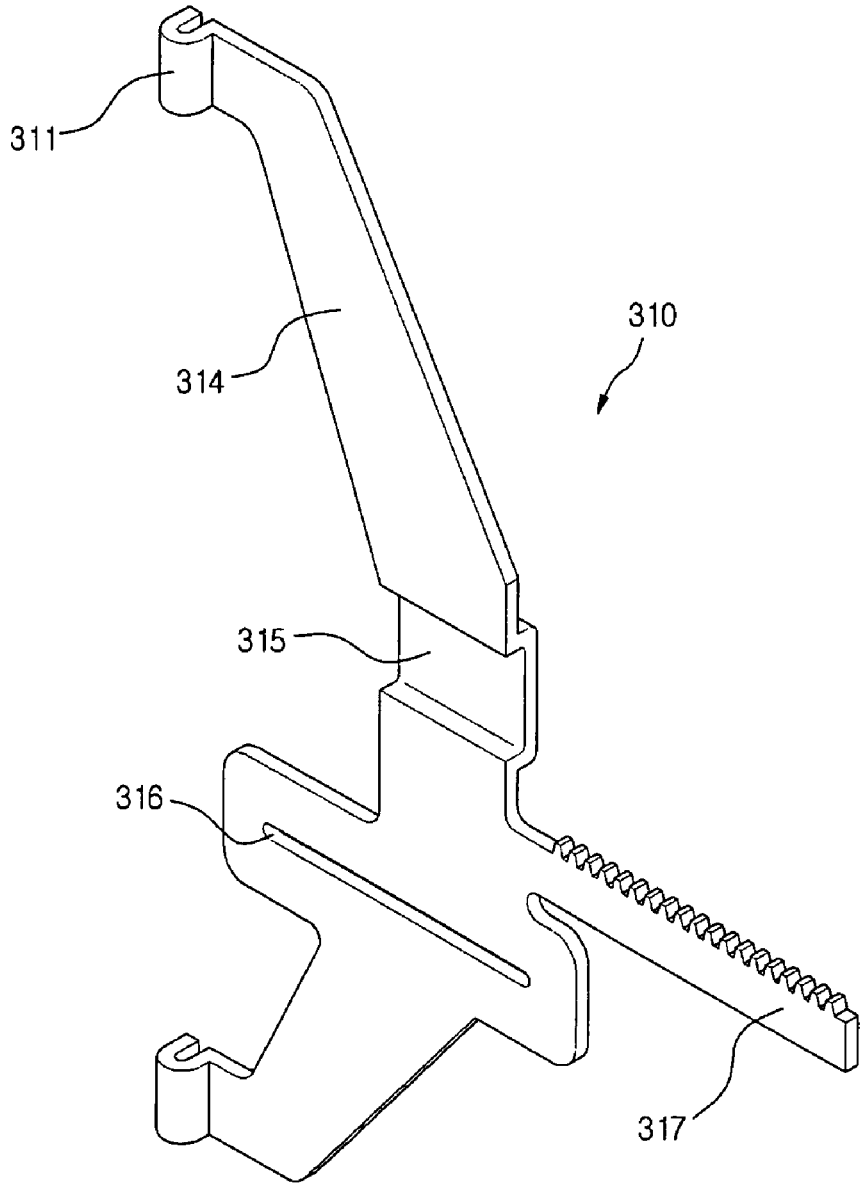
FIG. 54 is a front perspective view of a transfer part according to the present invention.
Figure 55:
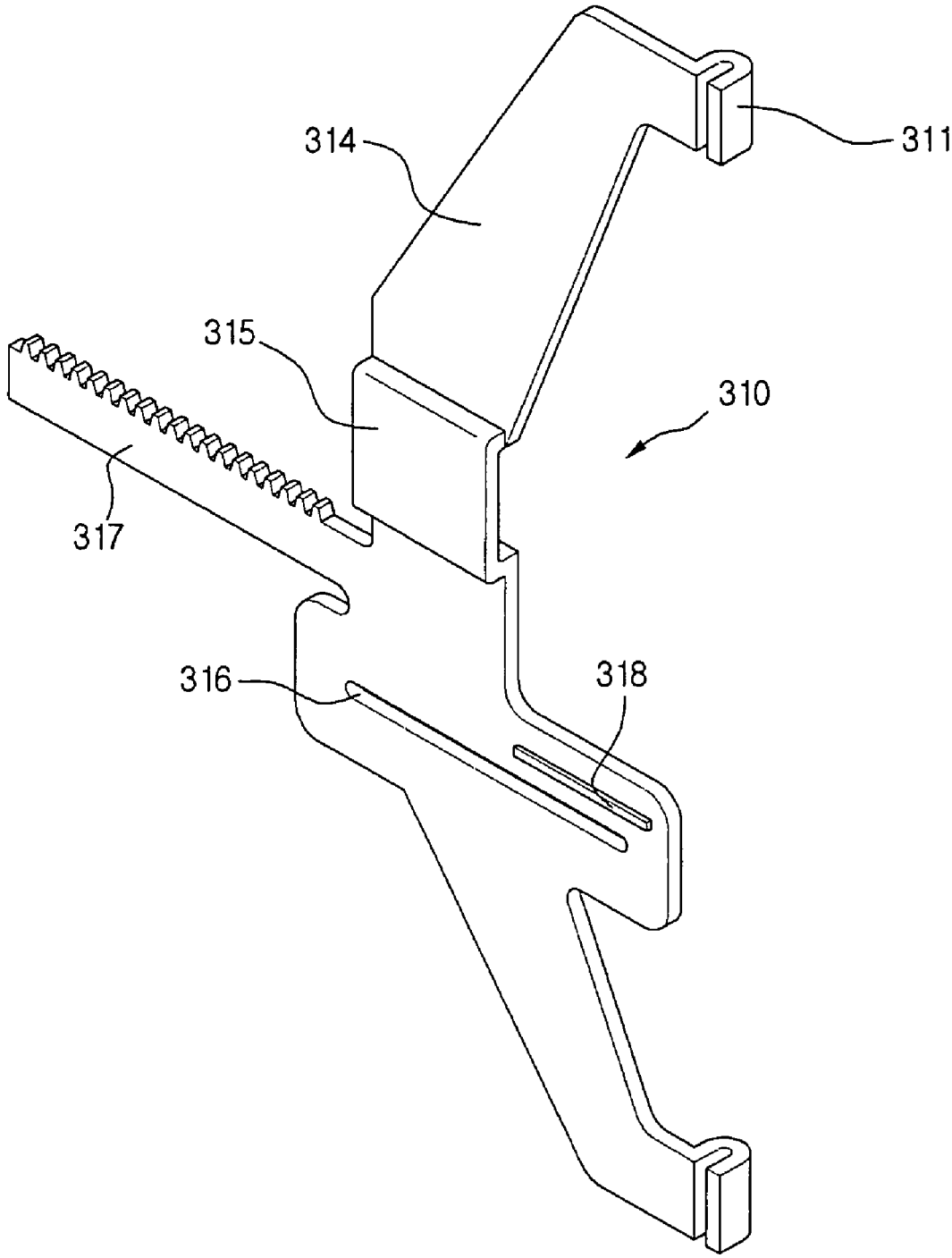
FIG. 55 is a rear perspective view of a transfer part according to the present invention.
Figure 5:
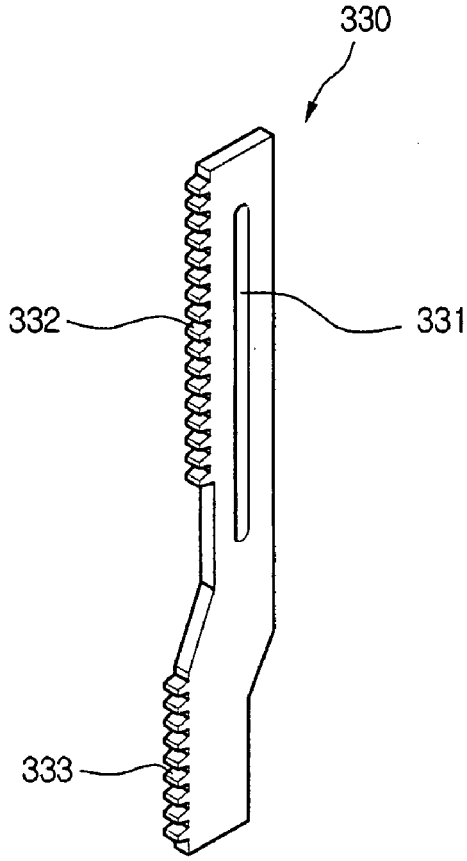
Figure 5:
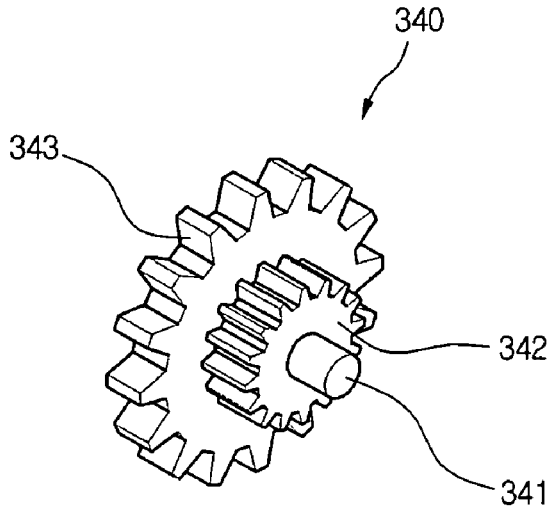
Figure 5:
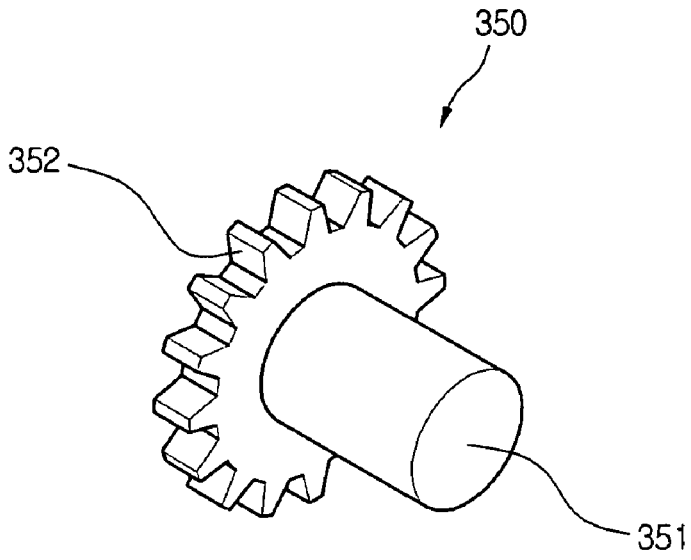
Figure 5:
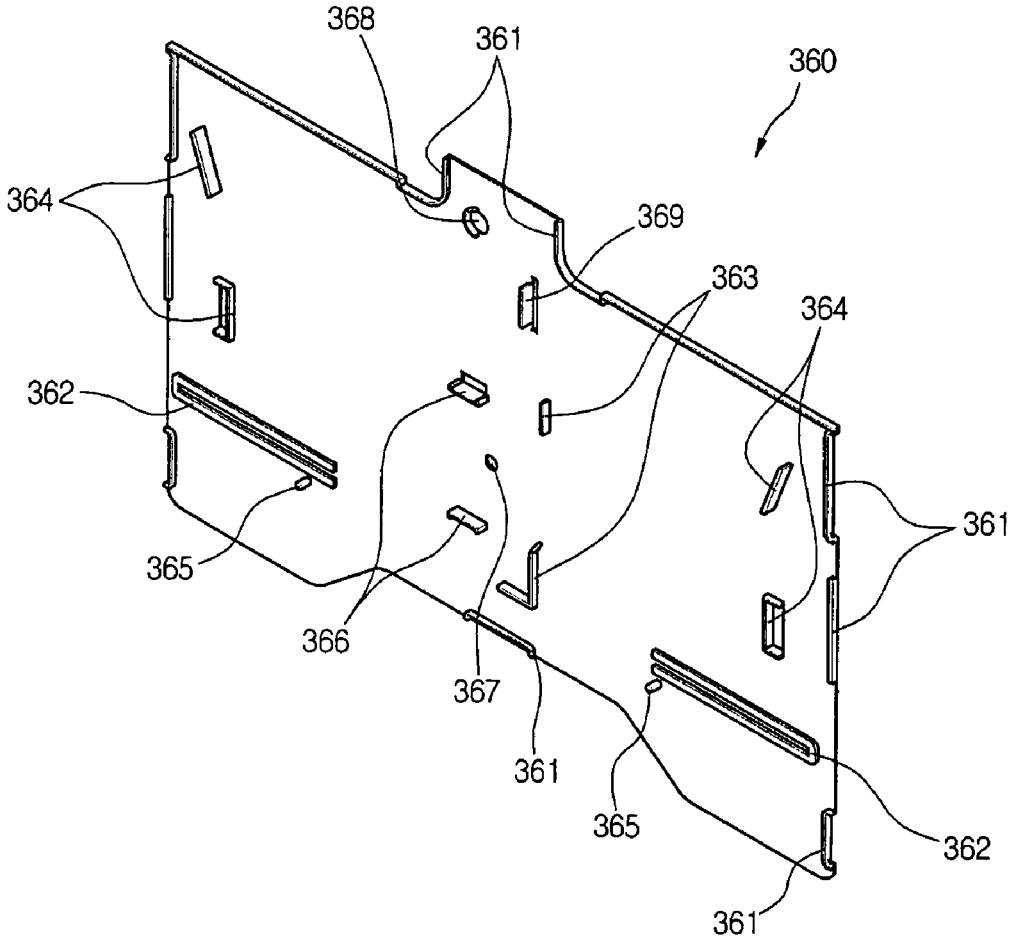

FIG. 54 is a front perspective view of a transfer part according to the present invention and FIG. 55 is a rear perspective view of a transfer part according to the present invention.

Referring to FIGS. 54 and 55, the transfer part 310 includes: the hook arms 311 at end portions, for a connection with the discharge hole door 290; arms 314 extending from the body of the transfer part 310 and having the hook arms 311 at its ends; a rack 317 with which a driven gear 340 is engaged; a rack guide 315 for guiding an opposing rack; a guide groove 316 and a guide rib 318 that are formed at a predetermined portion in horizontal direction, for exactly guiding a horizontal movement of the transfer part 310. The transfer part 310 is provided at each side to move the discharge hole door 290 provided at the each side.

FIG. 56 is a perspective view of a link according to the present invention.

Referring to FIG. 56, a link 330 functions to transmit a driving force from a driving gear 350 to the driven gear 340. In detail, the link 330 having a flat shape includes a driving rack 332 to which the driving force of the driving gear 350 is transmitted and a driven rack 333 transmitting the driving force to the driven gear 340. The link 330 has a sloped portion according to the position of the driving and driven gears 350 and 340.

FIG. 57 is a perspective view of a driven gear according to the present invention.

Referring to FIG. 57, the driven gear 340 transmits power from the link 330 to the rack 317. For this purpose, the driven gear 340 includes two toothed portions. In detail, the driven motor 340 includes a second gear 343 with a bigger diameter and a first gear 342 with a smaller diameter that are stacked in the front and rear direction, and a shaft 340 as a central axis. The second gear 343 is engaged with the rack 317, for a translational motion of the transfer part 310. The first gear 342 is engaged with the driven rack 333 in order to be driven by the link 330.

FIG. 58 is a perspective view of a driving gear according to the present invention.

Referring to FIG. 58, the driving gear 350 is driven by a discharge door motor (refer to 370 in FIG. 60) and drives the rack 330. The driving gear 350 includes a rotation axis 351 connected to the discharge door motor 370 and a third gear 352 engaged with link 330 to transmit power.

FIG. 59 is a perspective view of a rear case.

Referring to FIG. 59, the rear case 360 receives a number of parts and guides the operations of the parts. The rear case 360 is formed with a fixing rib 361 for a coupling with a periphery of the front case 320, such that the inside parts can be protected within a box shaped structure formed by the coupling of the front and rear cases 320 and 360.

The structure and shape of the rear case 360 will now be described more fully. To guide the motion the transfer part 310, the rear case 360 includes: a guide protrusion 365 formed at a position corresponding to the guide groove 316 of the transfer part 310, for guiding horizontal motion of the transfer part 310; and a rib guide 362 formed at a position corresponding to the guide rib 318 of the transfer part 310 in order to provide a more reliable guide for the motion of the transfer part 310. Herein, the guide rib 318 of the transfer part 310 is inserted into the rib guide 362 for the reliable guide. The guide protrusion 365 and the rib guide 362 are provided at each side of the rear case 360 in order to guide two transfer parts 310 that are disposed at both sides.

Further, the rear case 360 includes link guides 363 protruded perpendicular to the surface of the rear case 360, for preventing the link 330 from separation. The gears 340 and 350 may support left side of the link 330 and the link guides 363 may support right side of the link 330. The upper and lower sides of the link 330 are free ends and thereby the link 330 can be shifted in the up and down directions.

Further, the rear case 360 is provided at both sides with transfer part guides 364 shaped corresponding to the peripheral shape of the transfer part 310. The transfer part guide 364 are positioned to meet the transfer parts 310 when the discharge hole doors 290 are completely closed and are shaped corresponding to the peripheral shape of the transfer part 310, such that the transfer part guides 364 are exactly surface-contacted with the transfer parts 310 when the discharge hole doors 290 are completely closed. In other words, the transfer part guides 364 function to set right and left shifting limits of the transfer parts 310 and thereby the transfer parts 310 are prevented from departing from the right and left shifting limits.

Further, the rear case 360 includes rack guides 366 protruded from the surface thereof, for guided the horizontal motion of the transfer parts 310 more exactly. In detail, the rack guides 366 abut against the racks 317 of the transfer parts 310 when the racks 317 are engaged with the driven gear 340. That is, the rack guides 366 abut against straight sides opposing to the toothed sides of the racks 317, such that the rack guides 366 can prevent a disengagement of the racks 317 and the driven gear 340 while the racks 317 are moving in the right and left directions. Therefore, the rack guides 366 can guide the horizontal motion of the transfer parts 310 more exactly, together with the rib guides 362 and the guide protrusions 365.

Further, the rear case 360 includes a driving gear mount hole 368 and a driven gear mount hole 367 at predetermined portions, for mounting the driving gear 350 and the driven gear 340 in exact positions.

Figure 60:
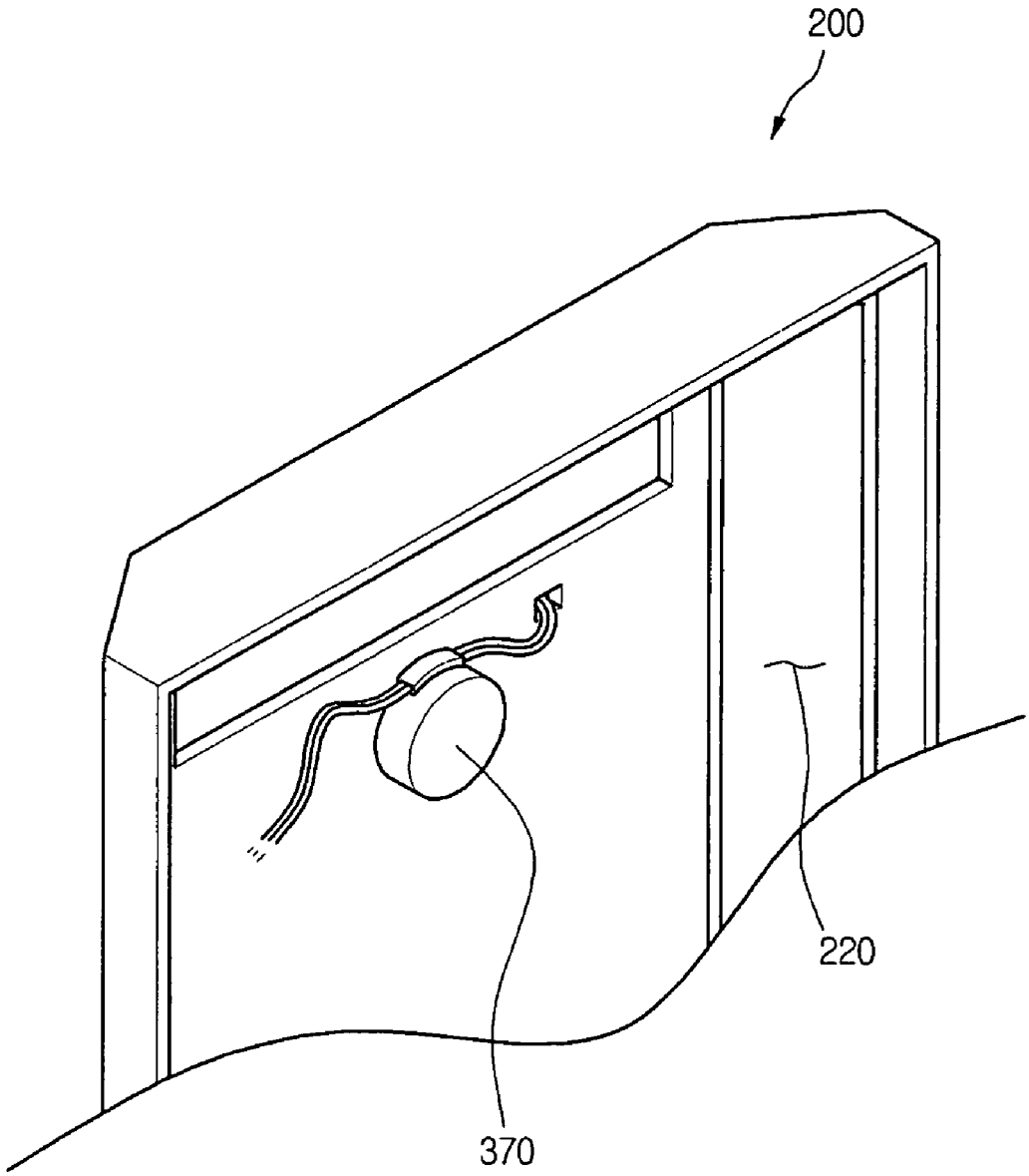
FIG. 60 is a rear perspective view of a front frame to which a discharge door motor is coupled according to the present invention.
Figure 6:
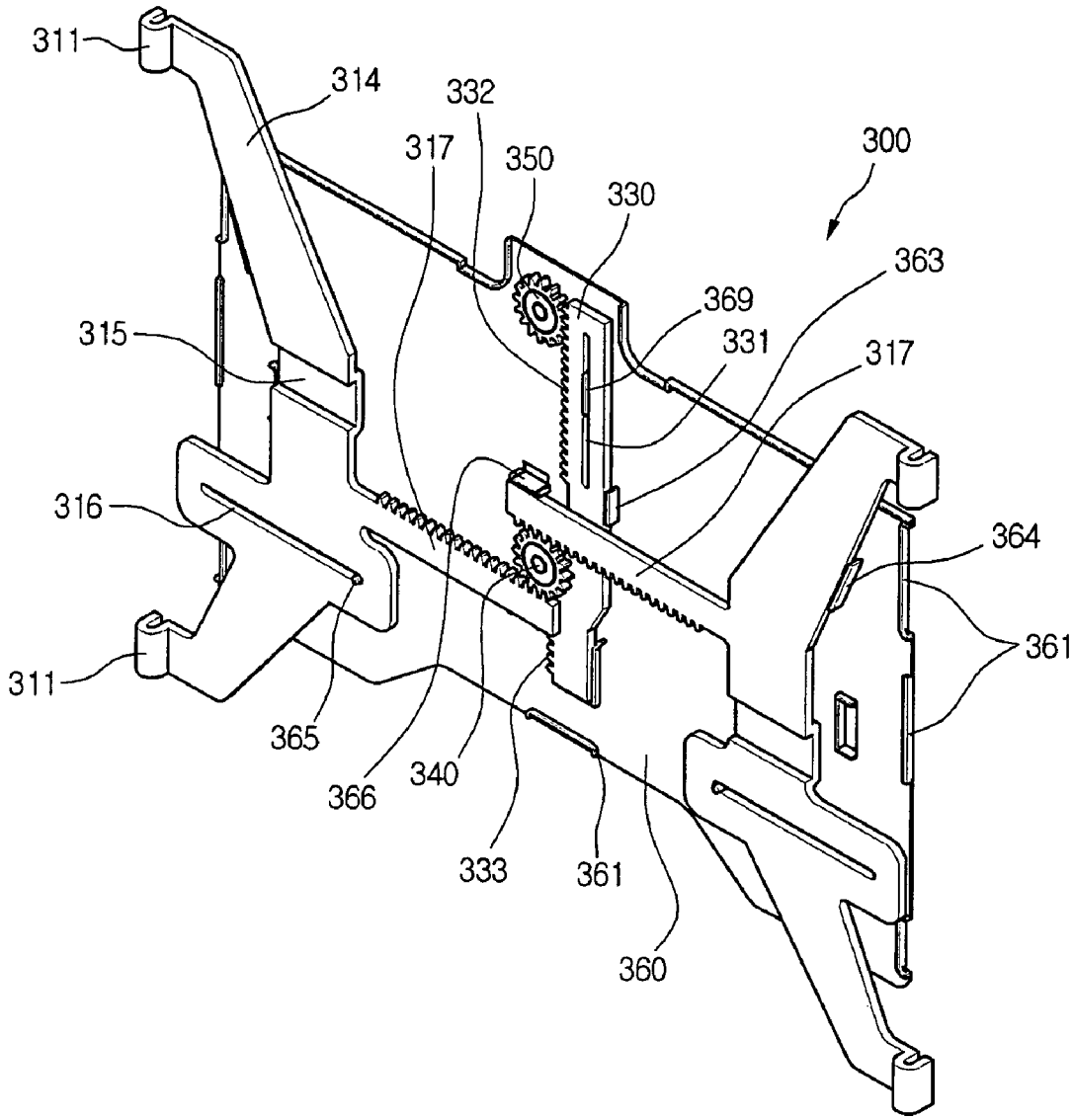
Figure 6:
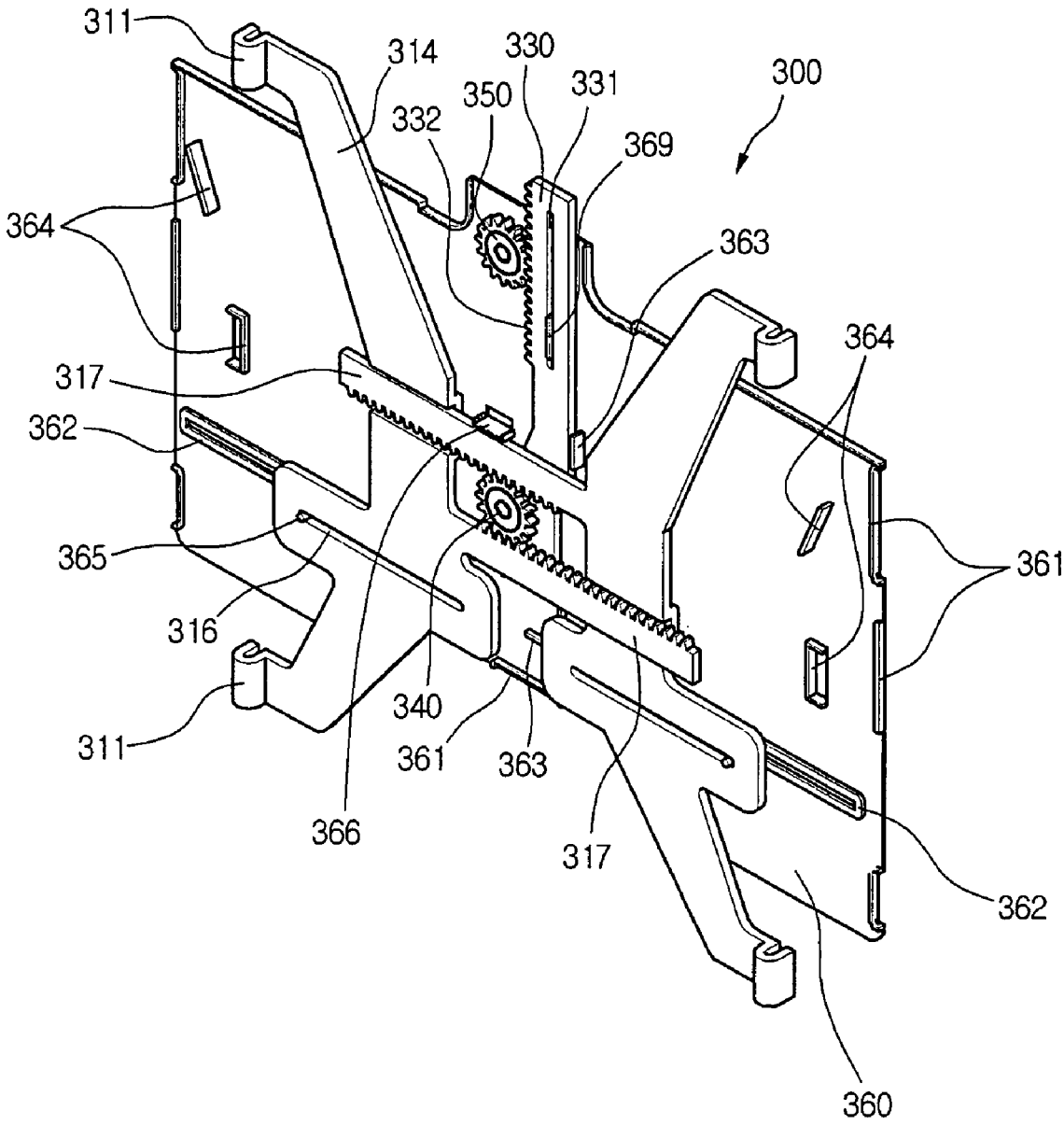

FIG. 60 is a rear perspective view of a front frame to which a discharge door motor is coupled according to the present invention.

Referring to FIG. 60, the discharge door motor 370 is installed at a location corresponding to the driving gear mount hole 368. Preferably, the discharge door motor 370 is a step motor capable of changing rotational directions instantly and freely.

The operational steps of the opening/closing device 300 will now be described.

When the side discharge holes 220 is required to be opened or closed according to the operation of the indoor unit 1, the discharge door motor 370 is driven in one direction or the other direction. As the discharge door motor 370 is driven, the driving gear 350 is rotated to cause a translational motion of the link 330 in the up and down directions. The link 330 can be shifted to exact positions in exact directions under the guides of a vertical link guide 369 and the link guides 363. The driven rack 333 formed at one portion of the link 330 is engaged with the smaller first gear 342 of the driven gear 340, such that the translational motion of the link 330 can rotate the driven gear 340. The transfer part 310 is moved in the right and left direction by the rotation of the driven gear 340. Herein, the second gear 343 of the driven gear 340 is engaged with the rack 317 of the transfer part 310 to cause a translational motion of the transfer part 310 in the right and left direction.

The guide groove 316 and the guide rib 318 may be used to generally guide the horizontal motion of the transfer part 310 and the rack guides 366 may be used to exactly guide the rack 317 of the transfer part 310. Since the rack guides 366 guide the rack 317, the tooth engagement between the rack 317 and the second gear 343 can be exactly guided and maintained, and thereby an idle motion therebetween can be prevented.

FIGS. 61 and 62 are views showing an opening/closing device for opening and closing a discharge holes according to the present invention, in which FIG. 61 shows closed discharge holes when transfer parts are located at outward position and FIG. 62 shows opened discharge holes when the transfer parts are located at inward position.

Referring to FIGS. 61 and 62, the above-mentioned motion of the transfer part 310 can be clearly understood with reference to the drawings. In detail, when the driven gear 340 is rotated in a clockwise direction, the racks 317 move outwardly to close the side discharge holes 220. It will be apparent that the link 330 moves downward and the driving gear 350 rotates in the clockwise direction in order to rotate the driven gear 340 in the clockwise direction. Further, the rack guides 366, the guide groove 316, and the guide rib 318 are used to function to guide the transfer part 310 exactly in the horizontal direction when the transfer part 310 is shifted.

Meanwhile, as mentioned above, the hook arms 311 and the discharge hole doors 290 are connected in such a manner that when the discharge hole doors 290 are moved outwardly, the restoring force of the spring 313 causes the doors 290 to be rotated toward both the sloped front sides where the discharge holes 220 are formed, such that the doors 290 can smoothly cover the side discharge holes 220.

Meanwhile, the rack guides 315 are formed at the transfer parts 310 to prevent interference between the opposing racks 317.

Referring again to FIG. 62, when the transfer parts 310 are shifted inwardly and each rack 317 overlaps opposing transfer part 310, the rack 317 of one transfer part 310 is guided to move into the rack guide 315 of the other transfer part 310, such that the transfer parts 310 can be shifted individually and exactly without interference therebetween.

Figure 63:
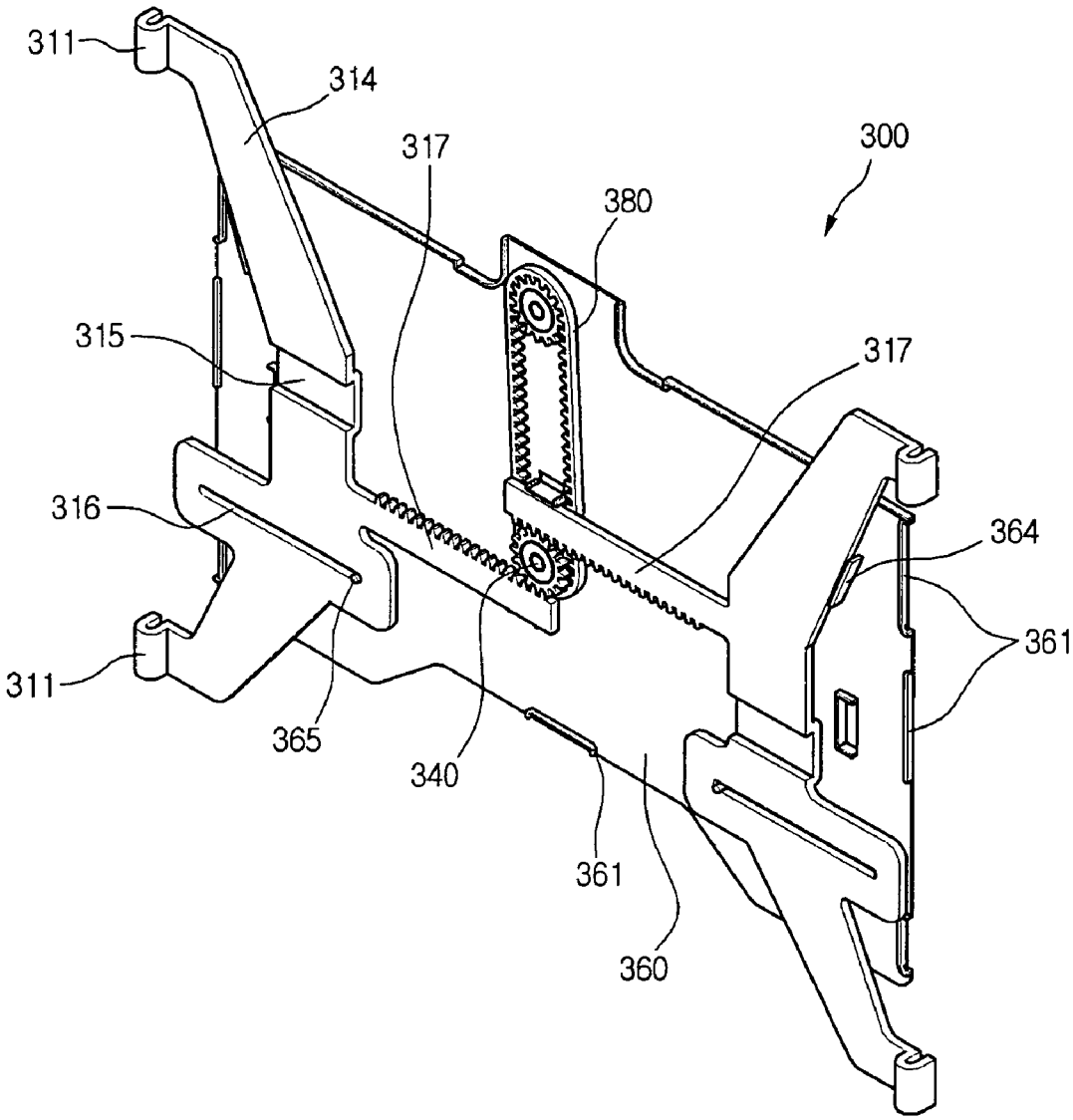
FIG. 63 is a view showing an opening/closing device according to another embodiment of the present invention.

FIG. 63 is a view showing an opening/closing device according to another embodiment of the present invention.

Referring to FIG. 63, an opening/closing device 300 of this embodiment has almost the same structure as described in previous embodiment. Therefore, descriptions for the same structure will be omitted. The opening/closing device 300 includes a belt 380 instead of the link 330 to transmit power from the driving gear 350 to the driven gear 340. In other words, the belt 380 replacing the link 330 connects the third gear 352 of the driving gear 350 with the first gear 342 of the driven gear 340 in order to transmit the power therebetween. The belt 380 may be replace by any kind of power transmitting means such as a chain and this replacement is included in this embodiment. Merely, the power transmitting means is capable of smoothly transmitting power without slipping.

Figure 64:
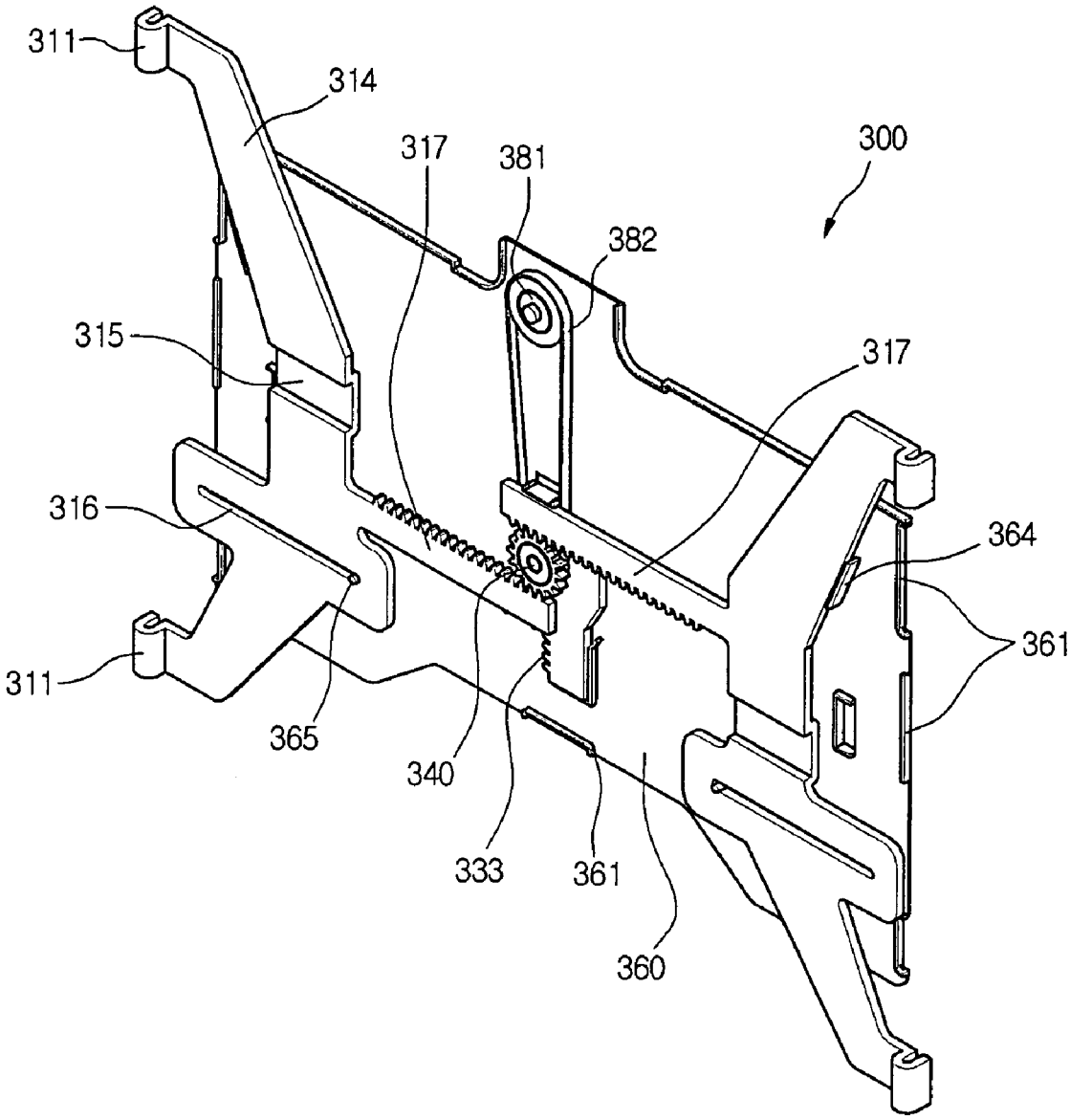
FIG. 64 is a view showing an opening/closing device according to a further another embodiment of the present invention.

FIG. 64 is a view showing an opening/closing device according to a further another embodiment of the present invention.

Referring to FIG. 64, an opening/closing device 300 of this embodiment has almost the same structure as described in previous embodiment. Therefore, descriptions for the same structure will be omitted. The opening/closing device 300 includes a roller 381 instead of the driving gear 350. The roller 381 does not have a toothed circumference and the first gear 342 of the driven gear 340 is also formed with a toothed circumference. A belt 382 is disposed around the circumferences of the roller 381 and the first gear 342, for connecting the roller 381 with the first gear 342. With this structure, the opening/closing device 300 can be operated in the same way.

Figure 65:
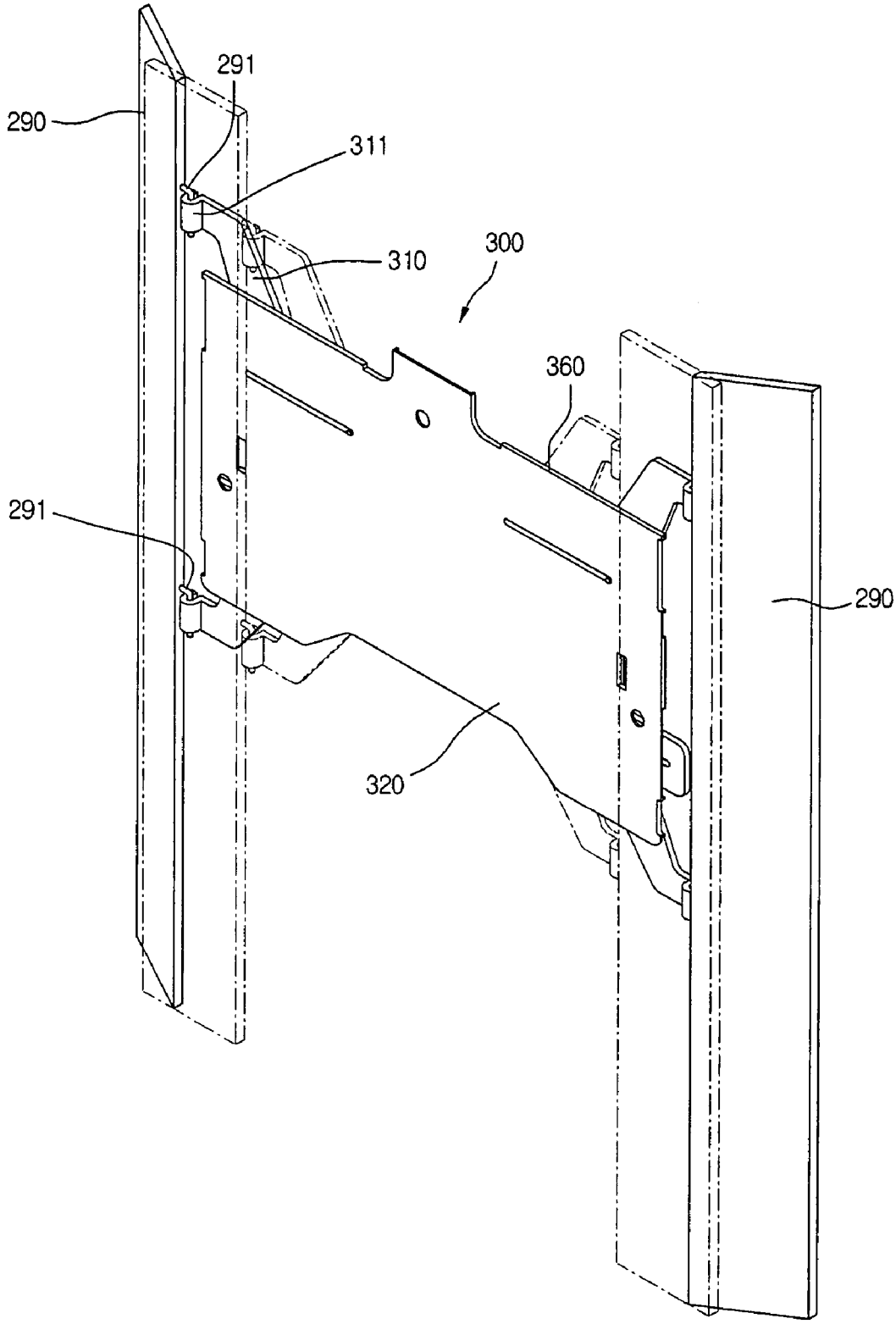
FIG. 65 is a view showing an operation of an opening/closing device according to the present invention.

FIG. 65 is a view showing an operation of an opening/closing device according to the present invention.

Referring to FIG. 65, when the transfer parts 310 are being shifted outward, the discharge hole doors 290 are moving outwardly while rotating toward the sloped side discharge holes 220 in order to close the sloped discharge holes 220. The rotational movement of the discharge hole doors 290 is caused by the springs 313 as is already shown in FIG. 53 and description thereof. When the side discharge holes 220 are opened, the discharge hole doors 290 moves inwardly along the sloped sides of the front frame 200 while maintaining their flat shapes, such that the discharge hole doors 290 can keep their flat shapes when the transfer parts 310 are completely moved to the inward locations.

Figure 66:
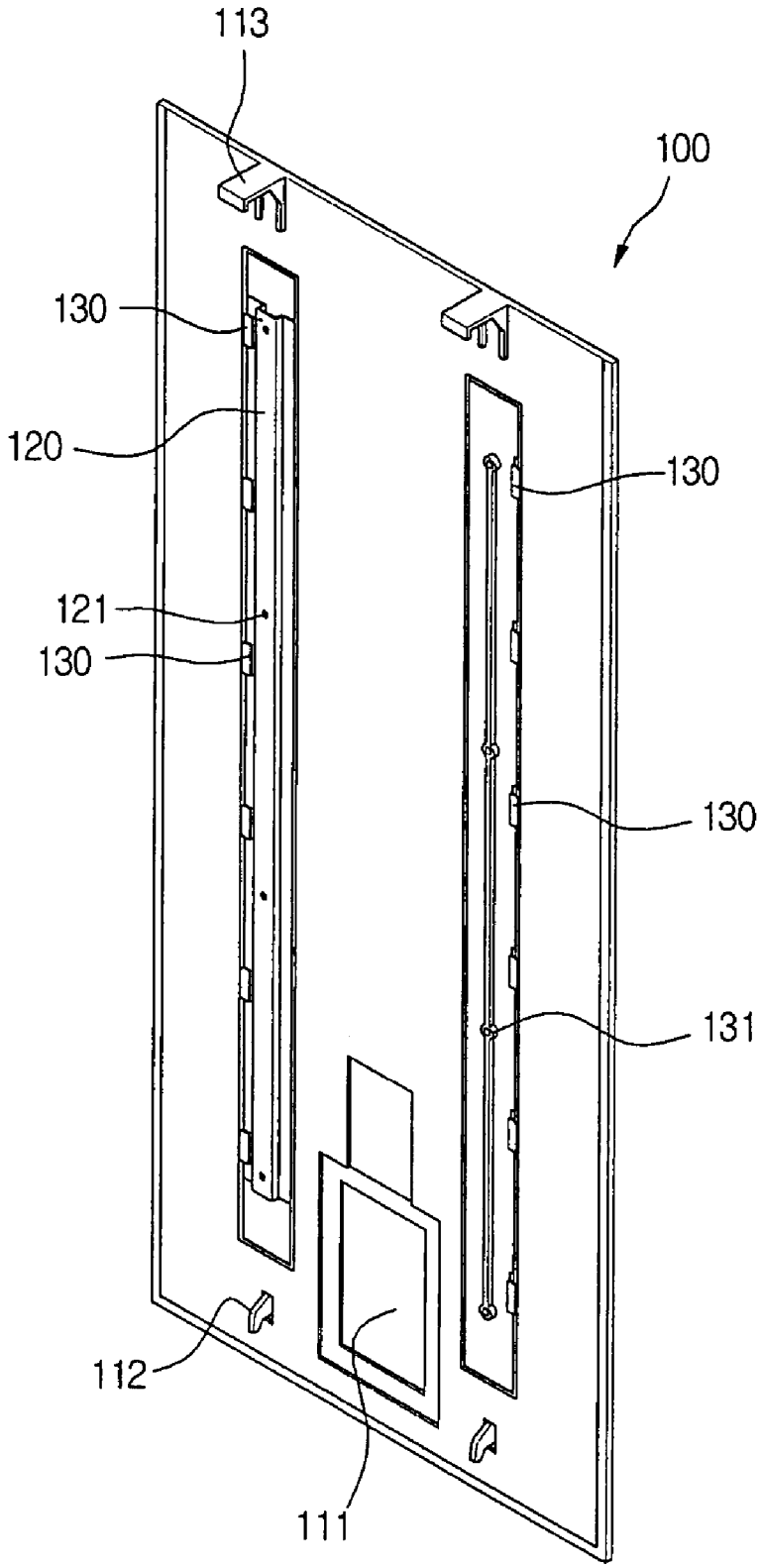
FIG. 66 is a rear perspective view of a front panel according to the present invention.

FIG. 66 is a rear perspective view of a front panel according to the present invention.

Referring to FIG. 66, the front panel 100 is provide at the front of the indoor unit 1 and may be painted with various colors or decorated with pictures or photographs.

In detail, the front panel 100 includes: the window 111 formed at a predetermined location with a transparent material, for allowing a picture and screen of the display unit (refer to 240 in FIG. 67) to be seen therethrough; upper hooks 113 protrusively formed at rear upper portions, for coupling with the front frame 200; and lower hooks 112 protrusively formed at rear lower portions. The front panel 100 can be hung on the front frame 200 and securely fixed thereto by means of the upper hooks 113 and the lower hooks 112.

The front panel 100 may be made of a plastic material for the cost and convenience of fabrication. However, since the front panel 100 made of a plastic material has a strength problem such as a deformation and a breakage, at least one reinforcement member 120 may be attached in a vertical direction of the front panel 100 to overcome the problem. There are shown two reinforcement members 120 in the drawing. The reinforcement member 120 may be made of a metal that has a high strength.

A structure of the reinforcement member 120 and corresponding structure of the front panel 100 will now be described in detail. The reinforcement member 120 has a hat-shaped section. In other words, the reinforcement member 120 has a groove along its vertical centerline, and its both side ends are bent and extended in lateral outward directions. The reinforcement member 120 includes holes 121 through which coupling members are to be inserted, for coupling the member 120 to the front panel 100. The front panel 100 includes: bosses 131 corresponding to the holes 121; a rib formed in vertical direction to connect the bosses 131 for protecting them; and a plurality of guide ribs 130 for supporting side end of the reinforcement member 120. The front panel 100 may include a groove at a rear portion on which the reinforcement member 120 is to be seated, for receiving the member 120 in exact position. In this case, the guide ribs 130 may be formed at the groove.

Installation steps of the reinforcement member 120 will now be described in detail. Seating the reinforcement member 120 on exact location of the front panel 100 by using the guide ribs 130. Herein, the holes 121 and the corresponding bosses 131 are aligned if the guide ribs 130 exactly guided the reinforcement member 120. Inserting the coupling members through the holes 121 and bosses 131 that are aligned, thereby completing coupling of the reinforcement member 120 and the front panel 100. In FIG. 66 is shown the reinforcement member 120 coupled to the left side of the front panel 100, but to the right side.

Figure 67:
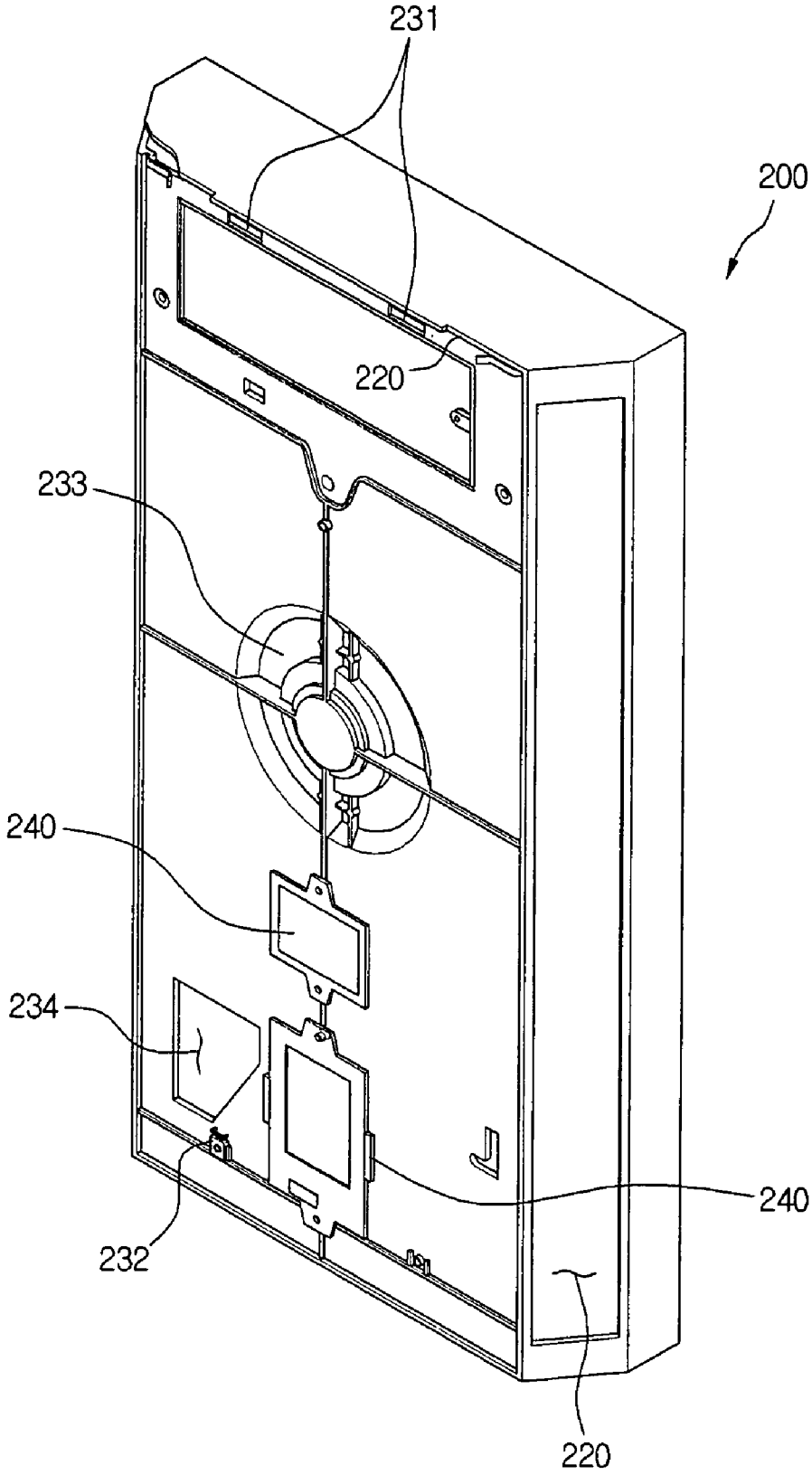
FIG. 67 is a front perspective view of a front frame according to the present invention.

FIG. 67 is a front perspective view of a front frame according to the present invention.

Referring to FIG. 67, the front frame 200 includes: the side discharge doors 220 at both sloped sides; upper panel supports 231 at an upper portion to which the upper hooks 113 of the front panel 100 are coupled; and lower panel supports 232 at a lower portion to which the lower hooks 112 of the front panel 100 are coupled. The front panel 100 can be fixed to the front frame 200 due to the upper supports 231 and the lower supports 232 without additional coupling members such as screws, such that the user can easily remove the front panel 100 to inspect the inside of the indoor unit 1 and perform a requiring work. Coupling members may be applied in order to securely fix the front panel 100 to the front frame 200.

Further, the front frame 200 includes: a motor receiving part 233 at a front; and a display unit 240 at which a display device such as liquid crystal display is to be located, for indicating the operational status of the indoor unit 1.

Further, the front frame 200 includes an opening 234 at a predetermined lower portion, for an easy access to parts stored at the part storage space 421. When the user is going to repair the indoor unit 1, the user can easily repair or replace the troubled parts by using the parts inside the part storage space 421 through the opening 234 after only removing the front panel 100, instead of disassembling the whole indoor unit 1.

Figure 68:
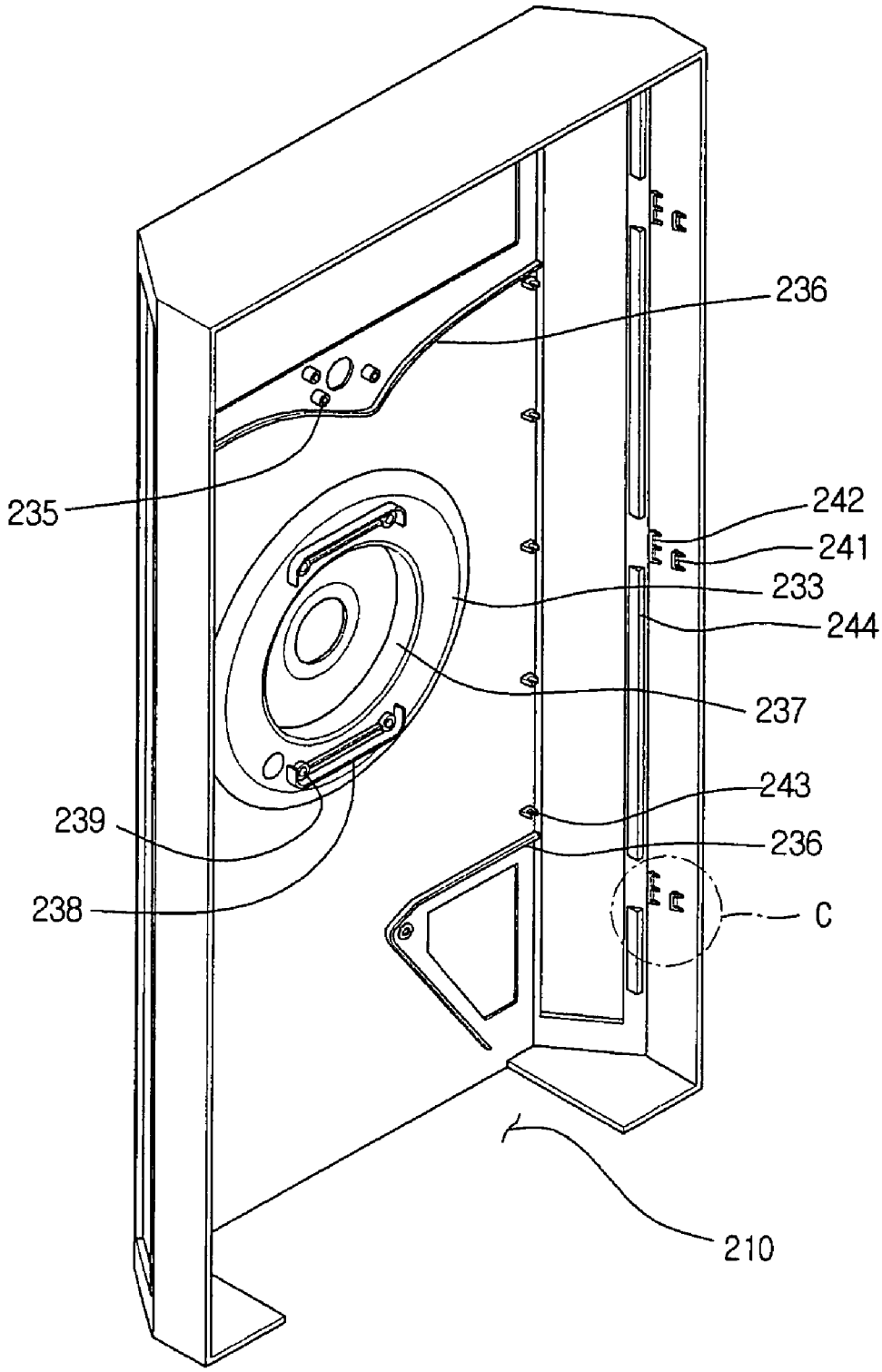
FIG. 68 is a rear perspective view of a front frame according to the present invention.
Figure 69:
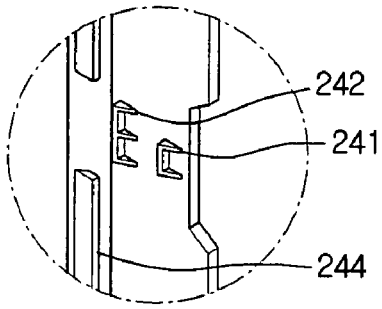
FIG. 69 is a partial enlarged view of "C" depicted in FIG. 68.

FIG. 68 is a rear perspective view of a front frame according to the present invention and FIG. 69 is a partial enlarged view of "C" depicted in FIG. 68.

Referring to FIGS. 68 and 69, the front frame 200 includes a motor fixing part 235 for receiving the discharge door motor 370 and thereby the discharge door motor 370 can be mounted in an exact position. Further, the front frame 200 includes the bottom discharge hole 210 at the bottom as described above.

Further, the front frame 200 includes air sealing parts 236 at the rear with shapes corresponding to the upper air guide 410 and the lower air guide 420, for preventing an air leakage at the contact points with the upper and lower air guides 410 and 420. It is apparent that the air sealing parts 236 have the shape corresponding to the upper and lower air guides 410 and 420, for reducing the loss of the cool air.

Further, the front frame 200 includes a plurality of air guide hooks 242 and rear cover hooks 241 at inner side surface portions, for exact coupling with the air guide 400 and rear cover 600. The air guide hooks 242 and the rear cover hooks 241 are respectively coupled with corresponding coupling parts formed at front edges of the air guide 400 and the rear cover 600. Further, the front frame 200 includes side sealing parts 244 fixed at inner sides using such a method of adhering, for preventing the discharged air from re-entering through the side discharge holes 220 and passing again the air guide 400. Further, the front frame 200 includes safety screen supports 243, for supporting one side of the safety screen 440, such that the safety screen 440 cannot be removed due to a pushing force of the user.

Meanwhile, the front frame 200 is provided at a central portion of an inner surface with a motor receiving part 233 for receiving a fan motor 280 driving the blower fan 800. The fan motor 280 is supported while its vibration being damped. The supporting structure for the motor 280 will now be described. A receiving portion 237 is formed at a central caved portion of the motor receiving part 233, for receiving a vibration-proof member, such that the vibration propagation from the fan motor 280 to the front frame 200 can be damped due to the vibration-proof member disposed between the fan motor 280 and the front frame 200. The vibration-proof member may be made of a sponge, an elastic material or the like.

Further, a motor mount (refer to FIG. 71) is separately provided to fix the fan motor 280 to the front frame 200. The fan motor 280 is placed within the motor mount and the motor mount is coupled to the front frame 200, thereby completing the mounting of the fan motor 280. In detail, the front frame 200 includes: a motor mount supporting part 238, for guiding the motor mount and indicating the location on which the motor mount is fixed; and a motor mount fixing part 239, for fixing the motor mount to the front frame 200.

Figure 70:
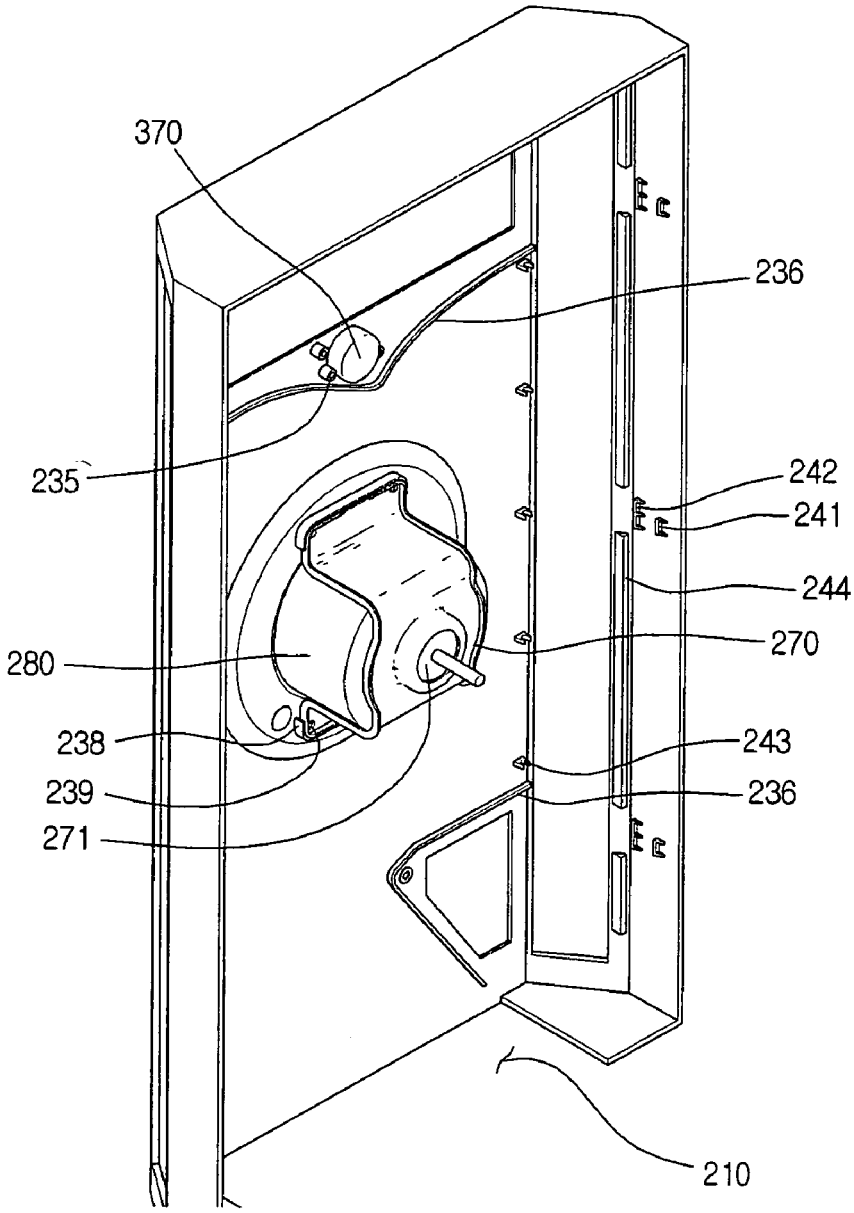
FIG. 70 is a rear perspective view of a front frame to which a motor is mounted according to the present invention.
Figure 7:
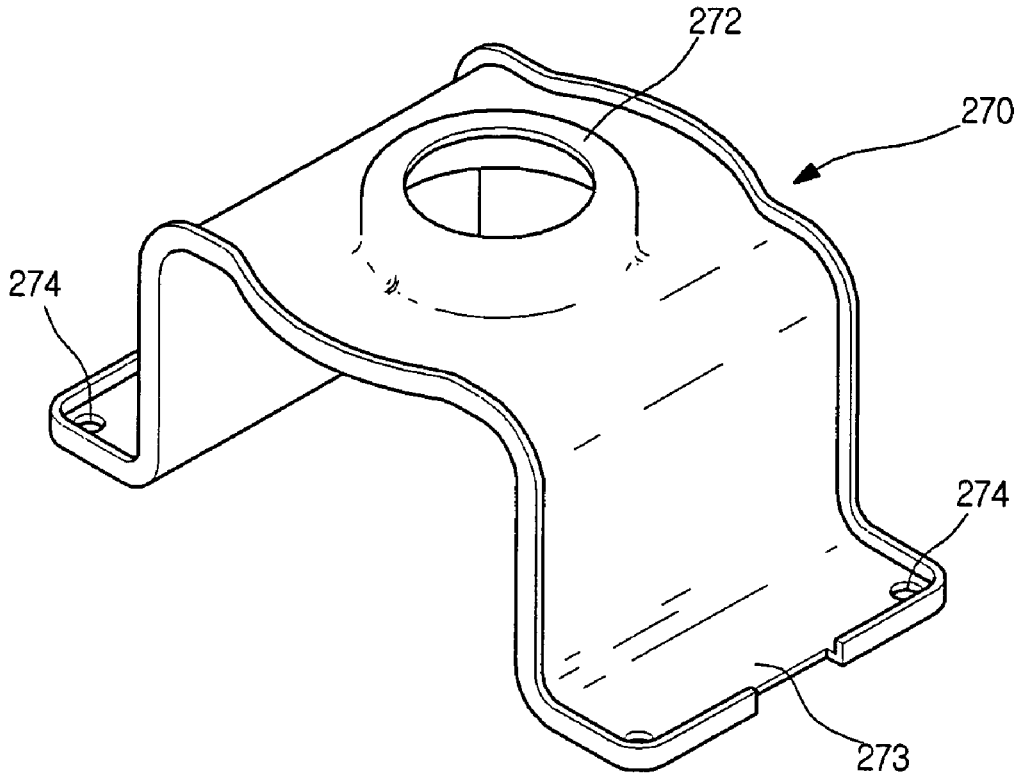

FIG. 70 is a rear perspective view of a front frame to which a motor is mounted using a motor mount according to the present invention.

Referring to FIG. 70, after the motor mount 270 accommodating the fan motor 280 is suspended at the motor mount supporting part 238, coupling members are inserted in the motor mount fixing part 239, such that the motor mount 270 can be securely fixed to the front frame 200. A vibration-proof member 271 is filled in a space formed between the motor mount 270 and a front of the fan motor 280, for efficiently damping a vibration propagating from the front of the fan motor 280 toward the motor mount 270. In other words, the vibration propagating from the fan motor 280 toward the front frame 200 is damped by the vibration-proof member disposed in the receiving portion 237 and the vibration propagating from the fan motor 280 toward the motor mount 270 is damped by the vibration-proof member 271, such that the vibration generated from the fan motor 280 can be prevented from propagating, thereby efficiently reducing the vibration and noise generating during the operation of the fan motor 280.

FIG. 71 is a perspective view of a motor mount according to the present invention.

Referring to FIG. 71, the motor mount 270 includes: a vibration-proof member receiving part 272 in which the vibration-proof member 271 is inserted; supporting parts 273 received at the motor mount receiving parts 238, for guiding the mounting location of the motor mount 270; and fixing holes 274 formed at the supporting parts 273 of the front frame 200, for an alignment with the motor mount fixing parts 239 of the front frame 200.

The motor mount supporting parts 238 of the front frame 200 is used to guide the motor mount 270 on the front frame 200 and predetermined coupling members are inserted into the fixing holes 274 and the motor mount fixing parts 239, such that the motor mount 270 can be fixed to the front frame 200.

MODE FOR INVENTION

An indoor unit of an air conditioner of the present invention has been described and illustrated herein with reference to the preferred embodiments thereof, it will be apparent to those skilled in the art that various modifications and variations can be made therein without departing from the spirit and scope of the invention. Thus, it is intended that the present invention covers the modifications and variations of this invention that come within the scope of the appended claims and their equivalents.

There will now be provided a number of embodiments that can be changed without departing from the spirit and scope of the present invention.

In case a front panel and a front frame are coupled in such a way that they are coupled using a hinge at one side and a hook at the other side, instead of a way of hooking the front panel to the front frame, the repairing work or the like can be more conveniently carried out.

Further, in case a front panel is provide to cover a predetermined portion, instead of entire portion, of a front frame, the front frame can be formed with a discharge hole at a center portion and thereby can supply a cool air more rapidly.

Further, a grill provided in a suction hole of a rear cover is not limited to the shape shown in accompanying drawings. The grill can be formed in any shape that is capable of smoothly sucking air and being safely used by the user. Also, though support protrusions of the rear cover are formed at four corners of the rear cover, for supporting and properly distributing the load of an indoor unit, the location and shape of the support protrusions can be changed according to the operational condition, shape or size of the indoor unit.

Further, a motor mount accommodating a fan motor includes two end faces with a symmetric relationship and a bent-shape formed by bending two times respectively. The bent-shape of the motor mount can be changed according to the shape of the fan motor.

Meanwhile, an indoor unit of the present invention can be conveniently used for an air conditioner that has one outdoor unit and two indoor units. Specifically, one of the indoor units is mounted on a wall and the other indoor unit is placed on a floor, thereby increasing user's convenience.

Further, a character image can be displayed on a display unit of an indoor unit according to the operational status of the indoor unit, thereby increasing user's convenience and interest.

Further, a heat exchanger of an indoor unit is bent at about central portion, for heat exchange efficiency. However, the heat exchanger can be bent at two or more portions without limitation, such that more heat can be exchanged at the heat exchanger.

INDUSTRIAL APPLICABILITY

An indoor unit of an air conditioner has an efficient and integrated structure, such that energy efficiency and user's convenience can be increased. The integrated-structure indoor unit also has a simple and strong structure, such that the life span of the indoor unit can be increased.

Further, the airflow of the indoor unit is improved with a rear-suction/front-discharge method, such that the indoor unit can be installed at desired location without limitation, thereby increasing user's convenience.

Furthermore, the indoor unit has a larger blast capacity compared to the same-sized indoor unit, such that the indoor unit can have an increased efficiency.

The invention claimed is:

1. An indoor unit of an air conditioner, comprising:

a rear cover disposed at a rear side of the indoor unit and through which indoor air is sucked;

a front frame disposed at a front side of the indoor unit and through which the indoor air is discharged;

a heat exchanger for performing heat exchange of the indoor air sucked through the rear cover;

an air guide located at an inner space formed by the rear cover and the front frame, for guiding airflow;

a blower fan for forcibly flowing the indoor air;

an air guide hole formed at a middle portion of the air guide and through which the air is passed; and an upper air guide and a lower air guide, the upper air guide being formed at an upper side portion a front side of the air guide to guide cool air, and the lower air guide being formed at a lower side portion of the front side of the air guide and spaced apart from the upper air guide, for guiding the cool air in a discharge direction, wherein the air guide comprises a wind direction shifter part smoothly curvedly formed at both side ends of the air guide, for guiding the discharged air.

2. The indoor unit according to claim 1, wherein the upper air guide and/or the lower air guide are/is formed integrally with the air guide.

3. The indoor unit according to claim 1, further comprising an electrical part mounted on an upper side of the air guide.

4. The indoor unit according to claim 1, wherein the lower air guide is downwardly opened so as to guide the cool air toward a lower side of the indoor unit.

5. The indoor unit according to claim 1, wherein the lower air guide guides the cool air toward both sides of the indoor unit.

6. The indoor unit according to claim 1, wherein the lower air guide comprises a part storage part formed at an inner space thereof, for storing parts.

7. The indoor unit according to claim 1, wherein the upper air guide has a middle portion which is lower than both side ends.

8. The indoor unit according to claim 1, wherein the air guide comprises an electrical part which is disposed on an upper portion of the air guide and is spaced apart from a body of the air guide.

9. The indoor unit according to claim 1, wherein the lower air guide comprises a bottom discharge hole door formed at a bottom thereof, for selectively discharging the cool air.

10. An indoor unit of an air conditioner comprising:

a front frame forming a front appearance of the indoor unit;

a rear cover forming a rear appearance of the indoor unit;

a blower fan disposed behind the front frame;

an air guide including:

an air guide hole formed at a middle portion of the air guide, for guiding an indoor air sucked through the rear cover by the blower fan, an upper air guide and a lower air guide for guiding the indoor air sucked through the air guide hole, and a wind direction shifter mounting part formed at both side ends of the air guide;

a wind direction shifter mounted inside the wind direction shifter mounting part; and a heat exchanger for performing heat exchange.

11. The indoor unit according to claim 10, further comprising an electrical part mounted on an upper side of the air guide and spaced apart from a body of the air guide.

12. The indoor unit according to claim 10, wherein the wind direction shifter mounting part is formed curvedly toward a front direction.

13. The indoor unit according to claim 10, wherein the wind direction shifter mounting part comprises a wind direction shifter mounting guide for guiding a mounting of the wind direction shifter.

14. The indoor unit according to claim 10, further comprising a safety net formed at a space between the wind direction shifter and the blower fan.

15. The indoor unit according to claim 10, further comprising a safety net supported by the air guide for a user's safety.

16. The indoor unit according to claim 10, further comprising:

a bottom discharge hole door installed at a bottom of the air guide; and a driving motor for driving the bottom discharge hole door.

17. The indoor unit according to claim 10, wherein the air guide comprises a heat exchanger mounting rib formed in a similar shape to the heat exchanger and inclined at a predetermined angle.

18. The indoor unit according to claim 10, further comprising a rear cover coupling member formed at a bottom of a rear side of the air guide and coupled with a base and/or a drain fan.

19. The indoor unit according to claim 10, wherein the air guide hole has an edge including a bell mouth curved at a predetermined curvature radius.

20. The indoor unit according to claim 10, wherein the wind direction shifter rotates in a predetermined angle range.

21. The indoor unit according to claim 10, further comprising a leakage preventing rib formed at both side ends of the heat exchanger, for preventing the cool air from being leaked.

22. An indoor unit of an air conditioner, comprising:

a rear cover disposed at a rear side of the indoor unit;

a front frame disposed at a front side of the indoor unit;

a heat exchanger for performing heat exchange;

a blower fan for sucking indoor air through the rear cover and forcibly flowing the indoor air toward an inner space and an outer space of the indoor unit; and an air guide including an air guide hole for flowing the air, and an upper air guide formed at a front upper portion of the air guide, for guiding the indoor air sucked through the air guide hole to be discharged toward both side portions of the indoor unit, wherein the air guide comprises a wind direction shifter part smoothly curvedly formed at both side ends of the air guide, for guiding the discharged air.

23. The indoor unit according to claim 22, wherein the air guide further comprises a lower air guide formed at a front lower portion of the air guide, for guiding the cool air to be discharged at a lower side of the indoor unit.

24. The indoor unit according to claim 1, wherein the lower air guide extends with a slope in a direction tangential to a circumference of the blower fan.

25. The indoor unit according to claim 10, wherein the lower air guide extends with a slope in a direction tangential to a circumference of the blower fan.

26. The indoor unit according to claim 22, wherein the lower air guide extends with a slope in a direction tangential to a circumference of the blower fan.

27. The indoor unit according to claim 1, wherein the upper air guide is configured to block the cool air from passing through the upper air guide.

* * * * *